US006441290B2

(12) United States Patent
Fujita et al.

(10) Patent No.: US 6,441,290 B2
(45) Date of Patent: Aug. 27, 2002

(54) APPARATUS AND METHOD FOR REPRODUCING OR RECORDING, VIA BUFFER MEMORY, SAMPLE DATA SUPPLIED FROM STORAGE DEVICE

(75) Inventors: Yoshio Fujita; Keisuke Mikata, both of Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 52 days.

(21) Appl. No.: 09/772,635

(22) Filed: Jan. 30, 2001

(30) Foreign Application Priority Data

Feb. 1, 2000 (JP) ..... 2000-024459
Feb. 2, 2000 (JP) ..... 2000-024551
Feb. 2, 2000 (JP) ..... 2000-024637

(51) Int. Cl.[7] ..... G10H 7/00
(52) U.S. Cl. ..... 84/603; 84/604; 84/605; 84/606
(58) Field of Search ..... 84/600–606, 609–610, 84/634, 649–650, 666

(56) References Cited

U.S. PATENT DOCUMENTS 5,321,198 A 6/1994 Suzuki et al.
5,386,529 A * 1/1995 Kondo ..... 84/603
5,525,748 A 6/1996 Kuribayashi et al.
5,892,170 A * 4/1999 Ichiki et al. ..... 84/605
6,242,681 B1 * 6/2001 Daishoji ..... 84/604

* cited by examiner

*Primary Examiner*—Marlon T. Fletcher
(74) *Attorney, Agent, or Firm*—Morrison & Foerster LLP

(57) ABSTRACT

Sample data stored in a storage device, such as a hard disk, are sequentially read out and transferred to a buffer memory, and the sample data are read out from the buffer memory, one sample per sampling period. Sample data at addresses of the buffer memory, where sample data read out has been completed, are sequentially updated with sample data newly read out from the storage device. Jump-from address and jump-to address are set while the sample data are being read out, sample by sample, from the buffer memory. When the read address of the buffer memory reaches the set jump-from address, the read address of the buffer memory is caused to jump to the jump-to address to carry on reading out the sample data from the jump-to address onward. Such readout control for the address jump is used for reproduction of silent data and repetitive sound. Basic waveform data of a given tone stored in memory are read out and subjected to desired waveform editing arithmetic processing, so that the resultant edited waveform data are buffered. The thus-buffered edited waveform data are read out and audibly reproduced. The buffer memory includes a plurality of banks, and a plurality of channels are allocated to respective separate banks. Sample data of a plurality of channels are written into or read out from the corresponding banks by sequentially switching between the banks on a sample-by-sample basis.

49 Claims, 23 Drawing Sheets

T1: ONE SAMPLE OF DATA OF RECORDING CHANNEL WRITTEN INTO SDRAM (VIA SIGNAL LINE 69)
ONE SAMPLE OF DATA OF REPRODUCTION CHANNEL READ OUT FROM SDRAM (VIA SIGNAL LINE 69)

T2: PLURAL SAMPLE OF DATA OF RECORDING CHANNEL DMA-TRANSFERRED FROM SDRAM TO HDD (VIA BUS 56)
PLURAL SAMPLE OF DATA OF REPRODUCTION CHANNEL DMA-TRANSFERRED FROM HDD TO SDRAM (VIA BUS 56)

APPARATUS AND METHOD FOR REPRODUCING OR RECORDING, VIA BUFFER MEMORY, SAMPLE DATA SUPPLIED FROM STORAGE DEVICE

TITLE OF THE INVENTION

Apparatus and Method for Reproducing or Recording, via Buffer Memory, Sample Data Supplied from Storage Device

BACKGROUND OF THE INVENTION

The present invention relates to an improved apparatus and method for reproducing, or recording and reproducing sample data (i.e., data sampled at an appropriate sampling frequency) recorded in a storage device, such as a hard disk.

Among the conventionally-known digital mixing recorders is the so-called hard disk recorder which uses a hard disk device (hereinafter also referred as an "HDD") to perform recording, reproduction, mixing, etc. of sound signals of a plurality of tracks. In such a hard disk recorder, sound signals input from an external source are written via a buffer memory into the HDD for recording of the sound signals, and the thus-recorded sound signals are reproduced by reading out the sound signals from the HDD and outputting them via the buffer memory to the outside. More specifically, in the hard disk recorder, sound data are recorded in predetermined unit performance segments (e.g., data of clusters) dispersedly at appropriate address locations of a memory. To reproduce these recorded sound data, a series of the sound data is retrieved by sequentially accessing the address locations on the basis of information indicative of a linkage of the recorded locations of the sound data which is contained in separately-recorded management data, then sequentially storing the retrieved sound data into the buffer memory, and then sequentially reading out the sound data from the buffer memory, one sample per sampling period.

The conventional hard disk recorder is arranged to continue recording silent data even for a quiescent or performance part temporarily disengaged from performance, which would thus result in an inefficient use of the HDD. Further, in reproduction, the conventional hard disk recorder has to perform the needless operation of sequentially accessing the recorded positions of the silent data and then storing the silent data into the buffer memory, which would needlessly impose great loads on the HDD and control device. Generally, where a user or human operator designates a desired performance section to be automatically reproduced or played back in a repetitive fashion for the purpose of so-called punch-in/punch-out or the like, it is necessary to repetitively retrieve the sound data of the individual unit performance segments by sequentially and repetitively accessing the recorded locations, on the HDD, of the sound data included in the designated performance section. For example, where, as shown in FIG. 2, a performance section, ranging from a time point immediately before the end of a given unit performance segment (unit performance segment 1 in the illustrated example) to a time point immediately after the beginning of another unit performance segment (unit performance segment 5), is designated as a repetitive reproduction section, there is a need to sequentially access, within a very short time after reproduction of unit performance segment 4, unit performance segments 5, 1 and 2 in order to reproduce short leading and trailing portions of unit performance segments 5 and 1 and then an entire portion of unit performance segment 2. However, in the past, such access to unit performance segments 5, 1 and 2 sometimes could not be made in time, with the result that there occurred an undesired break in reproduced tones halfway through the music piece reproduction. Particularly, such an undesired break in reproduced tones would occur where the number of tracks is relatively great. To avoid the undesired break in reproduced tones halfway through the music piece reproduction, it is necessary to make appropriate time adjustment such that the reproduction of unit performance segment 1 is initiated with a sufficient time margin after completion of the reproduction of unit performance segment 5 (i.e., after the sound data of unit performance segments 1 and 2 have been completely stored into the buffer memory); however, this approach would take a long waiting time in the case where the number of tracks is relatively great.

Further, with the hard disk recorder, there is a need to, within one sampling period, 1) time-divisionally write an input sound signal for each recording track (i.e., track for which data recording has been recorded) into the buffer memory, 2) read out an output sound signal for each reproduction track (i.e., track for which data reproduction has been recorded) from the buffer memory, and 3) transfer the input sound signal for each recording track from the buffer memory to the HDD or transfer the output sound signal for each reproduction track from the HDD to the buffer memory. Thus, as the number of channels increases, the greater number of samples have to be read out and written and transferred from or to the buffer memory, so that the conventional buffer memory can simultaneously deal with a relatively small number of channels.

Further, among various known electronic musical instruments is one equipped with a function of generating metronome tones, which allows a human player to perform a music piece while listening to the metronome tones. In recording a performance via a multi-track recorder or the like, it would be very convenient if the human player could perform a desired music piece while listening the electronically-generated metronome tones and record the music piece performance for subsequent reproduction. It would be more convenient if the metronome tones would be generated during reproduction of the recorded performance to allow the human player or human mixer to identify possible tempo deviation and the like. Generally, the metronome tone generator device is arranged to electronically generate metronome tones by repetitively reading out, at a frequency corresponding a selected performance tempo, basic waveform data of a metronome tone prestored in memory. It would be even more convenient if such a metronome tone generator device would have an extra function to adjust the tone pitch in accordance with a preference of the human player. The pitch adjustment would necessitate waveform editing processing such as a pitch shift process and envelope modification of any of an attack, release and other portions for modifying a waveform stretch/contraction resulting from the pitch shift.

FIG. 27 is a block diagram showing an exemplary setup of the conventional metronome tone generator device equipped with the pitch adjustment function. This metronome tone generator device includes a waveform memory 1 which is in the form of a non-volatile memory such as a ROM or flash ROM and which has prestored therein basic waveform data of a metronome tone (i.e., waveform data of a first metronome tick in a measure and waveform data to be shared between second and subsequent metronome ticks in the measure). Phase generator 2 generates sampling clock pulses corresponding to a sample readout rate of the waveform memory 1 for realizing a tone pitch designated by the human player, as well as divided clock pulses obtained by dividing the period of each sampling clock pulse into a plurality of sampling points; note that as the sample readout rate is increased, the tone pitch becomes higher, while as the sample readout rate is decreased, the tone pitch becomes lower. Address generator 3 counts the sampling clock pulses to create read addresses to be applied to the waveform memory 1. In accordance with the read addresses from the address generator 3, the samples of the metronome tone are sequentially read out from the waveform memory 1. Interpolation circuit 4 is supplied with the samples of the metronome tone and divided clock pulses, and interpolates between the sample values at a plurality of timings of the metronome tone in order to generate metronome tone samples in predetermined sampling periods and thereby determine metronome tone sample values at individual timings for generating the metronome tone. Envelope generator 5 outputs a time-varying coefficient for modifying a waveform stretch/contraction of the metronome tone resulting from the pitch shift; note that as the tone pitch is raised, the time length to read out the samples from the waveform 1 becomes shorter and thus the envelope length becomes shorter, but as the tone pitch is lowered, the time length to read out the samples from the waveform 1 becomes longer and thus the envelope length becomes longer. Multiplier 6 multiplies each sample value output from the interpolation circuit 4 by the coefficient generated by the envelope generator 5. In this way, the metronome tone is reproduced at a pitch designated by the human player. By repeating the above-mentioned calculation each time the metronome tone is to be generated, the metronome tones are reproduced repetitively at the pitch designated by the human player.

SUMMARY OF THE INVENTION

According to a first aspect of the present invention, there is provided a sample data reproduction apparatus for connection to a storage device, having sample data stored therein, to reproduce the sample data by reading out the sample data from the storage device, which comprises: a buffer memory; a control device coupled with the storage device and the buffer memory, the control device being adapted to: sequentially read out the sample data from the storage device and then write the read-out sample data into the buffer memory; read out the sample data from the buffer memory, one sample per sampling period; sequentially update the sample data at addresses of the buffer memory where sample data readout has been completed, with the sample data newly read out from the storage device; set a jump-from address and jump-to address while the sample data are being read out, sample by sample, from the buffer memory; and cause a read address of the buffer memory to jump to the jump-to address when the read address of the buffer memory reaches the set jump-from address, to carry on reading out the sample data from the jump-to address onward; and a reproduction circuit coupled to the control device and adapted to reproduce the sample data having been read out, sample by sample, from the buffer memory.

The present invention also provides another type of sample data reproduction apparatus, to which the arrangements of the above-mentioned sample data reproduction apparatus according to the first aspect of the invention are applied for reproduction of silent data. Namely, this sample data reproduction apparatus is adapted to be connected to a storage device storing therein sample data and adapted to reproduce the sample data by reading out the sample data from the storage device, information indicative of a silent section being stored in the storage device in place of sample data corresponding to the silent section. More specifically, the inventive sample data reproduction apparatus comprises: a buffer memory adapted to store therein sample data, a silent area for storing silent sample data being set in part of the buffer memory; a control device coupled with the storage device and the buffer memory, the control device being adapted to: sequentially read out the sample data from the storage device and then write the read-out sample data into the buffer memory; read out the sample data from the buffer memory, one sample per sampling period; sequentially update the sample data at addresses of the buffer memory where sample data readout has been completed, with the sample data newly read out from the storage device; while the sample data are being read out, sample by sample, from the buffer memory and on the basis of the information indicative of the silent section, set, as a jump-from address, an address of the buffer memory corresponding to a start point of the silent section and, as a jump-to address, an address of the silent area in the buffer memory; and cause a read address of the buffer memory to jump to the jump-to address when the read address of the buffer memory reaches the set jump-from address, to carry on reading out the silent sample data from the jump-to address onward; and a reproduction circuit coupled to the control device and adapted to reproduce the sample data having been read out, sample by sample, from the buffer memory.

The present invention provides still another type of sample data reproduction apparatus, to which the arrangements of the above-mentioned sample data reproduction apparatus according to the first aspect of the invention are applied for repetitive reproduction of sample data. Namely, this sample data reproduction apparatus, which is adapted to be connected to a storage device storing therein sample data and adapted to reproduce the sample data by reading out the sample data from the storage device, comprises: a buffer memory; a control device coupled with the storage device and the buffer memory, the control device being adapted to: sequentially read out the sample data from the storage device, by one predetermined unit segment at a time, and then write the read-out sample data into the buffer memory; read out the sample data from the buffer memory, one sample per sampling period; and sequentially update the sample data at addresses of the buffer memory where sample data readout has been completed, with the sample data newly read out from the storage device, by one unit segment at a time. When the sample data of a given section ranging across a plurality of unit segments are to be read out repetitively, the control device is also adapted to, prior to readout of the given section, read out, from the storage device, individual sample data of at least a first unit segment containing a fore end portion of the given section and a second unit segment containing a rear end portion of the given section, and then store the read-out individual sample data into a first area of the buffer memory; and, during the readout of the given section, read out, from the storage device, the sample data of other unit segments than at least the first unit segment and the second unit segment, and store the read-out sample data into a second area of the buffer memory in a sequentially updating fashion. The control device is also adapted to: sequentially set a jump-from address and jump-to address to effect an address jump for successive readout of the given section; and cause a read address of the buffer memory to jump to the jump-to address when the read address of the buffer memory reaches the set jump-from address, to carry on reading out the sample data from the jump-to address onward.

The present invention also provides a sample data recording apparatus adapted to be connected to a storage device storing therein sample data and adapted to record other sample data into the storage device while reading out the sample data from the storage device, which comprises: a buffer memory; a control device coupled with the storage device and the buffer memory, the control device being adapted to: sequentially read out the sample data from the storage device, by one predetermined unit segment at a time, and then write the read-out sample data into the buffer memory; read out the sample data from the buffer memory, one sample per sampling period; and sequentially update the sample data at addresses of the buffer memory where sample data readout has been completed, with the sample data newly read out from the storage device, by one unit segment at a time. When the control device is to record other sample data separately input to at least part of a given section ranging across a plurality of unit segments while repetitively reading out the sample data of the given section, the control device also functions in such a manner that prior to readout of the given section, it reads out, from the storage device, individual sample data of at least a first unit segment containing a fore end portion of the given section and a second unit segment containing a rear end portion of the given section and then stores the read-out individual sample data into a first area of the buffer memory, that during the readout of the given section, it reads out, from the storage device, the sample data of other unit segments than at least the first unit segment and the second unit segment and stores the read-out sample data into a second area of the buffer memory in a sequentially updating fashion, that it sequentially sets a jump-from address and jump-to address to effect an address jump for successive readout of the given section, that it causes a read address of the buffer memory to jump to the jump-to address when the read address of the buffer memory reaches the set jump-from address to thereby carry on reading out the sample data from the jump-to address onward, and that for the at least part of the given section during the readout of the sample data of the given section, it writes the other sample data into the buffer memory, one sample per sampling period, time-divisionally with readout of the sample data and then reads out the other sample data from the buffer memory, by one predetermined unit segment at a time, to write the read-out other sample data into the storage device.

According to a second aspect of the present invention, there is provided a recording/reproduction apparatus for recording and/or reproducing sound data to and/or from a storage device, which comprises: a basic waveform data storage section storing therein basic waveform data of a given tone; a waveform editing section coupled with the basic waveform data storage section, the waveform editing section being adapted to read out the basic waveform data from the basic waveform data storage section to thereby perform a waveform editing arithmetic operation on the basic waveform data in accordance with a predetermined waveform editing calculation program and given waveform editing parameters; a buffer memory; and a control device coupled with the storage device, the buffer memory and the waveform editing section, the control device being adapted to: store, into one area of the buffer memory, the basic waveform data of the given tone having been subjected to the waveform editing arithmetic operation; record input sound data into the storage device via another area of the buffer memory, and/or read out the sound data recorded in the storage device to thereby reproductively output the read-out sound data via the other area of the buffer memory; and read out and reproduce the basic waveform data of the given tone stored in the one area of the buffer memory, in synchronism with recording or reproduction of the sound data to or from the storage device, time-divisionally with writing and readout of the sound data to and from the buffer memory.

According to a third aspect of the present invention, there is provided a buffer device for use with an apparatus for recording sample data of a plurality of channels into a storage device. The buffer device of the invention comprises: a memory including a plurality of banks; and a control device coupled with the memory and adapted to: assign a plurality of channels to respective separate banks, and time-divisionally write input sample data of a plurality of recording channels, one sample within each sampling period, into corresponding ones of the banks of the memory while sequentially switching between the banks on a sample-by-sample basis; sequentially read out the sample data of individual ones of the recording channels, written in the memory, in predetermined order, and transfer the read-out sample data to the storage device; and write, into addresses, of the sample data of each of the recording channels, in the memory where readout of the sample data has been completed, newly-input sample data of a corresponding recording channel, to thereby sequentially update the sample data of the individual recording channels in the memory.

The present invention also provides a buffer device for use with an apparatus for reproducing sample data of a plurality of channels from a storage device, which comprises: a memory including a plurality of banks; and a control device coupled with the memory and adapted to: assign a plurality of channels to respective separate banks, and write sample data of a plurality of reproduction channels, sequentially read out from the storage device in predetermined order and transferred to the buffer device, into corresponding ones of the banks of the memory; time-divisionally read out the sample data of individual ones of the reproduction channels written in the memory, one sample within each sampling period, while sequentially switching between the banks on a sample-by-sample basis; and write, into addresses, of the sample data of each of the reproduction channels, in the memory where readout of the sample data has been completed, sample data of a corresponding reproduction channel newly transferred from the storage device, to thereby sequentially update the sample data of individual ones of the reproduction channels in the memory.

The present invention also provides a buffer device for use with an apparatus for recording and reproducing sample data of a plurality of channels to and from a storage device, which comprises: a memory including a plurality of banks; and a control device coupled with the memory and adapted to: assign a plurality of recording and reproduction channels to respective separate banks; time-divisionally write input sample data of a plurality of recording channels, into corresponding ones of the banks of the memory; sequentially read out the sample data of individual ones of the recording channels, written in the memory, in predetermined order, and transfer the read-out sample data to the storage device; write, into addresses, of the sample data of each of the recording channels, in the memory where readout of the sample data has been completed, newly-input sample data of a corresponding recording channel, to thereby sequentially update the sample data of the individual recording channels in the memory; write sample data of a plurality of reproduction channels, sequentially read out from the storage device in predetermined order and transferred to the buffer device, into corresponding ones of the banks of the memory; time-divisionally read out and output the sample data of individual ones of the reproduction channels written in the memory; and write, into addresses, of the sample data of each of the reproduction channels, in the memory where readout of the sample data has been completed, sample data of a corresponding reproduction channel newly transferred from the storage device, to thereby sequentially update the sample data of the individual reproduction channels in the memory. In this case, the control device carries out writing of the sample data of the recording channels into the memory and readout of the sample data of the reproduction channels from the memory, one sample within each sampling period, while sequentially switching between the banks on a sample-by-sample basis.

The present invention may be constructed and implemented not only as the apparatus invention as discussed above but also as a method invention. Also, the present invention may be arranged and implemented as a software program for execution by a processor such as a computer or DSP, as well as a storage medium storing such a program. Further, the controller or processor used in the present invention may comprise a dedicated controller or processor having dedicated logic, registers and the like in the form of hardware, or a general-purpose type processor, such as a computer, capable of running desired software.

BRIEF DESCRIPTION OF THE DRAWINGS

For better understanding of the object and other features of the present invention, its embodiments will be described in greater detail hereinbelow with reference to the accompanying drawings, in which.

DETAILED DESCRIPTION OF THE EMBODIMENTS

Figure 1:
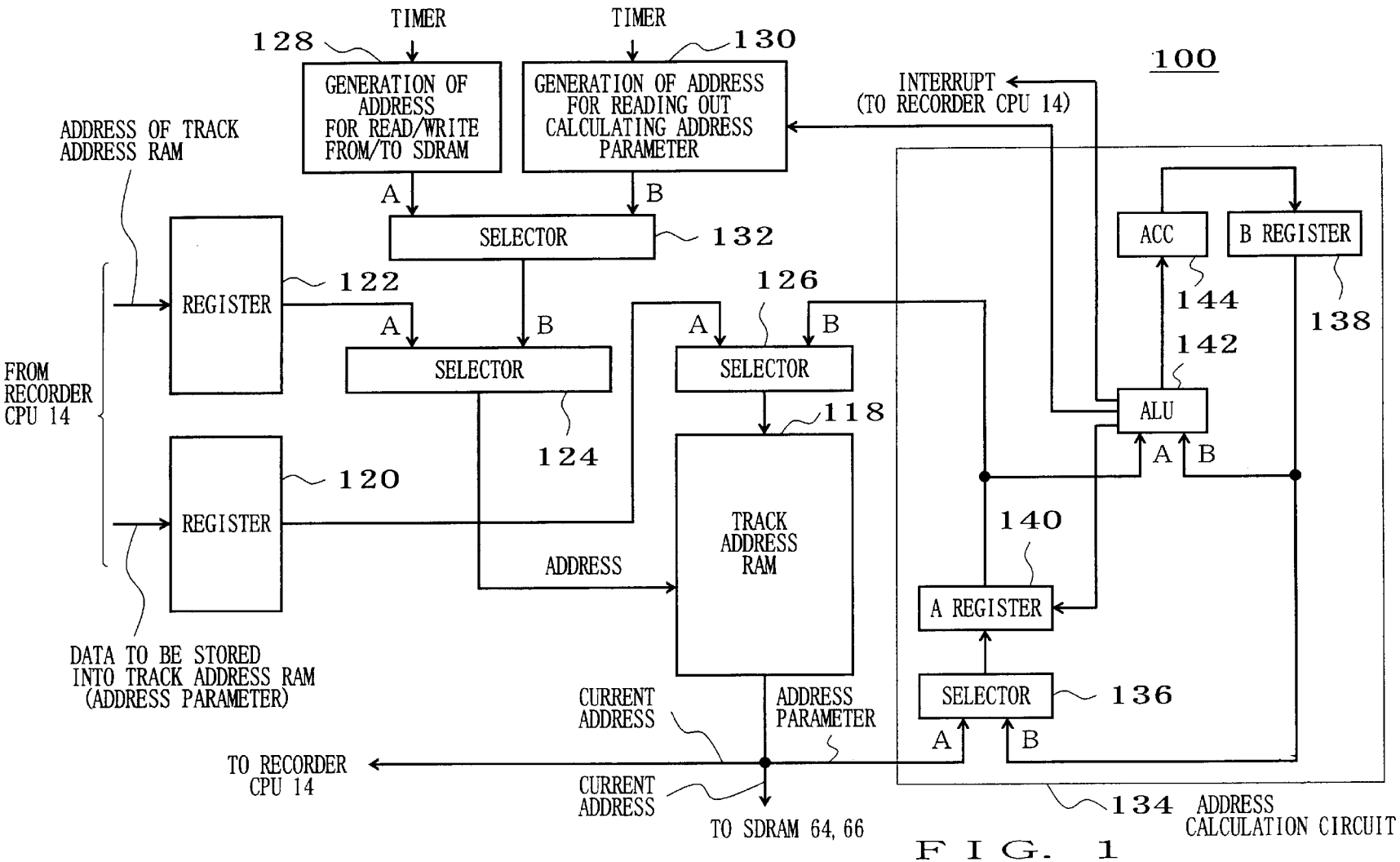
FIG. 1 is a diagram showing an exemplary setup of an embodiment of the present invention, which particularly shows a track address generator.

One of the embodiments of the present invention relates to an improved apparatus and method for reproducing, or recording and reproducing sample data recorded in a storage device, such as a hard disk, which permit efficient readout of the sample data.

Another embodiment of the present invention relates to an improved buffer circuit for use in a data recording apparatus, reproduction apparatus or recording/reproduction apparatus handling sample data, which can increase the number of channels that can be simultaneously handled thereby.

Still another embodiment of the present invention relates to an apparatus for generating repetitive tones such as metronome tones and rhythm tones, single-shot tones such as sampler tones and other tones, and a recording/reproduction apparatus having such a tone generating apparatus incorporated therein, which, without requiring addition of large-scale hardware, can generate a tone by applying waveform editing, such as pitch adjustment and envelope adjustment, to basic waveform data of the tone stored in a storage device.

An embodiment according to a first aspect of the present invention may be summarized in a sample data reproduction apparatus for connection to a storage device, having sample data stored therein, to reproduce the sample data by reading out the sample data from the storage device, which comprises: a buffer memory; a control device coupled with the storage device and the buffer memory, the control device being adapted to: sequentially read out the sample data from the storage device and then write the read-out sample data into the buffer memory; read out the sample data from the buffer memory, one sample per sampling period; sequentially update the sample data at addresses of the buffer memory where sample data readout has been completed, with the sample data newly read out from the storage device; set a jump-from address and jump-to address while the sample data are being read out, sample by sample, from the buffer memory; and cause a read address of the buffer memory to jump to the jump-to address when the read address of the buffer memory reaches the set jump-from address, to carry on reading out the sample data from the jump-to address onward; and a reproduction circuit coupled to the control device and adapted to reproduce the sample data having been read out, sample by sample, from the buffer memory.

In the above-summarized embodiment, both a jump-from (or jump source) address and a jump-to (or jump destination) address are set in the course of the sample-by-sample readout of the sample data from the buffer memory. Upon detecting that the read address of the buffer memory has reached the thus-set jump-from address, the read address of the buffer memory is caused to jump to the jump-to address so as to carry on the readout of the sample data from the jump-to address onward. In this way, a sample data reproduction apparatus and/or method which permit efficient readout of the sample data can be realized, and the sample data readout can be carried out with enhanced efficiency. The sample data handled in this invention may be image data, not to mention sound sample data, and the basic principles of the present invention may be applied to a variety of applications as will be later described in detail in connection with embodiments of the present invention.

As an example, the control device in the present invention may include: a jump address setting circuit that sets the jump-from address and jump-to address at an appropriate time point while the sample data are being read out, sample by sample, from the buffer memory; and a read-address calculation circuit that, every sampling period, obtains an address advanced from a current read address and determines whether or not the obtained address has reached the jump-from address. When it is determined that the obtained address has not reached the jump-from address, the read-address calculation circuit sets the obtained address as a read address to be used in a next sampling period, but when it is determined that the obtained address has reached the jump-from address, the read-address calculation circuit sets the jump-to address as the read address to be used in the next sampling period. In this case, the jump address setting circuit may include an address memory that rewritably holds information indicative of the jump-from address and jump-to address, and the information indicative of the jump-from address and jump-to address held in the address memory may be updated with a next jump-from address and next jump-to address at an appropriate time point after completion of a last address jump. For example, the jump-from address may be set on the basis of time information that is stored in the storage device and corresponds to timing for effecting an address jump from the jump-from address. As another example, the jump-from address may be set on the basis of an instructing operation by a human operator that corresponds to timing for effecting an address jump from the jump-from address.

Another embodiment of the present invention may be summarized in another type of sample data reproduction apparatus, to which the arrangements of the above-mentioned sample data reproduction apparatus according to the first aspect of the invention are applied for reproduction of silent data. Namely, this sample data reproduction apparatus is adapted to be connected to a storage device storing therein sample data and adapted to reproduce the sample data by reading out the sample data from the storage device, information indicative of a silent section being stored in the storage device in place of sample data corresponding to the silent section. More specifically, the inventive sample data reproduction apparatus comprises: a buffer memory adapted to store therein sample data, a silent area for storing silent sample data being set in part of the buffer memory; a control device coupled with the storage device and the buffer memory, the control device being adapted to: sequentially read out the sample data from the storage device and then write the read-out sample data into the buffer memory; read out the sample data from the buffer memory, one sample per sampling period; sequentially update the sample data at addresses of the buffer memory where sample data readout has been completed, with the sample data newly read out from the storage device; while the sample data are being read out, sample by sample, from the buffer memory and on the basis of the information indicative of the silent section, set, as a jump-from address, an address of the buffer memory corresponding to a start point of the silent section and, as a jump-to address, an address of the silent area in the buffer memory; and cause a read address of the buffer memory to jump to the jump-to address when the read address of the buffer memory reaches the set jump-from address, to carry on reading out the silent sample data from the jump-to address onward; and a reproduction circuit coupled to the control device and adapted to reproduce the sample data having been read out, sample by sample, from the buffer memory.

Generally, in a storage device, e.g., external storage device such as a hard disk device, sample data are stored successively. However, according to the present invention, no sample data of a silent section (e.g., silent performance section) is stored in the storage device; instead, only information indicative of presence of the silent section is stored in the storage device. Thus, the storage device can be used with enhanced efficiency. For reproducing the sample data of the silent section, the silent sample data is used which is stored in the silent area set in the buffer memory.

As an example, the control device in the present invention may be further adapted to: at an appropriate time point while the silent sample data are being read out from the silent area and on the basis of the information indicative of the silent section, set, as the jump-from address, an address of the silent area corresponding to an end point of the silent section and, as the jump-to address, an address within an area of the buffer memory containing the sample data following the silent section which is read out from the storage device; and cause a read address of the buffer memory to jump to the jump-to address when the read address of the buffer memory reaches the jump-from address within the silent area, to carry on reading out the sample data from the jump-to address onward.

Still another embodiment of the present invention may be summarized in still another type of sample data reproduction apparatus, to which the arrangements of the above-mentioned sample data reproduction apparatus according to the first aspect of the invention are applied for repetitive reproduction of sample data. Namely, this sample data reproduction apparatus, which is adapted to be connected to a storage device storing therein sample data and adapted to reproduce the sample data by reading out the sample data from the storage device, comprises: a buffer memory; a control device coupled with the storage device and the buffer memory, the control device being adapted to: sequentially read out the sample data from the storage device, by one predetermined unit segment at a time, and then write the read-out sample data into the buffer memory: read out the sample data from the buffer memory, one sample per sampling period; and sequentially update the sample data at addresses of the buffer memory where sample data readout has been completed, with the sample data newly read out from the storage device, by one unit segment at a time. When the sample data of a given section ranging across a plurality of unit segments are to be read out repetitively, the control device is also adapted to, prior to readout of the given section, read out, from the storage device, individual sample data of at least a first unit segment containing a fore end portion of the given section and a second unit segment containing a rear end portion of the given section, and then store the read-out individual sample data into a first area of the buffer memory; and, during the readout of the given section, read out, from the storage device, the sample data of other unit segments than at least the first unit segment and the second unit segment, and store the read-out sample data into a second area of the buffer memory in a sequentially updating fashion. The control device is also adapted to: sequentially set a jump-from address and jump-to address to effect an address jump for successive readout of the given section; and cause a read address of the buffer memory to jump to the jump-to address when the read address of the buffer memory reaches the set jump-from address, to carry on reading out the sample data from the jump-to address onward. The sample data reproduction apparatus further comprises a reproduction circuit coupled to the control device and adapted to reproduce the sample data having been read out, sample by sample, from the buffer memory.

Namely, when the sample data of the given section ranging across a plurality of unit segments are to be read out repetitively, the control device in the invention functions in such a manner that prior to the data readout of the given section, the control device reads out, from the storage device, the individual sample data of at least the first unit segment containing the fore end portion of the given section and the second unit segment containing the rear end portion of the given section and then stores the read-out individual sample data into the first area of the buffer memory, and that during the readout of the given section, the control device reads out, from the storage device, the sample data of other unit segments than at least the first unit segment and the second unit segment and stores the read-out sample data into the second area of the buffer memory in a sequentially updating fashion. Thus, during the repetitive reproduction, it is only necessary that at least the sample data of the first and second unit segments be read out from the first area of the buffer memory—they absolutely need not be read out from the storage device. Thus, even in a situation where the fore end portion contained in the first unit segment and rear end portion contained in the second unit segment are very short, it is possible to avoid an undesired break of reproduced sounds that would occur due to too-late access to the storage device, so that a break of reproduced sounds in the middle of a music piece can be reliably prevented by the present invention. In addition, a waiting time, intervening between termination of the repetition section reproduction and subsequent resumption of the repetition section reproduction, can be eliminated or minimized or set to a desired short length.

Still another embodiment according to the present invention may be summarized in a sample data recording apparatus adapted to be connected to a storage device storing therein sample data and adapted to record other sample data into the storage device while reading out the sample data from the storage device, which comprises: a buffer memory; a control device coupled with the storage device and the buffer memory, the control device being adapted to: sequentially read out the sample data from the storage device, by one predetermined unit segment at a time, and then write the read-out sample data into the buffer memory; read out the sample data from the buffer memory, one sample per sampling period; and sequentially update the sample data at addresses of the buffer memory where sample data readout has been completed, with the sample data newly read out from the storage device, by one unit segment at a time. When the control device is to record other sample data separately input to at least part of a given section ranging across a plurality of unit segments while repetitively reading out the sample data of the given section, the control device also functions in such a manner that prior to readout of the given section, it reads out, from the storage device, individual sample data of at least a first unit segment containing a fore end portion of the given section and a second unit segment containing a rear end portion of the given section and then stores the read-out individual sample data into a first area of the buffer memory, that during the readout of the given section, it reads out, from the storage device, the sample data of other unit segments than at least the first unit segment and the second unit segment and stores the read-out sample data into a second area of the buffer memory in a sequentially updating fashion, that it sequentially sets a jump-from address and jump-to address to effect an address jump for successive readout of the given section, that it causes a read address of the buffer memory to jump to the jump-to address when the read address of the buffer memory reaches the set jump-from address to thereby carry on reading out the sample data from the jump-to address onward, and that for the at least part of the given section during the readout of the sample data of the given section, it writes the other sample data into the buffer memory, one sample per sampling period, time-divisionally with readout of the sample data and then reads out the other sample data from the buffer memory, by one predetermined unit segment at a time, to write the read-out other sample data into the storage device. Thus, when, during repetitive reproduction of the sample data, other sample data are to be pasted and recorded by punch-in/punch out, the present invention can afford the same benefit as mentioned above at the time of the repetitive reproduction and can execute the punch-in/punch out operations with increased efficiency and smoothness. In this way, a sample data recording apparatus and/or method which permit efficient readout of the sample data can be realized.

An embodiment according to a second aspect of the present invention may be summarized in a recording/reproduction apparatus for recording and/or reproducing sound data to and/or from a storage device, which comprises: a basic waveform data storage section storing therein basic waveform data of a given tone; a waveform editing section coupled with the basic waveform data storage section, the waveform editing section being adapted to read out the basic waveform data from the basic waveform data storage section to thereby perform a waveform editing arithmetic operation on the basic waveform data in accordance with a predetermined waveform editing calculation program and given waveform editing parameters; a buffer memory; and a control device coupled with the storage device, the buffer memory and the waveform editing section, the control device being adapted to: store, into one area of the buffer memory, the basic waveform data of the given tone having been subjected to the waveform editing arithmetic operation; record input sound data into the storage device via another area of the buffer memory, and/or read out the sound data recorded in the storage device to thereby reproductively output the read-out sound data via the other area of the buffer memory; and read out and reproduce the basic waveform data of the given tone stored in the one area of the buffer memory, in synchronism with recording or reproduction of the sound data to or from the storage device, time-divisionally with writing and readout of the sound data to and from the buffer memory.

With the arrangement that the waveform editing arithmetic operation is performed on the basic waveform data of the given tone stored in the basic waveform data storage section, the waveform data of the given tone having been subjected to the waveform editing are stored in part of the buffer memory and then the thus-stored waveform data of the given tone are read out for reproduction, it is no longer necessary to carry out a large-scale and high-speed waveform editing arithmetic operation in real time each time the given tone is to be generated. As a consequence, the waveform editing arithmetic operation can be implemented by an arithmetic operation based on a software program executed by an existing CPU or the like, which, without addition of large-scale hardware, can carry out necessary waveform editing and thereby generate a desired waveform-edited tone. Further, because sound data are recorded to and/or reproduced from the storage device via the other area of the buffer memory and readout and reproduction, from other area of the buffer memory, of the waveform-edited waveform data of the given tone is carried out in synchronism with the recording/reproduction of the sound data, the buffer memory and read/write control arrangement for use in the recording/reproduction of the sound data can also be used for reproduction of the given tone, so that the waveform editing and reproductive generation of the given tone can be executed with simple construction. The basic waveform data to be stored in the basic waveform data storage section may be of any sound, such as a repetitive tone like a metronome tone or rhythm tone, or a single-shot tone like a sampler tone. Of course, in the case of a repetitive tone, control is performed to repetitively read out the waveform-edited waveform data stored in the buffer memory.

Figure 27:
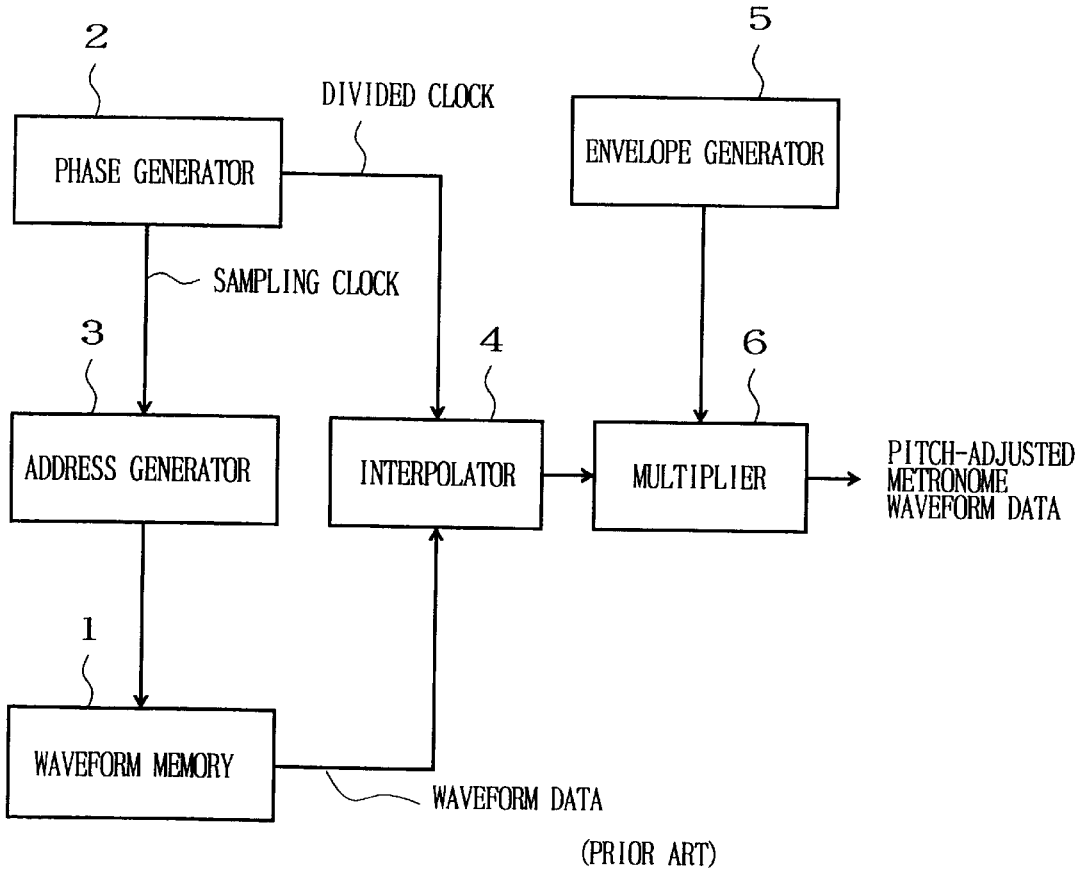
FIG. 27 is a block diagram showing an exemplary setup of a conventional metronome tone generator device equipped with a pitch adjustment function.

In contrast, in the above-mentioned prior art as shown in FIG. 27, by repeating the above-mentioned calculation each time the metronome tone is to be generated, the metronome tones are reproduced repetitively at the pitch designated by the human player. Because the pitch-adjusting calculations are large-scale operations and yet have to be carried out at high speed, it has been necessary to provide an electric circuit for the calculations in the form of hardware as shown in FIG. 27, which would present the problem that the overall scale of the necessary hardware becomes significantly great. The above-summarized embodiment according to the present invention, however, can realize a tone generating apparatus and/or method which, without requiring addition of large-scale hardware, can generate a tone by applying waveform editing, such as pitch adjustment and envelope adjustment, to basic waveform data of repetitive tones such as metronome tones and rhythm tones, single-shot tones such as sampler tones or other given tones, and a recording/reproduction apparatus and/or method having such a tone generating apparatus and/or method incorporated therein.

In the recording/reproduction apparatus of the present invention, sound data of a plurality of channels may be recorded and/or reproduced to and/or from the storage device. In such a case, areas allocated to the respective channels are set in the buffer memory so that the sound data of the individual channels are read out from the storage device and then reproductively output via the areas allocated to the respective channels.

As an example, the waveform editing parameters can be set via an operation by a user and each of the set waveform editing parameters is stored into the storage device. Thus, in response to designation of a song to be recorded or reproduced, the corresponding waveform editing parameters are read out from the storage device and the waveform editing arithmetic operation is performed in accordance with the corresponding waveform editing parameters. Further, the waveform editing parameters may include a parameter instructing either one or both of a pitch shift amount and envelope waveform of the tone.

An embodiment according to a third aspect of the present invention may be summarized in a buffer device for use with an apparatus for recording sample data of a plurality of channels into a storage device. The buffer device of the embodiment comprises: a memory including a plurality of banks; and a control device coupled with the memory and adapted to: assign a plurality of channels to respective separate banks, and time-divisionally write input sample data of a plurality of recording channels, one sample within each sampling period, into corresponding ones of the banks of the memory while sequentially switching between the banks on a sample-by-sample basis; sequentially read out the sample data of individual ones of the recording channels, written in the memory, in predetermined order, and transfer the read-out sample data to the storage device; and write, into addresses, of the sample data of each of the recording channels, in the memory where readout of the sample data has been completed, newly-input sample data of a corresponding recording channel, to thereby sequentially update the sample data of the individual recording channels in the memory. Thus, in this embodiment, using the time when preparations are being made for writing next sample time of one recording channel allocated to one of the banks, sample data of another recording channel allocated to another one of the banks can be written, and thus the number of channels that can be simultaneously handled can be increased to a significant degree. In this way, there is provided a buffer circuit which is suitable for use in a recording apparatus, reproduction apparatus or recording/reproduction apparatus handling sample data of a plurality of channels, and which can increase the number of the channels that can be simultaneously handled thereby.

In a preferred implementation, one or more of the channels are assigned to each one of the banks of the memory, and the sample data of the individual recording channels are written into the memory in such order as to prevent the channels assigned to a same bank from being written in succession. For the readout, from the memory, of the sample data of each of the recording channels, a predetermined quantity of the sample data may be collectively read out from the memory on a channel-by-channel time-divisional basis, for each of the recording channels for which the predetermined quantity of sample data have been newly written into the memory. Further, a time period of each sample may be divided into a first time for writing the sample data of the recording channel into the memory, and a second time for reading out the sample data of the recording channel from the memory to transfer the sample data to the storage device; in this case, the second time is set to be longer than the first time. Also, the total number of the sample data of the recording channel to be read out from the memory within each sampling period may be set to be greater than the total number of the sample data of the recording channel to be written into the memory within the sampling period. Further, there may be provided a particular sampling period when readout of the sample data of the recording channel from the memory is not carried out. Further, sample data of a given tone may be stored in a particular one of the banks of the memory, and readout of the sample data of the given tone from the memory may be carried out time-divisionally with writing of the sample data of each of the recording channels into the memory.

Still another embodiment according to the present invention may be summarized in a buffer device for use with an apparatus for reproducing sample data of a plurality of channels from a storage device, which comprises: a memory including a plurality of banks; and a control device coupled with the memory and adapted to: assign a plurality of channels to respective separate banks, and write sample data of a plurality of reproduction channels, sequentially read out from the storage device in predetermined order and transferred to the buffer device, into corresponding ones of the banks of the memory; time-divisionally read out the sample data of individual ones of the reproduction channels written in the memory, one sample within each sampling period, while sequentially switching between the banks on a sample-by-sample basis; and write, into addresses, of the sample data of each of the reproduction channels, in the memory where readout of the sample data has been completed, sample data of a corresponding reproduction channel newly transferred from the storage device, to thereby sequentially update the sample data of individual ones of the reproduction channels in the memory. In this embodiment, using the time when preparations are being made for reading out next sample time of one reproduction channel allocated to one of the banks, sample data of another reproduction channel allocated to another one of the banks can be read out, and thus the number of channels that can be simultaneously handled can be increased.

In a preferred embodiment, two or more of the channels are assigned to each one of the banks of the memory, and the sample data of the individual reproduction channels are read out from the memory in such order as to prevent the channels assigned to a same bank from being written in succession. For the writing, in the memory, of the sample data of the individual reproduction channels, a predetermined quantity of the sample data are collectively written into the memory on a channel-by-channel time-divisional basis, for each of the reproduction channels for which the predetermined quantity of sample data have been read out from the memory. Also, a time period of each sample may be divided into a first time for reading out the sample data of the recording channel from the memory, and a second time for writing the sample data of the reproduction channel, read out from the storage device, into the memory, the second time being set to be longer than the first time. The total number of the sample data of the reproduction channel to be written into the memory within each sampling period may be greater than the total number of the sample data of the reproduction channel to be read out from the memory within the sampling period. Further, there may be provided a particular sampling period when writing of the sample data of the reproduction channel into the memory is not carried out. In addition, sample data of a given tone may be stored in a particular one of the banks of the memory, and readout of the sample data of the given tone from the memory may be carried out time-divisionally with readout of the sample data of each of the reproduction channels from the memory.

Further embodiment according to the present invention may be summarized in a buffer device for use with an apparatus for recording and reproducing sample data of a plurality of channels to and from a storage device, which comprises: a memory including a plurality of banks; and a control device coupled with the memory and adapted to: assign a plurality of recording and reproduction channels to respective separate banks; time-divisionally write input sample data of a plurality of recording channels, into corresponding ones of the banks of the memory; sequentially read out the sample data of individual ones of the recording channels, written in the memory, in predetermined order, and transfer the read-out sample data to the storage device; write, into addresses, of the sample data of each of the recording channels, in the memory where readout of the sample data has been completed, newly-input sample data of a corresponding recording channel, to thereby sequentially update the sample data of the individual recording channels in the memory; write sample data of a plurality of reproduction channels, sequentially read out from the storage device in predetermined order and transferred to the buffer device, into corresponding ones of the banks of the memory; time-divisionally read out and output the sample data of individual ones of the reproduction channels written in the memory; and write, into addresses, of the sample data of each of the reproduction channels, in the memory where readout of the sample data has been completed, sample data of a corresponding reproduction channel newly transferred from the storage device, to thereby sequentially update the sample data of the individual reproduction channels in the memory. In this case, the control device carries out writing of the sample data of the recording channels into the memory and readout of the sample data of the reproduction channels from the memory, one sample within each sampling period, while sequentially switching between the banks on a sample-by-sample basis. In this embodiment, using the time when preparations are being made for writing next sample time of one recording channel allocated to one of the banks, sample data of one reproduction channel allocated to another one of the banks can be written, and thus the number of channels that can be simultaneously handled can be increased.

Now, a detailed description will be made about various embodiments of the present invention in relation to a case where the basic principles of the invention are applied to a digital mixing recorder (hard disk recorder) using a hard disk device (hereinafter also called an "HDD") as its external storage device.

Figure 3:
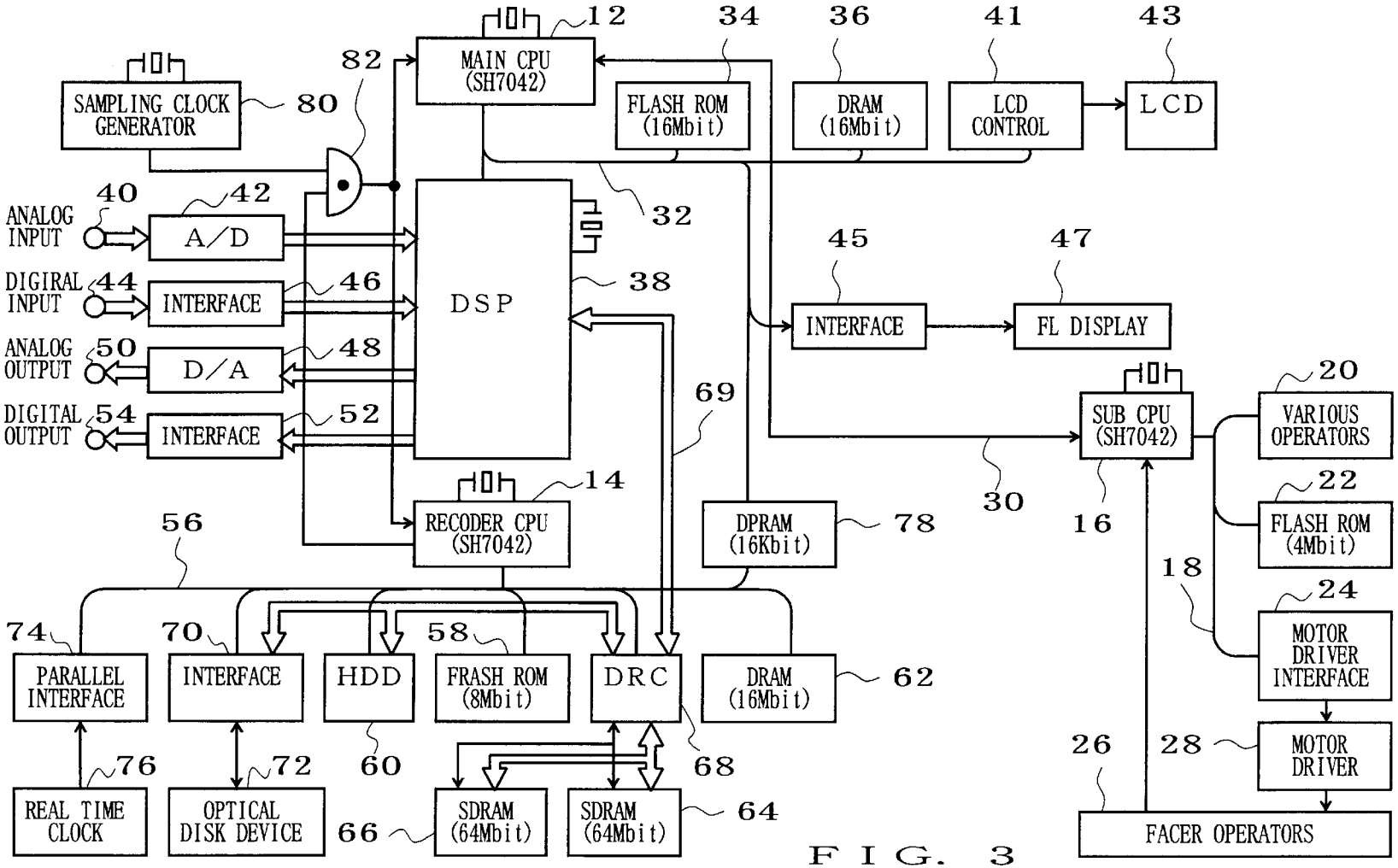
FIG. 3 is a block diagram showing a general setup of principal components in a hard disk recorder to which the basic principles of the present invention are applied.

FIG. 3 is a block diagram showing a general setup of the hard disk recorder 10 which includes signal paths of a plurality of channels. The term "channels" is used herein to refer to not only signal paths to be used for processing signals of sound data of individual tracks but also sound data themselves transmitted via the signal paths. Also note that the terms "signal paths" refer to not only signal paths physically separated from each other on a channel-by-channel basis but also a physically shared signal path by which the sound data of the individual channels are processed on a time divisional basis. With these signal paths and channels, the hard disk recorder 10 of the invention is capable of simultaneous recording or reproduction of a plurality of tracks (e.g., up to 16 tracks), or simultaneous recording and reproduction of a plurality of tracks (e.g., simultaneous recording of up to 8 tracks concurrent with simultaneous reproduction of up to 16 channels). In each of the tracks, every sample of the sound data consists of 16 bits (two bytes), except for a mix-down or track-down signal that consists of 24 bits (three bytes). Also, the hard disk recorder 10 is arranged to reproduce a metronome tone in response to an instruction of a human operator (human performer or the like) during recording or reproduction, or simultaneous recording and reproduction of a music performance. In the illustrated example, the pitch of the metronome tone can be adjusted by the human operator.

As illustrated in FIG. 3, the hard disk recorder 10 includes a total of three one-chip CPUs (microcomputers), i.e., a main CPU 12, a recorder CPU 14, a sub-CPU 16; for example, the one-chip CPUs may each be the "SH7042" single-chip RISC microcomputer commercially available from HITACHI, Ltd. These CPUs 12, 14 and 16 are driven independently of each other by their respective clocks that operate asynchronously with each other. The main CPU 12 chiefly performs mixing control as will be later described in detail. In accordance with instructions from the main CPU 12, the recorder CPU 14 controls recording and reproduction to and from the HDD 60 and also performs waveform editing control and the like. Arithmetic operations for editing the waveform of the metronome tone are also performed by the recorder CPU 14. The sub-CPU 16 performs control to deliver various operation information, input via the human operator, to the main CPU 12, and also performs motor drive control for individual fader operators and other control in accordance with instructions from the main CPU 12.

To a bus 18 of the sub-CPU 16 are connected various operators 20 including switches, rotary knobs, mouse, jog dial, shuttle knob and the like, a flash ROM 22 having stored therein programs for execution by the sub-CPU 16, a motor driver interface 24, etc. A plurality of motor-driven fader operators 26 are connected to the motor driver interface 24 via a motor driver 28. Information indicating a current operating position of each individual motor-driven fader operator 26 is delivered to the sub-CPU 16. Manipulation of the various operators 20 by the human operator can set mixing parameters, such as parameters for routing or assignment of each individual input channel to indicate on which track the input channel should be recorded via which signal path channel, parameters for routing or assignment of each track-reproduced signal to indicate from which output channel the track-reproduced signal should be output via which signal path channel, and parameters for setting equalizer characteristics, effect characteristics, sound image localization (panning), etc. Also, the manipulation of the various operators 20 by the human operator can instruct execution of various recorder functions such as recording, reproduction, stop, pause, slow reproduction, fast forwarding and fast rewinding, selection of a song (a unit of a music piece to be recorded or reproduced; for example, one song=one music piece), switching between operations modes such as recording/reproduction and editing modes, waveform editing, etc. ON/OFF setting of metronome tone reproduction, pitch adjustment of the metronome tone are also performed using the operators 20.

The recording/reproduction mode includes a mode in which normal recording and/or reproduction (i.e., only recording (ALL REC), only reproduction or simultaneous recording and reproduction(SYNC DUBBING)) is carried out for each performance part, a mode in which punch-in/punch-out operations are performed, and a mode in which a mix-down operation is performed. Information indicative of the manipulation of each of the operators 20 is passed to the sub-CPU 16, from which the information is delivered via a signal line 30 to the main CPU 12. In response to an operation by the human operator, the fader operators 26 adjust respective levels of the individual input channels and output channels, levels of stereo outputs, etc., and information indicative of manipulation of each of the fader operators 26 is passed to the sub-CPU 16, from which the information is delivered via the signal line 30 to the main CPU 12. In the recording/reproduction mode, i.e. the mode where only recording (ALL REC), only reproduction or simultaneous recording and reproduction (SYNC DUBBING) is carried out, the main CPU 12 instructs operating positions of the individual fader operators 26 sequentially to the sub-CPU 16 via the signal line 30 in accordance with progression of a song performance, for fader level adjustment of the individual reproduction tracks. Thus, via the motor driver interface 24 and motor driver 28, the individual fader operators 26 are controlled to automatically move to the respective instructed operating positions. In this way, the operating positions of the fader operators 26 that were previously set at the time of the recording are reproduced so that reproduction is carried out with the reproduction level of each of the tracks automatically adjusted to the level that was previously set at the time of the recording.

To a bus 32 of the main CPU 12, as further shown in FIG. 3, are connected a flash ROM 34 having stored therein programs for execution by the main CPU 12, and a DRAM 36 functioning as a working memory for the CPU 12 and also storing, as song management data related to mixing functions (routing, equalizing, effect imparting, fader level adjusting, sound-image-localization adjusting and other functions) for a song currently designated for recording, reproduction, editing or the like, sequence data related to time-varying settings of the mixing parameters. Also connected to the bus 32 of the main CPU 12 are a DSP 38 implementing the mixing functions, an LCD control circuit 41 connected with an LCD (Liquid Crystal Display) 43, an interface 45 connected with a fluorescent (FL) display 47, etc. Information corresponding to a current operation mode of the hard disk recorder 10 is displayed on the LCD 43; in the recording/reproduction mode, for example, information is displayed for selection of signal routing, ON/OFF states of the channels and virtual tracks, etc. In the waveform editing mode for increasing or decreasing the level of sound data of a recorded performance, performing waveform processing or modification such as noise component cut, or the like, a particular portion of the waveform that is to be edited is graphically shown on the LCD 43. On the fluorescent (FL) display 47 are displayed time information (time code) in a numerical value, levels of input signals or reproduced signals to or from the individual channels in a bar graph, etc. Note that the "virtual tracks" are imaginary tracks allocated to the respective tracks (i.e. real tracks). In the reproduction or simultaneous recording/reproduction, recorded data can be reproduced by selecting, one by one, the virtual tracks allocated to the real tracks to be reproduced. For example, in a situation where the number of the real tracks is "16" and the number of the virtual tracks allocated to each of the real tracks is "8", then a total of 128 virtual tracks can be provided.

The DSP 38 provides a mixing processing section for a plurality of channels. On the basis of manipulation, by the human operator, of any of the operators 20 and fader operators 26 or in accordance with mixing-function-related sequence data stored in the DRAM 36, the mixing processing section performs mixing processing to execute, for recording inputs and reproduction outputs, instructions that are issued from the main CPU 12 for routing, equalizing, effect imparting, fader level adjusting, sound-image-localization adjusting and other mixing functions.

Analog sound signals (recording inputs) of a plurality of channels (e.g., 16 channels at the maximum) input via an analog input terminal 40 of FIG. 3 are gain-controlled to signal levels suitable for analog-to-digital conversion and then passed to an A/D converter 42 for conversion into digital representation, from which the converted digital sound signals are supplied to the DSP 38 for mixing processing. Digital sound signals (recording inputs) of a plurality of channels (e.g., 16 channels at the maximum) input via a digital input terminal 44 are supplied via an interface 46 to the DSP 38 for mixing processing. The recording inputs having been subjected to the mixing processing is recorded onto an HDD 60 as will be later described. Digital sound signals (reproduction outputs) of a plurality of channels (e.g., 16 channels at the maximum) reproduced from the HDD 60 are mixed by the DSP 38 and then output from a digital output terminal 54 via an interface 52. Further, two-channel stereo signals obtained by the DSP 38 mixing the digital sound signals are converted by a D/A converter 48 into analog representation are output from an analog output terminal 50 for monitoring or other purposes.

To a bus 56 of the recorder CPU 14 are connected a flash ROM 58 having stored therein programs for execution by the recorder CPU 14, the HDD 60 constituting the external storage device of the present invention, a DRAM 62, and a DRAM controller (DRC) 68 for controlling data write and read to and from synchronous DRAMs (SDRAMs) 64 and 66 each functioning as a buffer memory of the present invention. Optical disk device 72, such as a CD-RW device, is also connected via an interface 70 to the bus 56 of the recorder CPU 14. Real time clock 76 for generating data indicative of a current date and time is connected via a parallel interface 74 to the bus 56 of the recorder CPU 14. Note that the programs for execution by the recorder CPU 14 include an arithmetic operation program for editing the metronome tone waveform. Further, basic waveform data of the metronome tone are stored in the flash ROM 58. The HDD 60 is connected to the bus 56, for example, via an interface in the form of IDE (Integrated Device Electronics) or the like. The optical disk device 72 is used to back up any desired one of the songs, recorded on the HDD 60, onto a CD-R or CD-RW disk. The optical disk device 72 is also used to reproduce a CD-ROM or the like having stored therein a version upgrading program and upper-version basic metronome tone waveform data so as to update a particular one of the programs, stored in the flash ROM 22, 34 and 58, with the reproduced upgrading program, and add or update the basic metronome tone waveform data with the reproduced upper-version basic metronome tone waveform data. Further, in predetermined areas of the SDRAMs 64 and 66, there are stored metronome tone waveform data which are waveform data of a first metronome tick in a measure and waveform data to be shared between second and subsequent metronome ticks in the measure and which have been waveform-edited as necessary. The metronome tone waveform data are reproduced by being repetitively read out at a tempo designated by the user while metronome tone reproduction is placed in an ON state by the user.

Figure 4:
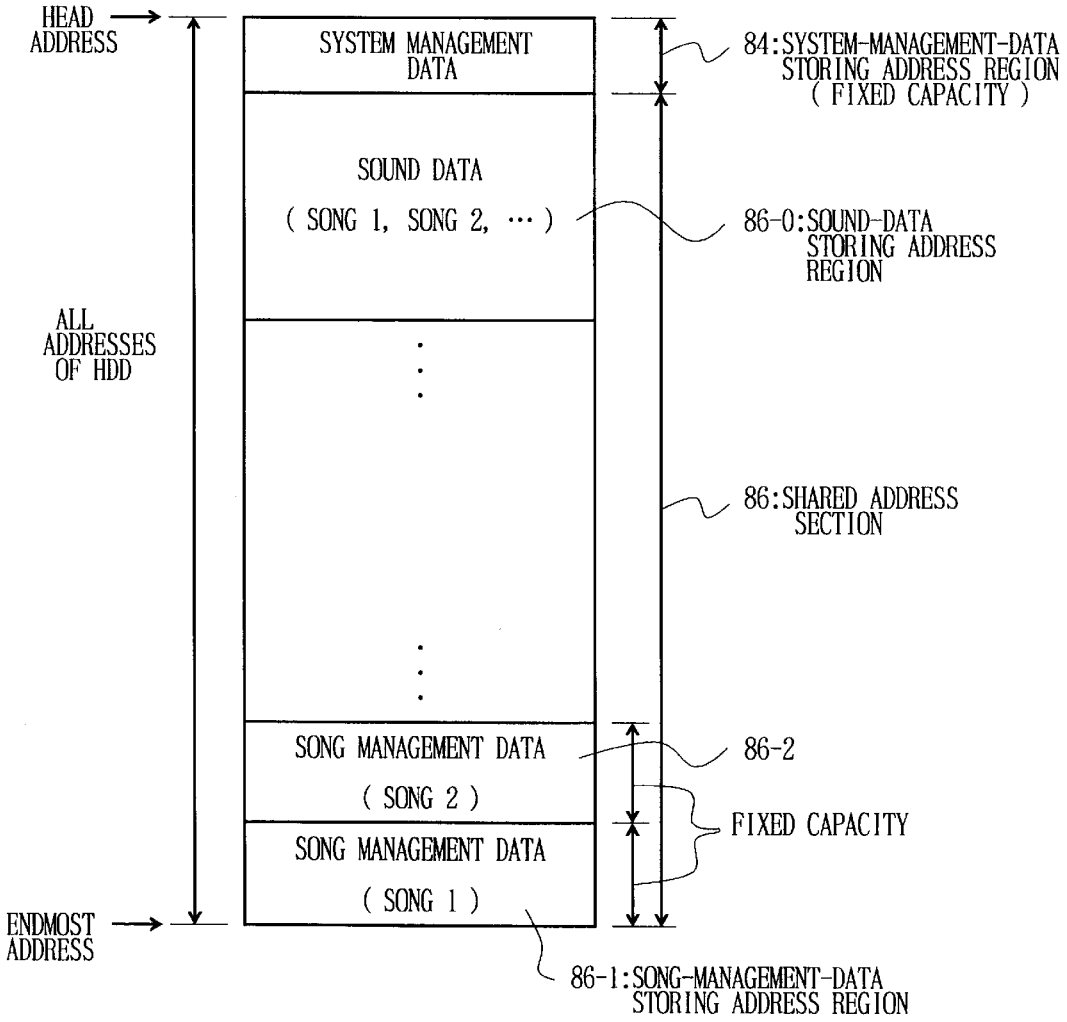
FIG. 4 is a diagram showing an exemplary manner in which a hard disk device or HDD of FIG. 3 is divided into various address regions for practicing the invention.

In FIG. 4, there is shown an exemplary manner in which the HDD 60 is divided into various address regions. As shown, the HDD 60 is divided into, in its start-to-end or fore-to-read direction, a system-management-data storing address region 84 of a fixed storage capacity and a shared address (shared storage) section 86 following the system-management-data storing address region 84 and lying up to the endmost of the HDD 60. In the shared address section 86, channel-by-channel (channel-specific) sound data are accumulatively recorded, sequentially in order of their takes, as digital signals from its fore end so that a sound-data storing region 86-0 is formed in a sequentially enlarged fashion, while song management data of individual songs are sequentially recorded from its rear end so that song-management-data storing address regions 86-1, 86-2, . . . are formed sequentially in the rear-to-fore direction. The sound data are recorded in clusters each having a size of 128 K bytes. Note that each of the clusters is a 64 K word (samples) and, in the case of data in the CD format, becomes data of 1.45 sec. (i.e., 64 K samples/44.1 kHz =1.45 sec.). Once recorded, the sound data will not be deleted unless an express instruction is given for deleting the corresponding take. In a situation where a plurality of tracks are recorded simultaneously, sound data of the individual tracks are recorded sequentially into the shared address section 86 by rotation, i.e. in such a manner that the sound data of one track are recorded after the sound data of another track. Further, sound data to be added later by punch-in/punch-out or the like, waveform-edited sound data, or the like are recorded immediately following a current end point of already-recorded sound data in the shared address section 86 apart from addresses where the sound data were recorded by initial recording on that track in question. Thus, sound data of each of the virtual tracks are recorded in the shared address section 86 dispersedly in clusters. When there occurs a long pause halfway through a music piece for a performance part being recorded and if the human operator designates a silent performance section for the channel in question, recording for that channel is ceased immediately in response to the silent performance section designation, so that sound data of that channel are prevented from being recorded into the shared address section 86 after data of one cluster containing data immediately before the recording cease have been recorded into the shared address section 86. Once the human operator makes an operation for instructing termination of the silent performance section for that channel, the recording for the channel is resumed so that the sound data of the channel are sequentially recorded in clusters into the shared address section 86.

In the song-management-data storing address region 86-1, 86-2, . . . for each of the songs, there are stored sequence data indicative of the linkage among the recorded addresses of the sound data of the individual virtual tracks which is necessary for reproducing the sound data of each individual virtual track contained in the song. Further, for each virtual track for which insertion of a silent performance section has been instructed, information indicative of start and end time points of the silent performance section is also recorded. In each of the song-management-data storing address region

86-1, 86-2, . . . there are stored mixing-function-related sequence data for each of the virtual tracks included in the song, as well as parameters for editing the waveform of the metronome tone (i.e., a pitch shift amount corresponding to a pitch adjusted on a song-by-song basis, envelope waveform parameters, etc. to be used in arithmetic operations for the later-described waveform editing). The song-management-data storing address region 86-1, 86-2, . . . for each of the songs has a fixed storage capacity (e.g., 1.5 M bytes per song), and each time the human operator instructs creation of a new song file, a new song-management-data storing address region is initialized and allocated to the song. The thus-allocated song-management-data storing address region is updated each time new sound data of that song is added such as by recording. Once set in the above-mentioned manner, the song-management-data storing address region 86-1, 86-2, . . . for each of the songs is not deleted unless the human operator explicitly instructs deletion of the song. In the system-management-data storing address region 84, there are stored system management data including data that is indicative of the respective recorded positions of the song management data of the individual songs.

The song management data are recorded sequentially from the rear end of the HDD 60 on the song-by-song basis; however, it is to be noted that in each of the song-management-data storing address regions 86-1, 86-2, . . . , the data are recorded in a normal or forward direction, i.e. in an address-incrementing direction. Because each of the song-management-data storing address regions 86-1, 86-2, . . . has a fixed storage capacity as noted above, the respective start locations of the song-management-data storing address regions 86-1, 86-2, . . . can be arithmetically obtained by just recording, in the system-management-data storing address region 84, the endmost address in the entire HDD 60. For example, the start location of the song-management-data storing address region 86-1 for the first song can be arithmetically determined by "(endmost address of the entire HDD 60)–(storage capacity of the song-management-data storing address region)." The addresses at the start locations of the song-management-data storing address regions 86-1, 86-2, . . . may be recorded in advance rather than being arithmetically determined in the above-mentioned manner. Although the endmost address of the shared address section has been described above as being coincident with the endmost address of the HDD 60, the present invention is not so limited and the endmost address of the shared address section may be set at any other suitable location.

With the above-described file arrangement, it is possible to automatically access the start address of the HDD 60 and read out the system management data as the hard disk recorder 10 is turned on. Then, when a desired song is designated, access can be made, on the basis of the system management data, to the song-management-data storing address region storing the song management data of the designated song. Then, when reproduction of the song is instructed, it is possible to sequentially access the addresses where the sound data are recorded, for each currently-selected virtual track of the song, so that the sound data of the individual virtual tracks can be reproduced.

In the DRAM 62 connected to the recorder CPU 14, as shown in FIG. 3, there are stored the system management data read out from the HDD 60, and sequence data indicative of a linkage among recorded locations, on the HDD 60, of the sound data related to a song currently designated for recording, reproduction, editing or the like, as well as waveform editing parameters of the metronome tone or tick. The DRAM 62 also functions as a working memory for the recorder CPU 14. Note that between the DSP 38 and the DRAM controller (DRC) 68, the sound data are communicated via a signals line 69 rather than via the buses 32 and 56.

The bus 32 of the main CPU 12 and bus 56 of the recorder CPU 14 are interconnected via a dual-port RAM (DPRAM) 78, so that various instructions, song management data and other information are communicated via these buses between the main CPU 12 and the recorder CPU 14. Sampling clock generator 80 generates clock pulses of a predetermined sampling frequency that are given to an AND circuit 82. The recorder CPU 14 outputs an active-performance-section designating signal that rises in synchronism with a start of recording or reproduction and falls in synchronism with an end of the recording or reproduction, and the active-performance-section designating signal is passed to the AND circuit 82. This way, the AND circuit 82 generates section sampling clock pulses from the start to end of the recording or reproduction. These sampling clock pulses are fed to external clock input terminals of the main CPU 12 and recorder CPU 14. Each of the main CPU 12 and recorder CPU 14 contains a counter for counting the clock pulses received via the above-mentioned external clock input terminal. The counters of the main CPU 12 and recorder CPU 14 are reset in synchronism with the start of the recording or reproduction and then count the sampling clock pulses. The main CPU 12 performs the mixing processing per sampling clock pulse in accordance with the counted value of the counter. Further, the recorder CPU 14 controls the data write/read to/from the HDD 60 and synchronous DRAMs (SDRAMs) 64 and 66 per sampling clock pulse in accordance with the counted value of the counter. This way, the main CPU 12 and recorder CPU 14 operate in synchronism with each other with respect to each sampling frequency (e.g., 48 kHz, 44.1 kHz or the like) while operating on their respective operation clocks (e.g., 28 MHz), and thus can perform the recording and reproduction control independently and in parallel to each other.

Figure 5:
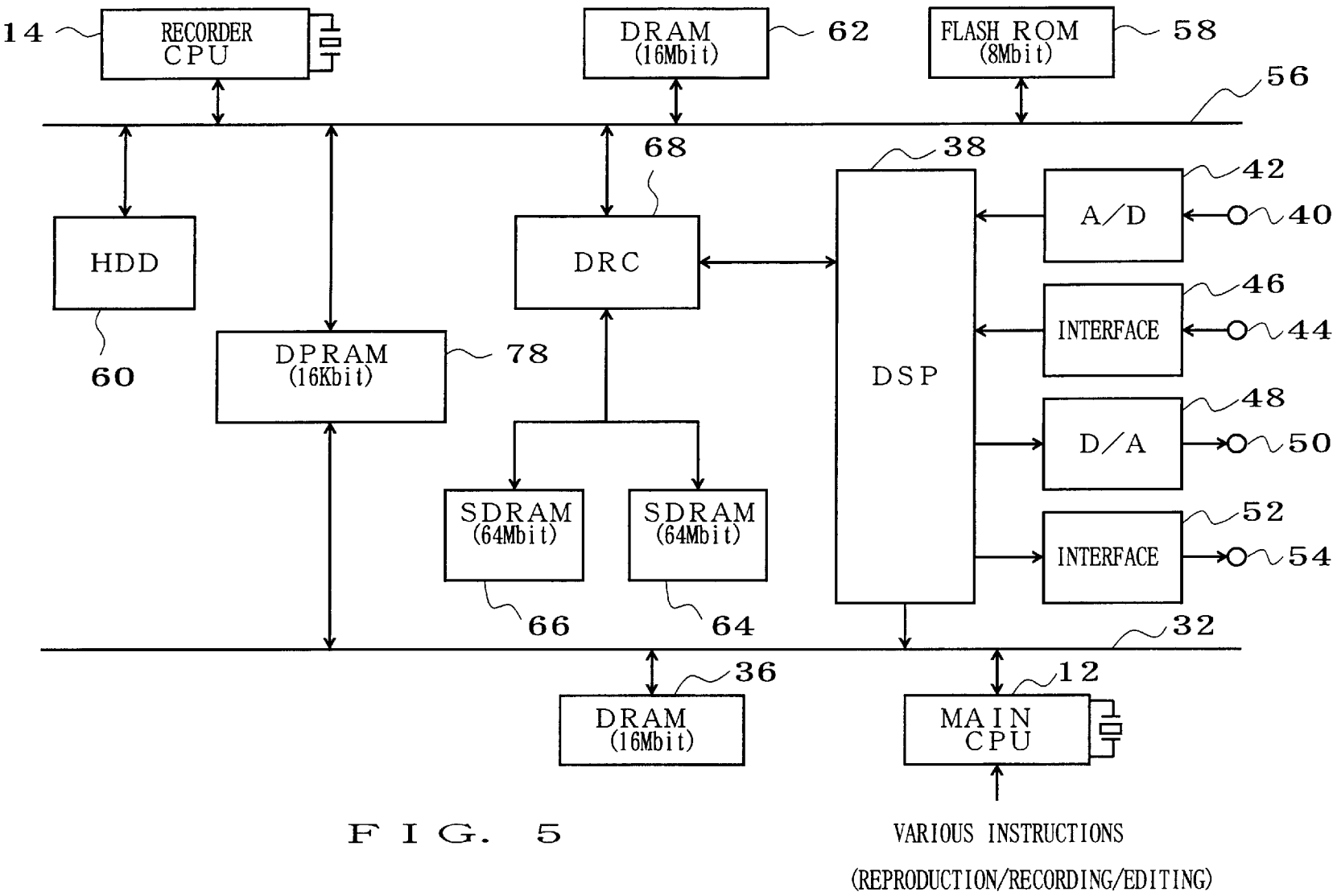
FIG. 5 is a block diagram showing sections of the hard disk recorder of FIG. 3 which relate to communication of sound data, system management data in a recording/reproduction mode of the hard disk recorder of the present invention.

The following paragraphs describe the transfer or communication of the data (sound data, system management data, song management data, etc.) and editing and generation of a metronome tone in the recording/reproduction mode of the hard disk recorder 10 shown in FIG. 3, with reference to FIG. 5. Upon power-on of the hard disk recorder 10, the system management data are read out from the system-management-data storing address region of the HDD 60 and delivered via the bus 56 to the DRAM 62 for storage therein. Then, once a desired song is designated, the recorder CPU 14 refers to the system management data stored in the DRAM 62 and then accesses an area of the song-management-data storing address region of the HDD 60 where are stored the song management data of the designated song, so as to read out the song management data from the song-management-data storing address area. Of the read-out song management data, the sequence data related to the mixing functions of the designated song are transferred via the bus 56, dual-port RAM (DPRAM) 78 and bus 32 to the DRAM 36. Further, of the read-out song management data, the sequence data indicative of the linkage among the recorded positions of a series of the sound data of that song are transferred via the bus 56 to the DRAM 62. In this way, various processes, such as recording, reproduction and waveform editing, can be performed on the designated song in accordance with instructions from the human operator. Note that for each song to be recorded for the first time, a new file of the song is created (i.e., a new song-management-data storing address region is initialized and secured in the HDD 60), in advance, in accordance with manipulation by the human operator. Song management data of the new song are stored into the DRAMs 36 and 62 so that the hard disk recorder 10 is brought into a state ready for recording the song.

In the recording/reproduction mode, the following operations are carried out on each track for which data recording has been instructed (recording channel). Each recording signal (sound data) for the track, introduced via the analog input terminal 40 or digital input terminal 44, is passed via the A/D converter 42 or interface 46 to the DSP 38, where the mixing processing is performed on the input recording signal in accordance with manipulation, by the human operator, of any of the operators 20 and fader operators 26. The recording signal having been subjected to the mixing processing is then sequentially stored from the DRAM controller (DRC) 68, via the predetermined signal line 69 that is separate from the bus 56, into the synchronous DRAMs (SDRAMS) 64 and 66 constituting the buffer memory. The sound data thus stored in the synchronous DRAMs 64 and 66 are transferred periodically via the bus onto the HDD 60 in a DMA (Direct Memory Access) fashion. Of system management data and song management data to be newly created this time, sequence data indicative of the linkage among the reproduced positions of the sound data are sequentially accumulated into the DRAM 62, and sequence data of the song management data related to the mixing functions are sequentially accumulated into the DRAM 36. In response to a user's data storing operation after completion of the recording, the sequence data related to the mixing functions having been accumulated in the DRAM 36 are delivered via the dual-port-RAM (DPRAM) 78 to the bus 56. Thus, the sequence data are overwritten into the song-management-data storing address region of the HDD 60 storing the song management data of the song, along with the data indicative of the linkage among the recorded positions, on the HDD 60, of the sound data accumulated in the DRAM 62. In addition, the system management data stored in the DRAM 62 are overwritten into the system-management-data storing address region of the HDD 60.

Further, in the recording/reproduction mode, the following operations are performed on each track for which data reproduction has been instructed (reproduction channel). The recorder CPU 14 refers to the data indicative of the linkage among the reproduced positions of the track stored in the DRAM 62 and thus sequentially reads out the corresponding sound data from the HDD 60. The read-out sound data are transferred in the DMA (Direct Memory Access) fashion, via the bus 56 and DRAM controller 68, to the synchronous DRAMs 64 and 66 for storage therein. The DRAM controller 68 sequentially reads out the sound data from the synchronous DRAMs 64 and 66 at the predetermined sampling frequency. The sound data read out from the synchronous DRAMs 64 and 66 are transferred from the DRAM controller 68, via the above-mentioned predetermined signal line 69 that is separate from the bus 56, to the DSP 38. The main CPU 12 sets parameters for the DSP 38 by referring to the mixing-function-related sequence data stored in the DRAM 36, and then performs the mixing processing on the transferred sound data. The sound data having undergone the mixing processing are output from the digital output terminal 54 via the interface 52. Further, the signals having been mixed into two-channel stereo signals within the DSP 38 are converted via the D/A converter 48 into analog signals that are then output from the analog output terminal 50. Note that in the recording/reproduction mode, signals of the individual tracks designated for the recording or reproduction are sequentially processed on the time-divisional basis, during which time the synchronous DRAMs or SDRAMs 64 and 66 are switched, on the time-divisional basis, between the write and read modes depending on whether the currently designated track is a recording track or reproducing track.

Figure 6:
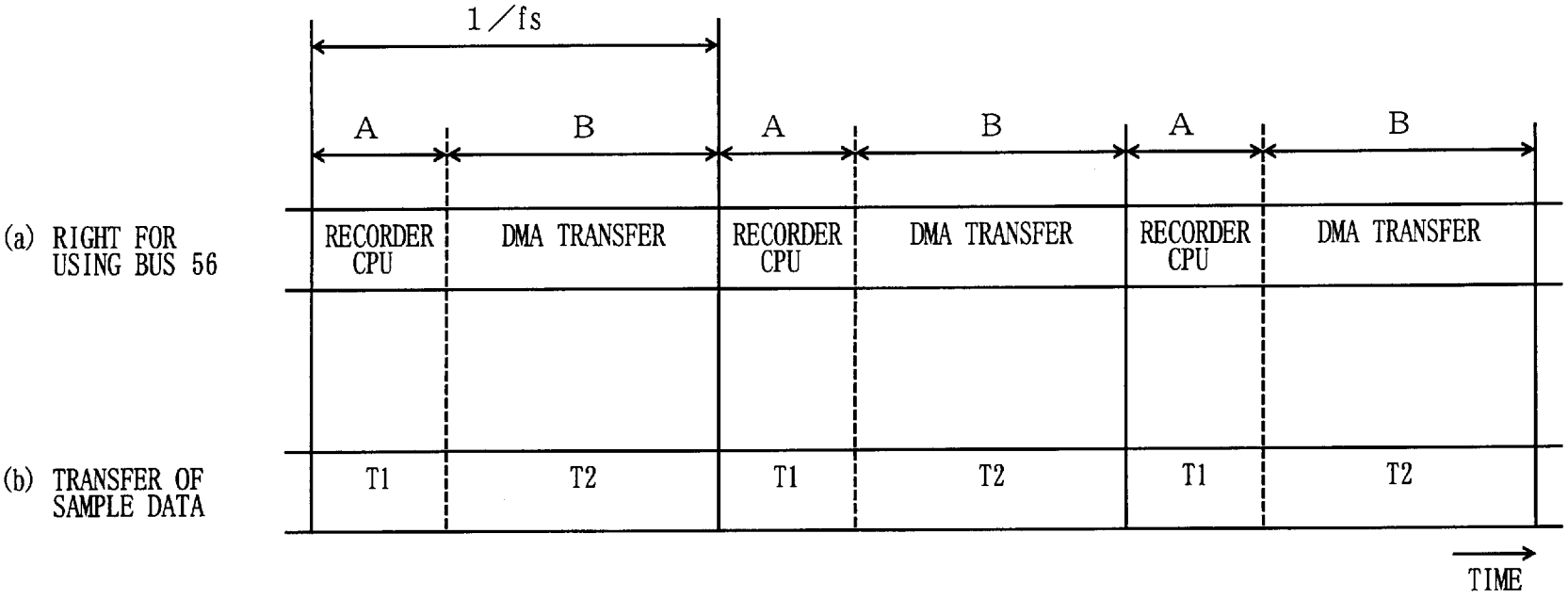
FIG. 6 is a time chart showing exemplary manners in which a right for using a bus is divided into two predetermined sections and data writing/reading operations on synchronous DRAMs or SDRAMs are performed within sampling periods in the recording/reproduction mode of the present invention.

Now, a description will be made about specific examples of bus-use right control (for controlling the right for using the bus 56) and sample data transfer control (i.e., write/read control of the SDRAMs 64 and 66) which are both performed in the recording/reproduction mode. In the recording/reproduction mode, the right for using the bus 56 is divided into two predetermined time sections A and B, i.e. a first time period A and a second time period B, per sampling cycle 1/fs (fs=48 kHz, 44.1 kHz or the like), as shown in FIG. 6. Time section A has a length smaller than time section B (A<B). In time section A, the right for using the bus 56 is given to the recorder CPU 14, while in time section B, the right for using the bus 56 is allocated to the DMA transfer operation between the SDRAM 64 or 66 and the HDD 60. Within time section A, the recorder CPU 14 accesses, via the bus 56, the program stored in the flash ROM 58 and song management data stored in the DRAM 62 and thereby executes the program. The sample data transfer control is carried out in the following manner.

Namely, for each recording channel (input channel), the sound data are time-divisionally written, sample by sample, into the SDRAM 64 or 66 via the signal line 69 within time section A. Then, in time section B, plural samples of the sound data of the recording channel are read out from the SDRAM 64 or 66 and DMA-transferred via the bus 56 to the HDD 60 for storage therein. For each reproduction channel (output channel), the sound data are time-divisionally read out, sample by sample, from the SDRAM 64 or 66 and output via the signal line 69 within time section A. Then, in time section B, plural samples of the sound data of the reproduction channel are read out from the HDD 60 and DMA-transferred via the bus 56 to the SDRAM 64 or 66 for storage therein.

For the above-mentioned DMA-transfer from the SDRAM 64 or 66 to the HDD 60, the sample data constituting one cluster are newly accumulated into the SDRAM 64 or 66 for each of the channels, upon which the sample data of the one cluster thus newly accumulated (or previously accumulated) are collectively DMA-transferred every section B of the sampling period. More specifically, once the DMA transfer of the sample data of one cluster for one channel is completed, similar collective DMA transfer of the sample data of one cluster having been newly accumulated into the SDRAM is carried out for another channel. This way, the sample data of the individual channels are DMA-transferred cluster by cluster with the bus 56 time-divisionally shared between the channels. Further, for the above-mentioned DMA-transfer from the HDD 60 to the SDRAM 64 or 66, the sample data constituting one cluster are read out from the SDRAM 64 or 66 for each of the channels, upon which the sample data of one cluster thus read out are collectively DMA-transferred every section B of the sampling period. More specifically, once the DMA transfer of the sample data of one cluster for one channel is completed, similar collective DMA transfer of the sample data of one cluster having been newly read out from the SDRAM is carried out for another channel. This way, the sample data of the individual channels are DMA-transferred cluster by cluster with the bus 56 shared time-divisionally between the channels.

Note that in case there is no need to DMA-transfer the data for any of the channels, i.e. in a situation where one cluster of the input data from the input/output signal line 69 has not been newly written in the SDRAM 64 or 66 or where one cluster of the data has not been read out from the SDRAM 64 or 66 to the input/output signal line 69, the DMA transfer is not carried out, and the bus-use right is given to the recorder CPU 14 for the whole of every sampling cycle. Also note that the respective address areas of the SDRAMs 64 and 66 are divided on a channel-by-channel basis, and the address area for each of the channels has a capacity enough to store at least two clusters of the sample data at a time. Namely, while one cluster of the sample data of a given channel is DMA-transferred using one of the at least two usable address areas, the sample data of the same channel newly input by recording or to be reproductively output can be written or read out every sampling cycle, sample by sample, using the other address area. By alternately switching the functions of the address area used for the DMA transfer and the address area used for writing or reading out, sample by sample, the sample data newly input by recording or to be reproductively output, the DMA transfer and write/read of the sample data for the same channel can be performed concurrently in parallel relation to each other.

Figure 7:
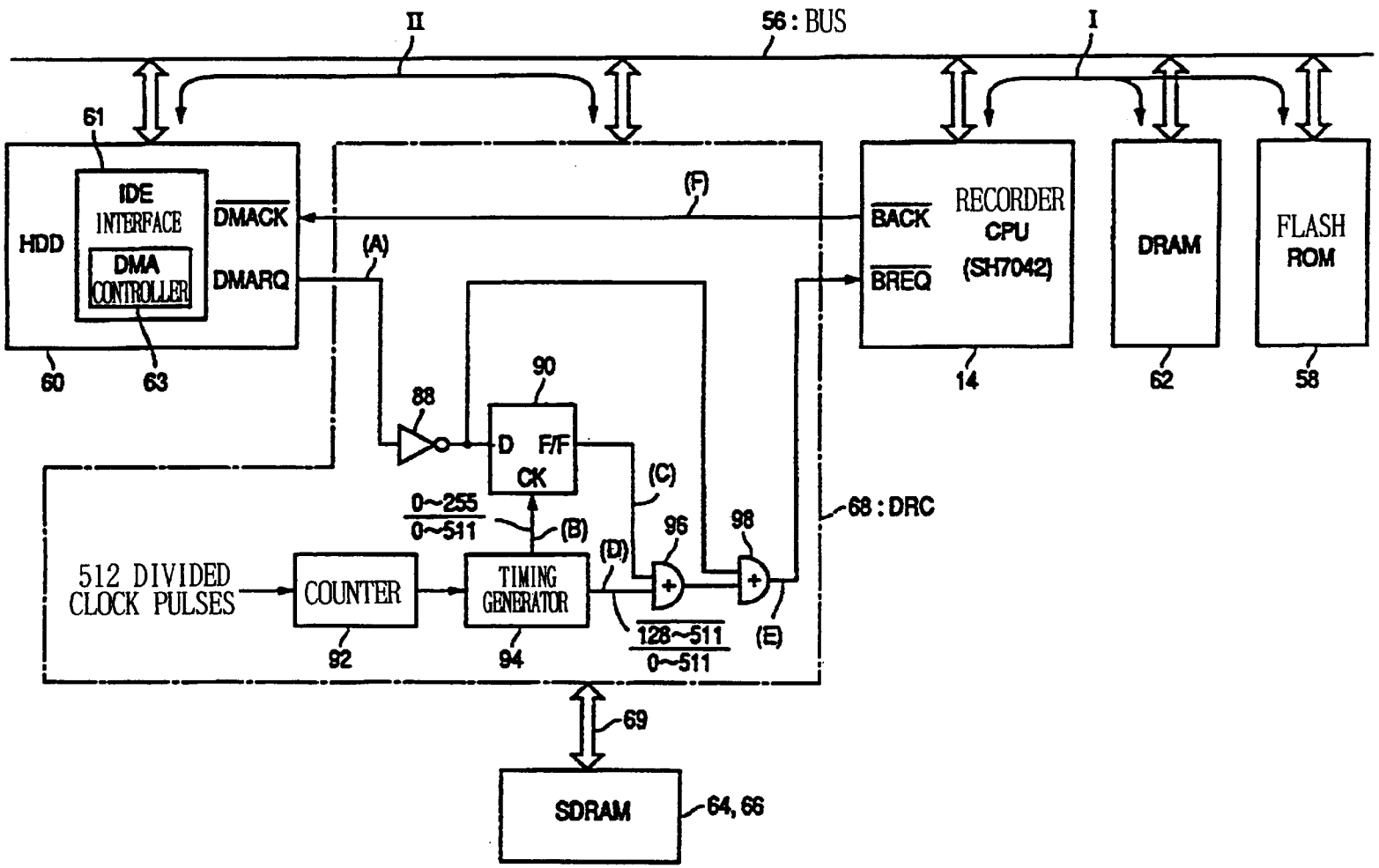
FIG. 7 is a block diagram showing a general setup of a control unit that performs time-divisional control of the right for using the bus in the hard disk recorder of FIG. 7.
Figure 8:
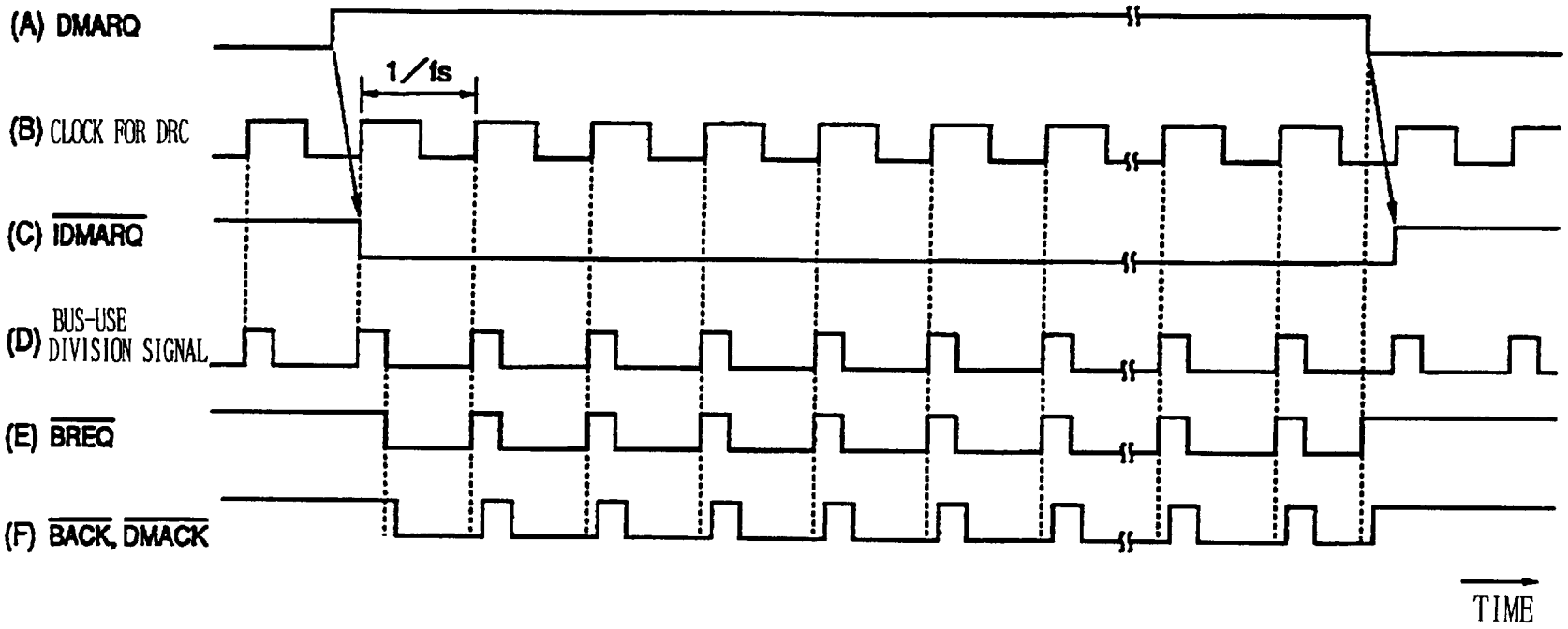
FIG. 8 is a time chart shows behavior of the control unit of FIG. 7 in the recording/reproduction mode.

The following paragraphs describe a specific example of the time-divisional control of the right for using the bus 56 in the recording/reproduction mode. FIG. 7 shows a general setup of a control unit that performs the time-divisional control of the right for using the bus 56, and FIG. 8 shows behavior of the DRC 68 of the control unit in the recording/reproduction mode. In FIG. 8, (A) to (F) represent signal waveforms appearing at points (A) to (F) in FIG. 7. Let it be assumed here that the recorder CPU 14 is the "SH7042" single-chip RISC microcomputer commercially available from HITACHI, Ltd. and that the control is performed on the basis of clock pulses each corresponding to 1/521 of one sampling period. Although the "SH7042" RISC microcomputer contains a DMA controller for performing the DMA transfer, let's assume here that the illustrated example of FIG. 7 does not use the built-in DMA controller within the recorder CPU 14 but uses a DMA controller 63 within an IDE interface 61, contained in the HDD 60, to control the DMA transfer.

In FIG. 7, each time one cluster of the sample data newly input by recording has been accumulated into the SDRAM 64 or 66 (or one cluster of the sample data to be reproductively output has been read out from the SDRAM 64 or 66) for any recording channel or reproduction channel while the recording/reproduction mode is ON, the recorder CPU 14 instructs the DRC 68 and HDD 60 to start up the DMA transfer operation. In response to the instruction from the recorder CPU 14, the HDD 60 issues a DMA request signal DMARQ ("High" level) (signal waveform (A) of FIG. 8). The DRAM controller or DRC 68 inverts the DMA request signal DMARQ by means of an inverter 88 and passes the inverted signal to a D flip-flop circuit 90. Counter 92 is reset, every sampling-period start timing, to count clock pulses each corresponding to 1/521 of one period (1/fs) of the sampling clock pulses (48 kHz, 44.1 kHz or the like) generated by the sampling clock generator 80 shown in FIG. 3. Timing generator 94 generates a bus-use-right division signal (signal waveform (D) shown in FIG. 8) that varies in value in accordance with a count value of the counter 92; that is, the bus-use-right division signal takes a "High" level for a period when the count value of the counter 92 is in a range of 0–127 (i.e., for a first quarter of one sampling period from the onset thereof) and takes a "Low" level for a period when the count value of the counter 92 is in a range of 128–521 (i.e., for the remaining three quarters of the sampling period). Further, the timing generator 94 also generates a clock signal (signal waveform (B) in FIG. 8) that takes a "High" level for a period when the count value of the counter 92 is in a range of 0–255 (i.e., for a first or former half of one sampling period) and takes a "Low" level for a period when the count value of the counter 92 is in a range of 256–521 (i.e., for a second or latter half of the sampling period). The D flip-flop circuit 90 takes in the inverted version of the DMA request signal DMARQ (signal synchronous with the clock pulse within the HDD 60) and outputs a Low-level DMA request signal IDMARQ (signal waveform (C) in FIG. 8). OR circuit 96 takes in the above-mentioned DMA request signal IDMARQ and the bus-use-right division signal and outputs the bus-use-right division signal for a period when the DMA request signal IDMARQ is at the Low level. Another OR circuit 98 takes in the output signal of the OR circuit 96 and the inverted version of the DMA request signal DMARQ, and outputs, as a bus-use-right request signal BREQ (signal waveform (E) in FIG. 8), a signal to stop the output of the bus-use-right division signal in synchronism with the Hihgh-level DMA request signal DMARQ.

Once the Low-level bus-use-right request signal BREQ is received, the recorder CPU 14 releases the bus-use right and outputs a Low-level bus-use-right request acceptance signal BACK (signal waveform (F) in FIG. 8). Upon receipt of the bus-use-right request acceptance signal BACK from the recorder CPU 14, the DRC 68 forwards the received signal BACK directly to the HDD 60 as a DMA acceptance signal DMACK. The HDD 60 and DRC 68 exclusively use the bus 56 to perform the DMA transfer while the bus-use-right request acceptance signal BACK (DMACK) is at the Low level. Further, during the DMA operation, the DRC 68 sets the bus-use-right request signal BREQ to the High level for the first quarter of every sampling period so as to intermittently return the bus-use right. Thus, only for the first quarter of the sampling period, the recorder CPU 14 exclusively uses the bus 56 to access the DRAM 62 and flash ROM 58 and thereby execute the program necessary for recording or reproduction.

During the time that the recorder CPU 14 is exclusively using the bus 56, the DMA transfer between the HDD 60 and DRC 68 is suspended, so that every sampling period, the DRC 68 uses the signal line 69, separate from the bus 56, to write input sample data to the SDRAM 64 or 66 for each recording channel (one sample per channel) or read out output sample data from the SDRAM 64 or 66 (one sample per channel). Thus, the bus-use right is divided in such a manner that in the first quarter from the onset of each sampling period, the recorder CPU 14 functions as a bus master to access the DRAM 62 and flash ROM 58 via the bus 56 for execution of the program as denoted by reference character I in FIG. 7, while in the remaining three quarters of the sampling period, the HDD 60 (IDE) functions as the bus master to carry out the DMA transfer between the HDD 60 and the DRC 68 via the bus 56 as denoted by reference character II in FIG. 7.

Figure 9:
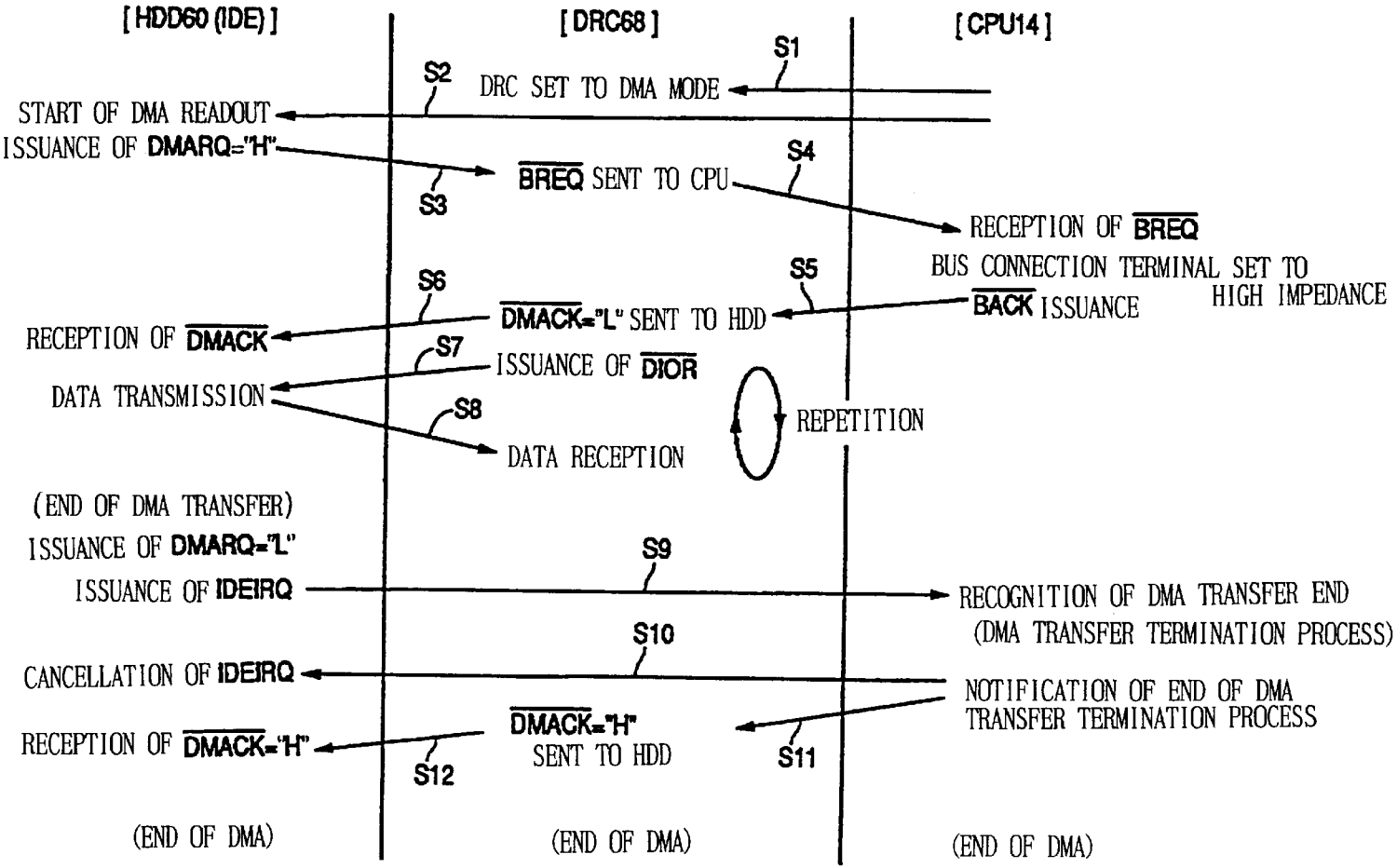
FIG. 9 is a diagram showing an exemplary manner or protocol in accordance with which the control unit of FIG. 7 carries, out DMA transfer for one reproduction channel.

Now, with reference to FIG. 9, a description will be made about an exemplary manner or protocol in accordance with which the control unit of FIG. 7 carries out the DMA transfer for one reproduction channel. Once the readout, from the SDRAM 64 or 66, of one cluster of the sample data to be reproductively output has been completed in the recording/reproduction mode, the DRC 68 is set, at step S1, to a mode for carrying out the DMA transfer, in response to an instruction from the recorder CPU 14. Also, at step S2, the recorder CPU 14 issues an instruction to the HDD 60 (IDE) that instructs the HDD 60 (IDE) to start the sample data readout for the DMA transfer. Upon receipt of such an instruction from the recorder CPU 14, the HDD 60 issues and transfers a High-level DMA request signal DMARQ to the DRC 68 at step S3. In response to the DMA request signal DMARQ, the DRC 68 issues and transfers a Low-level bus-use-right request signal BREQ to the recorder CPU 14 at step S4. Upon receipt of the Low-level bus-use-right request signal BREQ from the DRC 68, the recorder CPU 14 sets its strobe terminal to an High-level output mode, sets each of the strobe terminal, address terminal and data terminal to a high impedance state, and then issues a Low-level bus-use-right request acceptance signal BACK, at step S5. In response to the low-level bus-use-right request acceptance signal BACK from the recorder CPU 14, the DRC 68 issues and transfers a Low-level DMA acceptance signal DMACK to the HDD 60, at next step S6. Then, the DRC 68 supplies the HDD 60 with a signal to prompt the HDD 60 to send the data, at step S7. Upon receipt of the prompt signal from the DRC 68, the DRC 68 performs the data transmission (DMA transfer) for each time section allocated to the DMA transfer; that is, while the DMA request signal DMARQ is at the High level, new sample data are sent out from the HDD 60 each time DIOR falls to a Low level. The sample data sent out from the HDD 60 are received by the DRC 68 at step S8, from which they are transferred to the SDRAM 64 or 66. Once the DMA transfer of one cluster of the sample data has been completed in the above-mentioned manner, the HDD 60 sets the DMA request signal DMARQ to the Low level and also issues an interrupt request signal IDEIRQ, at step S9. The interrupt request signal IDEIRQ is forwarded via the DRC 68 to the recorder CPU 14, on the basis of which the recorder CPU 14 recognizes termination of the DMA transfer and then carries out a DMA transfer termination process. Upon completion of the DMA transfer termination process by the recorder CPU 14, the completion of the DMA transfer termination process is informed to the HDD 60 via the DRC 68 at step S10, and thus the HDD 60 terminates the issuance of the interrupt request signal IDEIRQ. Also, at step S11, the HDD 60 brings the bus-use-right request acceptance signal BACK back to the High level and transfers the High-level bus-use-right request acceptance signal BACK to the DRC 68, in response to which the DRC 68 brings the DMA request signal DMARQ back to the High level and transfers the High-level DMA request signal DMARQ to the HDD 60 at step D12. In this way, the DMA transfer is completed, and then the bus 56 continues to be used exclusively by the recorder CPU 14 until the DMA transfer is requested next for any one of the channels.

By dividing the address areas of the SDRAMs 64 and 66 on the channel-by-channel basis and allocating the divided address areas for the individual channels to respective separate banks so as to write or read out the data of the individual channels to or from the SDRAM 64 or 66, sample by sample, on the time divisional basis within the first quarter (from the onset) of every sampling period while alternately designating the channels of the different banks (in such a manner that the channels allocated to a same bank are never written in succession), about three to four samples of the data can be written or read out to or from the SDRAM 64 or 66 every eight clocks out of the 512 divided clock pulses. In this case, assuming that the number of the input/output channels is 24 to permit recording of 8 tracks concurrently with simultaneous reproduction of 16 tracks, the sample data can be written or read out to or from the SDRAM 64 or 66, one sample per channel, within the first quarter (equal to a time length of 128 clock pulses) of each sampling period with a sufficient time margin. Further, because the DMA transfer of one sample can be completed every four clock pulses out of the 512 divided clock pulses, about 90 samples can be DMA-transferred within the remaining three quarters of each sampling period (i.e., within a time length of 384 clock pulses). Therefore, in a case where data in the CD format (16 bits and 44.1 kHz) are handled, one cluster (128 K bytes) of the sample data of one channel, —64 K samples (in the CD format, data of about 1.45 sec. (64 K samples/44.1 kHz))—can be performed sufficiently within about 800 sampling periods (64,000/90) equal to about 20 msec.

Figure 10:
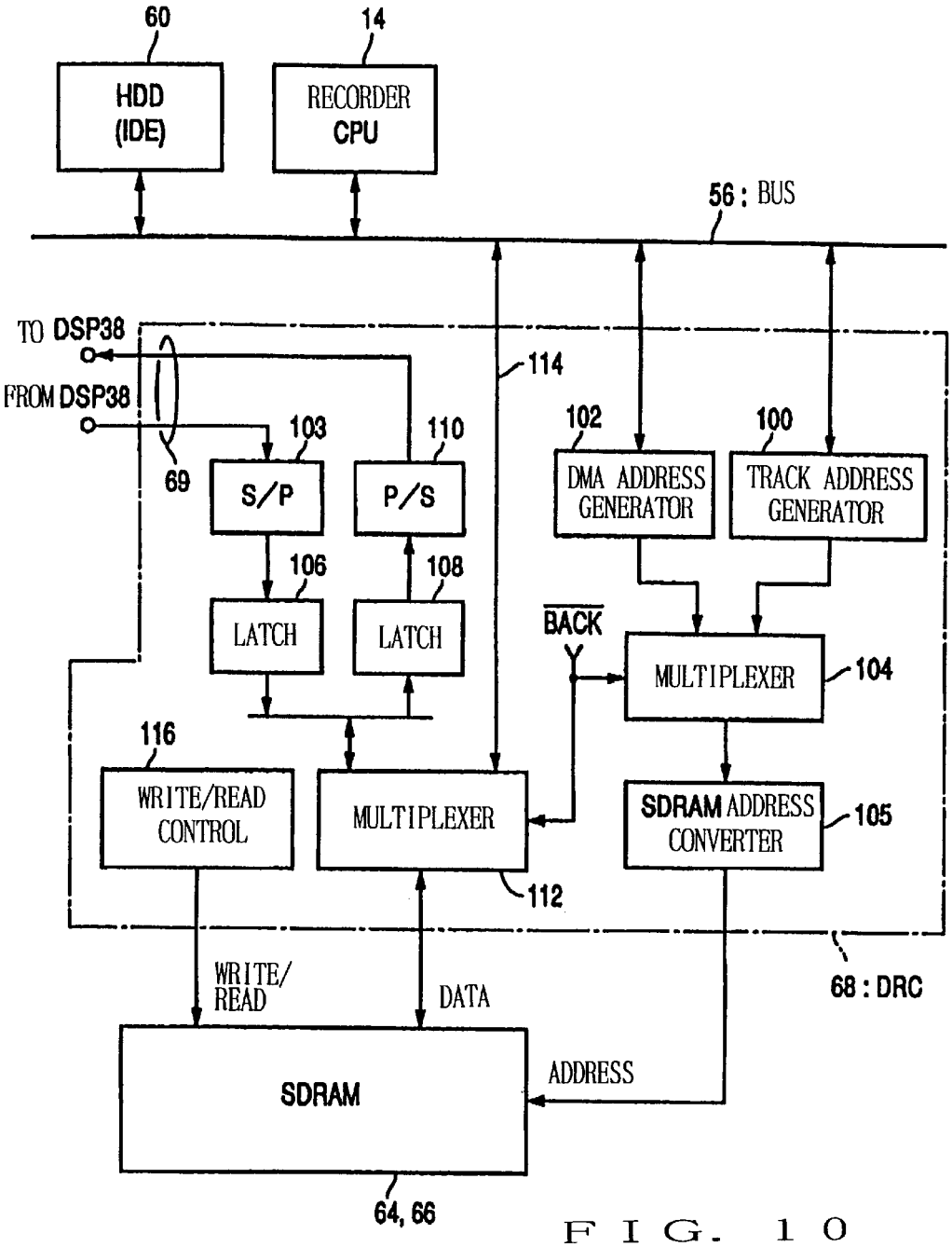
FIG. 10 is a block diagram showing specific examples of construction of a signal path for transferring sample data within a DRAM controller or DRC of FIG. 3 and a signal path for transferring address information within the SDRAMs.

FIG. 10 is a block diagram showing specific examples of construction of the signal path for transferring sample data within the DRC 68 and the signal path for transferring address information within the SDRAM 64 or 66. In the recording/reproduction mode of the present invention, a track address generator 100 generates address information for writing one input sample data of each channel or reading out one output sample data of each channel to or from the SDRAM 64 or 66 within the first quarter (from the onset) of each sampling period. Then, within the remaining three quarters of the sampling period, the track address generator 100 calculates, for each of the channels, a write or read address to access the SDRAM 64 or 66 in a next sampling period. Further, in the recording/reproduction mode, a DMA address generator 102 generates address information with which to write or read out the DMA transfer data of each of the channels to or from the SDRAM 64 or 66 within the remaining three quarters of each sampling period occurring in the time section when the DMA transfer is being performed. The address information is generated as information indicative of the start address of the SDRAM 64 or 66, where data writing or readout is performed by DMA transfer, is given by the recorder CPU 14 and then the start address is sequentially incremented by the DMA address generator 102 at predetermined time intervals. Multiplexer 104 uses, for example, the above-mentioned bus-use-right request acceptance signal BACK (signal waveform (F) in FIG. 8) as a switching signal, to selectively output the address information generated by the track address generator 100 for the first quarter (from the onset) of each sampling period occurring in the time section when the DMA transfer is being performed, but selectively output the address information generated by the DMA address generator 102 for the remaining three quarters of each sampling period occurring in the time section when the DMA transfer is being performed. The address information output from the multiplexer 104 is time-divided by an SDRAM address converter 105 into a row address and a column address that are then fed to an address input terminal of the SDRAM 64 or 66.

The sample data of each input channel supplied from the DSP 38 (FIGS. 3 and 5) are converted via a serial-to-parallel converter 103 into parallel data and then latched by a latch circuit 106, one sample per channel. The thus-latched sample data are written into the SDRAM 64 or 66 via a multiplexer 112. The sample data of each output channel read out from the SDRAM 64 or 66 are latched by a latch circuit 108, one sample per channel, and converted via a parallel-to-serial converter 110 into serial data to be output to the DSP 38. The sample data latched by the latch circuits 106 and 108 are rewritten every sampling period. The DMA transfer data are DMA-transferred between the SDRAM 64 or 66 and the HDD 60 via the multiplexer 112, signal line 114 and bus 56. The multiplexer 112 uses, for example, the above-mentioned bus-use-right request acceptance signal BACK as a switching signal, to select the signal line 69 so as to input/output one sample per input/output channel for the first quarter (from the onset) of each sampling period occurring in the time section when the DMA transfer is being performed, but to select the signal line 114 so as to input/output the DMA transfer data for the remaining three quarters of each sampling period occurring in the time section when the DMA transfer is being performed. Write/read control circuit 116 sets the SDRAM 64 or 66 to the write mode when the current timing is one for writing data into the SDRAM 64 or 66, but sets the SDRAM 64 or 66 to the read mode when the present timing is one for reading data from the SDRAM 64 or 66.

In Table 1 below, there is shown an example of assignment of the channels to the banks, in the SDRAMs 64 and 66 constituting the buffer memory, for normal recording/reproduction in the recording/reproduction mode.

TABLE 1

| Chip No. | Bank No. | Assigned Channel No. or Name |
|---|---|---|
| 0 | 0 | 0, 2, 4, 6, 8, 10 |
| 0 | 1 | 1, 3, 5, 7, 9, 11 |
| 0 | 2 | 12, 14, 16, 18, 20, 22 |
| 0 | 3 | 13, 15, 17, 19, 21, 23 |
| 1 | 0 | metronome (1st tick), sampler |
| 1 | 1 | sampler |
| 1 | 2 | sampler |
| 1 | 3 | sampler metronome (2nd and subsequent ticks) |

Chip 0 (i.e., one of the SDRAMs 64 and 66) and chip 1 (i.e., the other of the SDRAMs 64 and 66) includes a total of four banks, bank Nos. 0–4. Performance channel Nos. 0–23 are allocated to areas of chip 0 having an equal capacity. Every adjoining channel Nos. are allocated to separate banks. To bank 0 of chip 1 are allocated the areas for an entire waveform of the first metronome tone a measure and a sampler. To the whole of banks 2 and 3 are assigned the areas for the sampler. To bank 4 are allocated the areas for the sampler and entire waveform of the metronome tone to be shared for the second and subsequence metronome ticks the measure. Whereas sound data in the areas for performance channels 0–23 are sequentially updated in accordance with progression of a music piece performance in the recording/reproduction mode, the metronome tone and sampler tone are read out and used repetitively; thus, the metronome tone and sampler tone are not updated unless there is a particular need for updating. Note that the metronome tone is automatically read out repetitively at a tempo designated by the human operator while metronome tone reproduction is set in an ON state by the human operator, while the sampler tone is read out repetitively each time tone generation is instructed by the recorder CPU 14 on the basis of an operation by the human operator. Namely, because all of the waveform data to be reproduced for generation of the metronome tone and sampler tone are already stored in the SDRAM 64 or 66, there is no need for writing data into the SDRAM 64 or 66 during reproduction of the metronome tone or sampler tone, and only data readout from the SDRAM 64 or 66 is carried out during the reproduction. The readout of the metronome tone and sampler tone from the SDRAM 64 or 66 is executed, one sample per sampling period 1/fs (when a plurality of different types of samplers are designated, one sample per sampler type) along with the sound data readout process of each performance tone reproduction channel and sound data write process of each recording channel on the time-divisional basis. Typically, a desired number of desired sampler tones are previously recorded by the human operator so that before recording is initiated by designation of a desired song in the recording/reproduction mode, particular one or more (up to eight) of the previously recorded sampler tones are selected by the human operator and the corresponding sampler tone data are read out from the HDD 60 to be written into given channels (any of samplers 0–7) of the SDRAM 64 or 66. Then, by the human operator instructing, such as via activation of a predetermined button, generation of the sampler tone of a desired channel at desired timing after the start of recording, the sampler tone of a desired channel is generated, and the time of the tone generation and tone generating channel are recorded into song management data. Then, once reproduction of the thus-recorded song is instructed, the corresponding sampler tone is read out from the SDRAM 64 or 66 at the corresponding timing and then audibly reproduced or sounded.

Figure 11:
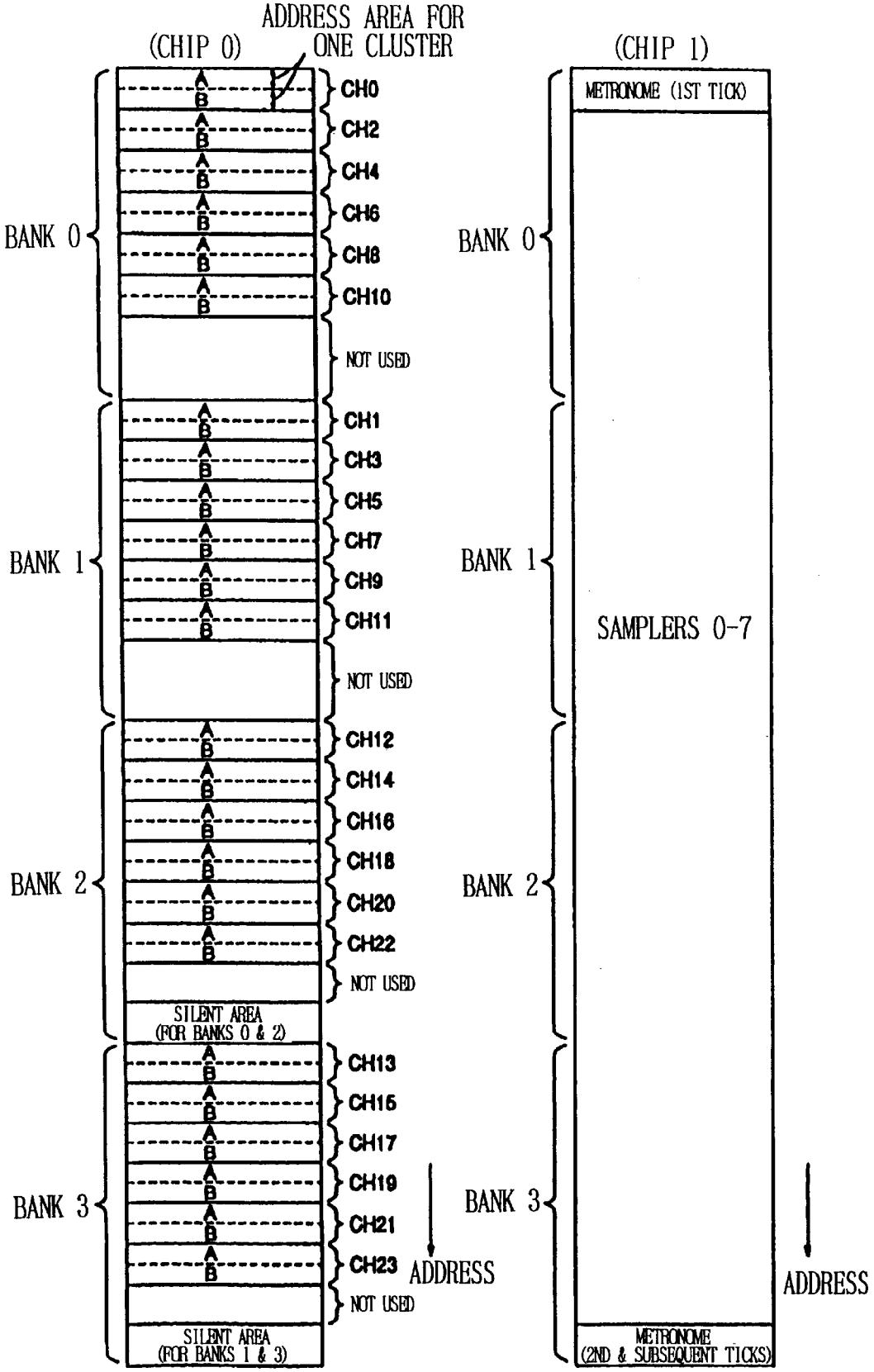
FIG. 11 is a diagram showing an example of an address map of the SDRAMs for normal recording/reproduction.

FIG. 11 is a diagram showing an example of an address map of the SDRAMs 64 and 66 (one of them is chip 0 and the other is chip 1) which corresponds to the channel assignment of Table 1 above. In chip 0, successive address areas A and B for a total of two clusters (each address area for one cluster) are allocated to each of performance channels 0–23. In chip 0, a silent area for the channels assigned to banks 0 and 2 is allocated immediately following the rear end of bank 2, and a silent area for the channels assigned to banks 1 and 3 is allocated immediately following the rear end of bank 3. Each of the silent areas has an appropriate size equal to about one or two clusters, in which silent data is inserted and held upon activation of the recording/reproduction mode. Area of an appropriate size (about the size of one cluster) is allocated to the head of chip 1 for the first metronome tick, and another area of an appropriate size (about the size of one cluster) is allocated immediately following the rear end of chip 1 for the second and subsequent metronome ticks. Upon activation of the recording/reproduction mode, the sound data of the first metronome tick and sound data of the second and subsequent metronome ticks, read out from the flash ROM 58 (FIG. 3), are held in the respective metronome areas. Sampler area is allocated to an intermediate continuous area between the head and end of chip 1. The number of samplers to be allocated to the sampler area may be set as desired by the human operator (up to eight different types, i.e. sampler types 1–7 and up to a time length of 80 sec.).

In Table 2 below, there is shown an exemplary control sequence in accordance with which data are written and read out to and from the SDRAMs 64 and 66, sample by sample, by the DRC 68 at the time of normal recording and reproduction, in relation to a case where the SDRAMs 64 and 66 are each in the form of "HITACHI HM5264165-B60", the channels are assigned to the banks of the SDRAMs 64 and 66 and the data of each channel are written to or read out from the SDRAM 64 or 66 within the first quarter (0th to 127th time slots, namely, time section A) of each sampling period (a total of 512 time slots). In Table 2, the following alphabetical marks have meanings as stated below.

ACT: Command for activating a selected bank. Row address is designated in response to this command.

RDwAP: Abbreviation for "read with auto pre-charge", which is a command for reading out data and automatically pre-charging upon completion of the data readout. Column address is designated in response to this command.

WTwAP: Abbreviation for "write with auto pre-charge", which is a command for writing data and automatically pre-charging upon completion of the data write. Column address is designated in response to this command.

R/WTwAP: Abbreviation for "read or write with auto pre-charge", which is a command for reading or writing data and automatically pre-charging upon completion of the data readout or write. Column address is designated in response to this command.

R: Read mode.

W: Write mode.

TABLE 2

| TIME SLOT | CHIP SELECTION (CHIP NO.) | COMMAND | BANK SELECTION (BANK NO.) | MODE | INPUT/OUTPUT DATA (CHANNEL NO.) |
|---|---|---|---|---|---|
| 0 | 0 | ACT | 0 | | |
| 1 | 0 | ACT | 1 | | |
| 2 | 0 | RDwAP | 0 | | |
| 3 | 0 | RDwAP | 0 | | |
| 4 | 1 | | | R | 0 |
| 5 | 1 | ACT | 0 | R | 1 |
| 6 | 1 | | | | |
| 7 | 1 | RDwAP | | | |
| 8 | 0 | ACT | 0 | | |
| 9 | 0 | ACT | 1 | R | METRONOME (1ST TICK) |
| 10 | 0 | RDwAP | 0 | | |
| 11 | 0 | RDwAP | 1 | | |
| 12 | 1 | | | R | 2 |
| 13 | 1 | ACT | 3 | R | 3 |
| 14 | 1 | | | | |
| 15 | 1 | RDwAP | 3 | | |
| 16 | 0 | ACT | 0 | | |
| 17 | 0 | ACT | 1 | R | METRONOME (2ND & SUBSEQUENT TICKS) |
| 18 | 0 | RDwAP | 0 | | |
| 19 | 0 | RDwAP | 1 | | |
| 20 | 1 | | | R | 4 |
| 21 | 1 | | | R | 5 |
| 22 | 1 | | | | |
| 23 | 1 | | | | |
| 24 | 0 | ACT | 0 | | |
| 25 | 0 | ACT | 1 | | |
| 26 | 0 | RDwAP | 0 | | |
| 27 | 0 | RDwAP | 1 | | |
| 28 | 1 | | | R | 6 |
| 29 | 1 | | | R | 7 |
| 30 | 1 | | | | |
| 31 | 1 | | | | |
| 32 | 0 | ACT | 0 | | |
| 33 | 0 | ACT | 1 | | |
| 34 | 0 | R/WwAP | 0 | W | 8 |
| 35 | 0 | R/WwAP | 1 | W | 9 |
| 36 | 1 | | | (R | 8) |
| 37 | 1 | | | (R | 9) |
| 38 | 1 | | | | |
| 39 | 1 | | | | |
| 40 | 0 | ACT | 0 | | |
| 41 | 0 | ACT | 1 | | |
| 42 | 0 | R/WwAP | 0 | W | 10 |
| 43 | 0 | R/WwAP | 1 | W | 11 |
| 44 | 1 | | | (R | 10) |
| 45 | 1 | | | (R | 11) |
| 46 | 1 | | | | |
| 47 | 1 | | | | |
| 48 | 0 | ACT | 2 | | |
| 49 | 0 | ACT | 3 | | |
| 50 | 0 | R/WwAP | 2 | W | 12 |
| 51 | 0 | R/WwAP | 3 | W | 13 |
| 52 | 1 | | | (R | 12) |

TABLE 2-continued

| TIME SLOT | CHIP SELECTION (CHIP NO.) | COMMAND | BANK SELECTION (BANK NO.) | MODE | INPUT/OUTPUT DATA (CHANNEL NO.) |
|---|---|---|---|---|---|
| 53 | 1 | | | (R | 13) |
| 54 | 1 | | | | |
| 55 | 1 | | | | |
| 56 | 0 | ACT | 2 | | |
| 57 | 0 | ACT | 3 | | |
| 58 | 0 | R/WwAP | 2 | W | 14 |
| 59 | 0 | R/WwAP | 3 | W | 15 |
| 60 | 1 | | | (R | 14) |
| 61 | 1 | | | (R | 15) |
| 62 | 1 | | | | |
| 63 | 1 | | | | |
| 64 | 0 | ACT | 2 | | |
| 65 | 0 | ACT | 3 | | |
| 66 | 0 | WTwAP | 2 | W | 16 (MIXL UPPER WORD) |
| 67 | 0 | WTwAP | 3 | W | 17 (MIXR UPPER WORD) |
| 68 | 1 | | | | |
| 69 | 1 | ACT | 0–3 | | |
| 70 | 1 | | | | |
| 71 | 1 | RDwAP | 0–3 | | |
| 72 | 0 | ACT | 2 | | |
| 73 | 0 | ACT | 3 | R | SAMPLER 0 |
| 74 | 0 | WTwAP | 2 | W | 18 |
| 75 | 0 | WTwAP | 3 | W | 19 |
| 76 | 1 | | | | |
| 77 | 1 | ACT | 0–3 | | |
| 78 | 1 | | | | |
| 79 | 1 | RDwAP | 0–3 | | |
| 80 | 0 | ACT | 2 | | |
| 81 | 0 | ACT | 3 | R | SAMPLER 1 |
| 82 | 0 | WTwAP | 2 | W | 20 |
| 83 | 0 | WTwAP | 3 | W | 21 |
| 84 | 1 | | | | |
| 85 | 1 | ACT | 0–3 | | |
| 86 | 1 | | | | |
| 87 | 1 | RDwAP | 0–3 | | |
| 88 | 0 | ACT | 2 | | |
| 89 | 0 | ACT | 3 | R | SAMPLER 2 |
| 90 | 0 | WTwAP | 2 | W | 22 |
| 91 | 0 | WTwAP | 3 | W | 23 |
| 92 | 1 | | | | |
| 93 | 1 | ACT | 0–3 | | |
| 94 | 1 | | | | |
| 95 | 1 | RDwAP | 0–3 | | |
| 96 | 0 | ACT | 2 | | |
| 97 | 0 | ACT | 3 | R | SAMPLER 3 |
| 98 | 0 | {WTwAP | 2 | W | 16 (MIXL LOWER WORD) } |
| 99 | 0 | {WTwAP | 3 | W | 17 (MIXR LOWER WORD)} |
| 100 | 1 | | | | |
| 101 | 1 | ACT | 0–3 | | |
| 102 | 1 | | | | |
| 103 | 1 | RDwAP | 0–3 | | |
| 104 | 0 | | | | |
| 105 | 0 | ACT | 3 | R | SAMPLER 4 |
| 106 | 0 | | | | |
| 107 | 0 | | | | |
| 108 | 1 | | | | |
| 109 | 1 | ACT | 0–3 | | |
| 110 | 1 | | | | |
| 111 | 1 | RDwAP | 0–3 | | |
| 112 | 0 | | | | |
| 113 | 0 | | | R | SAMPLER 5 |
| 114 | 0 | | | | |
| 115 | 0 | | | | |
| 116 | 1 | | | | |
| 117 | 1 | ACT | 0–3 | | |

TABLE 2-continued

| TIME SLOT | CHIP SELECTION (CHIP NO.) | COMMAND | BANK SELECTION (BANK NO.) | MODE | INPUT/OUTPUT DATA (CHANNEL NO.) |
|---|---|---|---|---|---|
| 118 | 1 | | | | |
| 119 | 1 | RDwAP | 0–3 | | |
| 120 | 0 | | | | |
| 121 | 0 | | | R | SAMPLER 6 |
| 122 | 0 | | | | |
| 123 | 0 | | | | |
| 124 | 1 | | | | |
| 125 | 1 | ACT | 0–3 | | |
| 126 | 1 | | | | |
| 127 | 1 | RDwAP | 0–3 | | |
| 128 | 0 | | | | |
| 129 | 0 | | | R | SAMPLER 7 |

Figure 12:
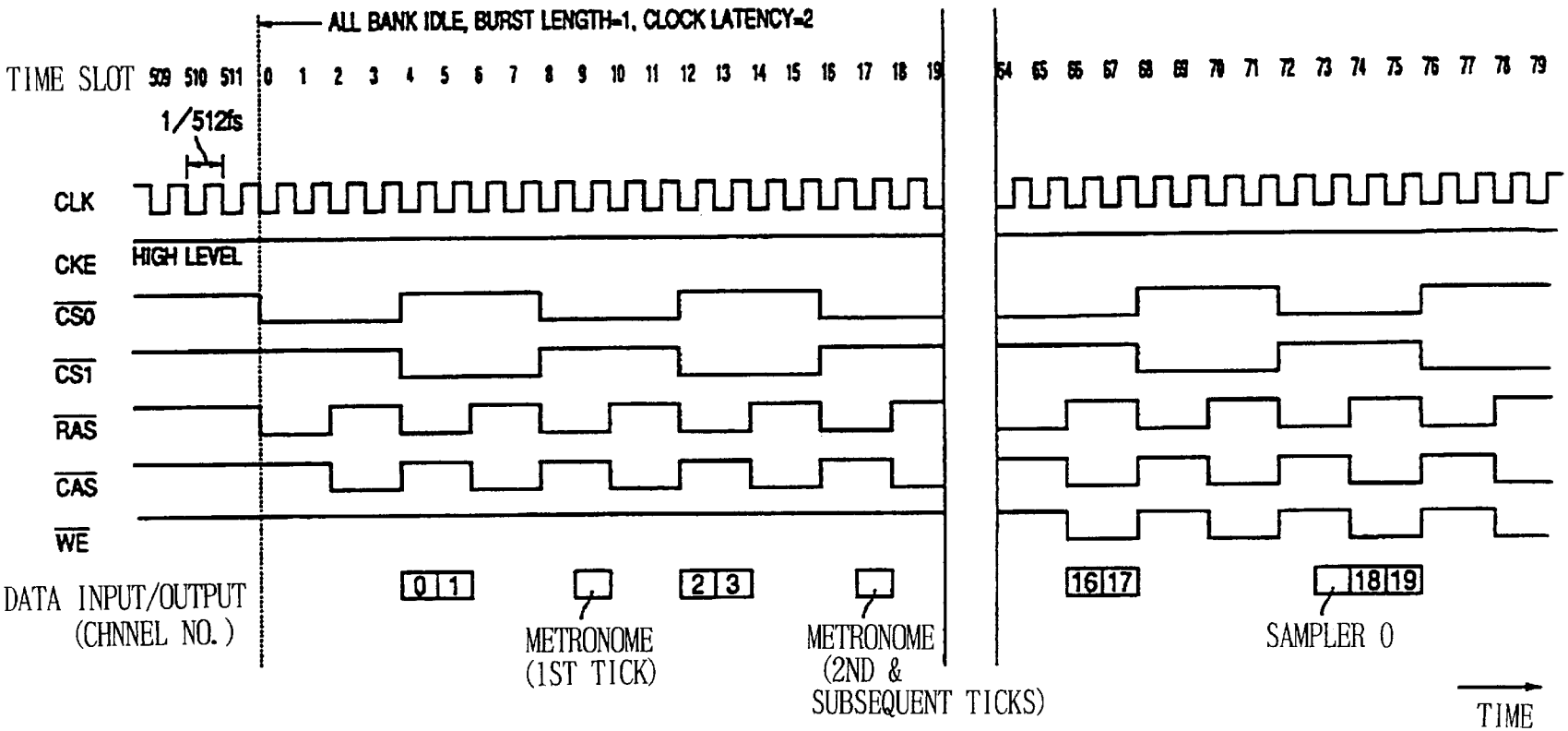
FIG. 12 is a time chart of control signals for controlling the SDRAMs when a sequence of Table 2 is to be executed.

In Table 2 above, of performance channels 0–23, channels 0–7 are set as reproduction-only channels, channels 8–15 as recording/reproduction channels, and channels 16–23 as recording-only channels. Note that channels 8–15 can be used as recording channels only in the recording-only (ALL REC) mode, and can be used only as reproduction channels in the simultaneous recording and reproduction (SYNC DUBBING) mode. In Table 2, there are parentheses, output timings of sample data from channels 8–15 when channels 8–15 are set in a readout mode. Further, in Table 2, data of sampler 7, instructed to read out the data in the 127th time slot, is output in the 129th time slot immediately after the rear end of time section A (i.e., after the recorder CPU 14 has surrendered to bus-use right); however, because the recorder CPU 14 is not involved in the output of the data, the data output can be done without any inconveniences. If a mix-down operation is to be executed, a track of a performance part as a mix-down source (i.e., mix-down-from performance part) is assigned with channels 0–15 set as reproduction channels and channels 16 and 17 are assigned as mix-down destination recording channels MIXL and MIXR (a pair of left and right mix-down-to recording channels), so that tones reproduced via channels 0–15 are mixed down to the left and right channels MIXL and MIXR by means of the DSP 38 and recorded onto the HDD 60 by way of channels 16 and 17. The mixed-down signals of the left and right channels are reproduced by being allocated to any desired ones of reproduction-only channels 0–15. Because the mixed-down signals MIXL and MIXR are each made up of 24 bits, each of the signals MIXL and MIXR is transmitted after being divided into upper and lower words. FIG. 12 is a time chart of control signals for controlling the SDRAMs 64 and 66 when the sequence of Table 2 is to be executed.

In Table 3 below, there is shown an example of assignment of the channels to the banks, in the SDRAMs 64 and 66 constituting the buffer memory, for normal recording/reproduction.

TABLE 3

| Chip No. | Bank No. | Assigned Channel No. |
|---|---|---|
| 0 | 0 | 0, 2, 4, 6, 8, 10 |
| 0 | 1 | 1, 3, 5, 7, 9, 11 |
| 0 | 2 | 12, 14, 16, 18, 20, 22 |
| 0 | 3 | 13, 15, 17, 19, 21, 23 |
| 1 | 0 | 24, 26, 28, 30, 32, 34 |
| 1 | 1 | 25, 27, 29, 31, 33, 35 |

TABLE 3-continued

| Chip No. | Bank No. | Assigned Channel No. |
|---|---|---|
| 1 | 2 | 36, 38, 40, 42, 44, 46 |
| 1 | 3 | 37, 39, 41, 43, 45, 47 |

Table 4 below, there is shown an exemplary control sequence in accordance with which data of the individual channel are written and read out to and from the SDRAMs 64 and 66, sample by sample, by the DRC 68, in relation to a case where the SDRAMs 64 and 66 are each in the form of "HITACHI HM5264165-B60", the channels are assigned to the banks of the SDRAMs 64 and 66 as shown in Table 3 above and the data of each channel are written to or read out from the SDRAM 64 or 66 within the first quarter (0th to 127th time slots) of each sampling period (a total of 512 time slots). In Table 4, there are used the same alphabetical marks as in Table 2 above.

TABLE 4

| TIME SLOT | CHIP SELECTION (CHIP NO.) | COMMAND | BANK SELECTION (BANK NO.) | MODE | INPUT/OUTPUT DATA (CHANNEL NO.) |
|---|---|---|---|---|---|
| 0 | 0 | ACT | 0 | | |
| 1 | 0 | ACT | 1 | | |
| 2 | 0 | RDwAP | 0 | | |
| 3 | 0 | RDwAP | 1 | | |
| 4 | 1 | ACT | 0 | R | 0 |
| 5 | 1 | ACT | 1 | R | 1 |
| 6 | 1 | RDwAP | 0 | | |
| 7 | 1 | RDwAP | 1 | | |
| 8 | 0 | ACT | 0 | R | 24 |
| 9 | 0 | ACT | 1 | R | 25 |
| 10 | 0 | RDwAP | 0 | | |
| 11 | 0 | RDwAP | 1 | | |
| 12 | 1 | ACT | 0 | R | 2 |
| 13 | 1 | ACT | 1 | R | 3 |
| 14 | 1 | RDwAP | 0 | | |
| 15 | 1 | RDwAP | 1 | | |
| 16 | 0 | ACT | 0 | R | 26 |
| 17 | 0 | ACT | 1 | R | 27 |
| 18 | 0 | RDwAP | 0 | | |
| 19 | 0 | RDwAP | 1 | | |
| 20 | 1 | ACT | 0 | R | 4 |
| 21 | 1 | ACT | 1 | R | 5 |
| 22 | 1 | RDwAP | 0 | | |
| 23 | 1 | RDwAP | 1 | | |
| 24 | 0 | ACT | 0 | R | 28 |
| 25 | 0 | ACT | 1 | R | 29 |
| 26 | 0 | RDwAP | 0 | | |
| 27 | 0 | RDwAP | 1 | | |
| 28 | 1 | ACT | 0 | R | 6 |
| 29 | 1 | ACT | 1 | R | 7 |
| 30 | 1 | RDwAP | 0 | | |
| 31 | 1 | RDWAP | 1 | | |
| 32 | 0 | ACT | 0 | R | 30 |
| 33 | 0 | ACT | 1 | R | 31 |
| 34 | 0 | R/WwAP | 0 | W | 8 |
| 35 | 0 | R/WwAP | 0 | W | 9 |
| 36 | 1 | ACT | 0 | (R | 8) |
| 37 | 1 | ACT | 1 | (R | 9) |
| 38 | 1 | R/WwAP | 0 | W | 32 |
| 39 | 1 | R/WwAP | 1 | W | 33 |
| 40 | 0 | ACT | 0 | (R | 32) |
| 41 | 0 | ACT | 1 | (R | 33) |
| 42 | 0 | R/WwAP | 0 | W | 10 |
| 43 | 0 | R/WwAP | 1 | W | 11 |
| 44 | 1 | ACT | 0 | (R | 10) |
| 45 | 1 | ACT | 1 | (R | 11) |
| 46 | 1 | R/WwAP | 0 | W | 34 |
| 47 | 1 | R/WwAP | 1 | W | 35 |

TABLE 4-continued

| TIME SLOT | CHIP SELECTION (CHIP NO.) | COMMAND | BANK SELECTION (BANK NO.) | MODE | INPUT/OUTPUT DATA (CHANNEL NO.) |
|---|---|---|---|---|---|
| 48 | 0 | ACT | 2 | (R | 34) |
| 49 | 0 | ACT | 3 | (R | 35) |
| 50 | 0 | R/WwAP | 2 | W | 12 |
| 51 | 0 | R/WwAP | 3 | W | 13 |
| 52 | 1 | ACT | 2 | (R | 12) |
| 53 | 1 | ACT | 3 | (R | 13) |
| 54 | 1 | R/WwAP | 2 | W | 36 |
| 55 | 1 | R/WwAP | 3 | W | 37 |
| 56 | 0 | ACT | 2 | (R | 36) |
| 57 | 0 | ACT | 3 | (R | 37) |
| 58 | 0 | R/WwAP | 2 | W | 14 |
| 59 | 0 | R/WwAP | 3 | W | 15 |
| 60 | 1 | ACT | 2 | (R | 14) |
| 61 | 1 | ACT | 3 | (R | 15) |
| 62 | 1 | R/WwAP | 2 | W | 38 |
| 63 | 1 | R/WwAP | 3 | W | 39 |
| 64 | 0 | ACT | 2 | (R | 38) |
| 65 | 0 | ACT | 3 | (R | 39) |
| 66 | 0 | R/WwAP | 2 | W | 16 |
| 67 | 0 | R/WwAP | 3 | W | 17 |
| 68 | 1 | ACT | 2 | | |
| 69 | 1 | ACT | 3 | | |
| 70 | 1 | WTwAP | 2 | W | 40 |
| 71 | 1 | WTwAP | 3 | W | 41 |
| 72 | 0 | ACT | 2 | | |
| 73 | 0 | ACT | 3 | | |
| 74 | 0 | WTwAP | 2 | W | 18 |
| 75 | 0 | WTwAP | 3 | W | 19 |
| 76 | 1 | ACT | 2 | | |
| 77 | 1 | ACT | 3 | | |
| 78 | 1 | WTwAP | 2 | W | 42 |
| 79 | 1 | WTwAP | 3 | W | 43 |
| 80 | 0 | ACT | 2 | | |
| 81 | 0 | ACT | 3 | | |
| 82 | 0 | WTwAP | 2 | W | 20 |
| 83 | 0 | WTwAP | 3 | W | 21 |
| 84 | 1 | ACT | 2 | | |
| 85 | 1 | ACT | 3 | | |
| 86 | 1 | WTwAP | 2 | W | 44 |
| 87 | 1 | WTwAP | 3 | W | 45 |
| 88 | 0 | ACT | 2 | | |
| 89 | 0 | ACT | 3 | | |
| 90 | 0 | WTwAP | 2 | W | 22 |
| 91 | 0 | WTwAP | 3 | W | 23 |
| 92 | 1 | ACT | 2 | | |
| 93 | 1 | ACT | 3 | | |
| 94 | 1 | WTwAP | 2 | W | 46 |
| 95 | 1 | WTwAP | 3 | W | 47 |

Figure 24:
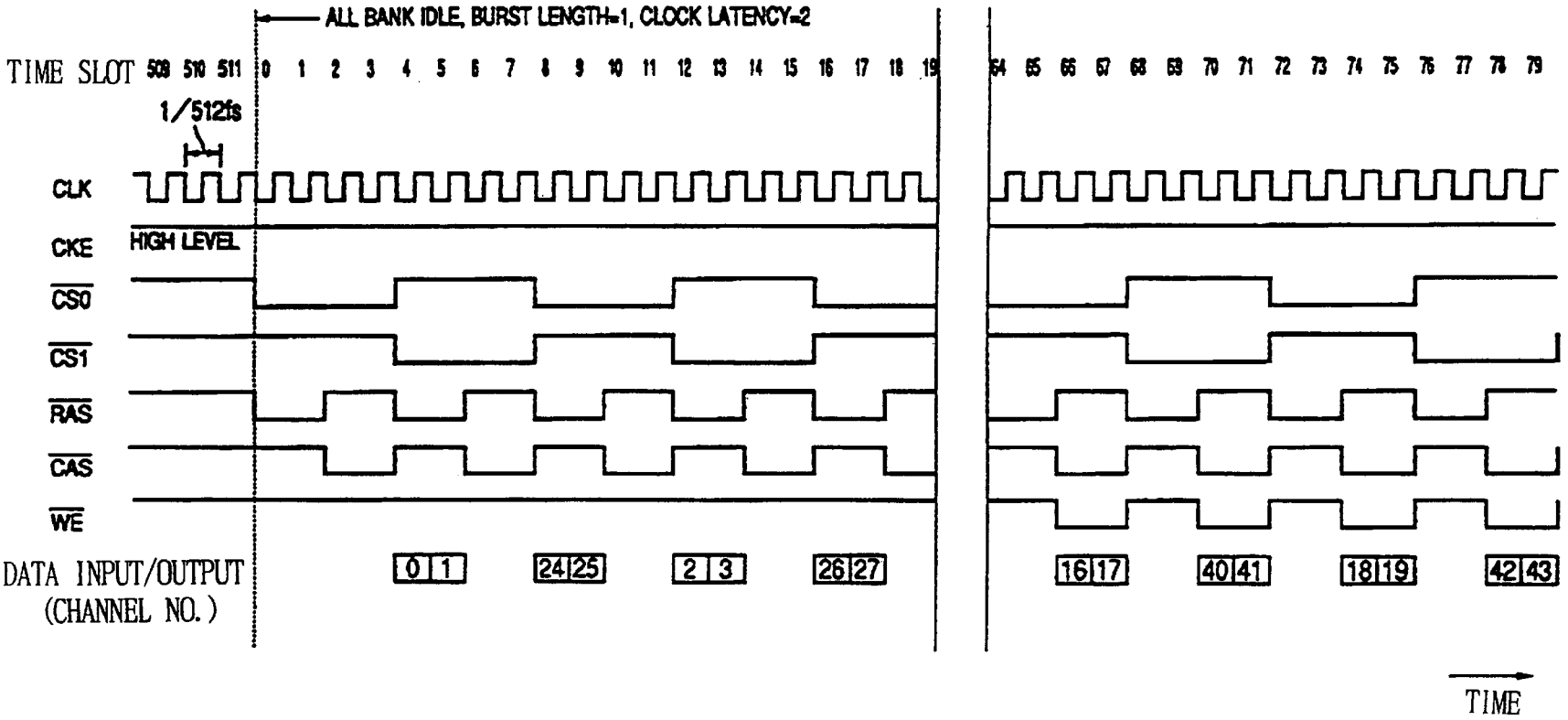
FIG. 24 is a time chart showing control signals to the SDRAMs when a sequence of Table 4 is to be executed.

In Table 4 above, of channels 0–47, channels 0–7 and 24–31 are set as reproduction-only channels, channels 8–15 and 32–39 as recording/reproduction channels, and channels 16–23 and 40–47 as recording-only channels. FIG. 24 is a time chart of control signals for controlling the SDRAMs 64 and 66 when the sequence of Table 4 is to be executed.

In Table 5 below, there is shown an example of assignment of the channels to banks in the SDRAMs 64 and 66, constituting the buffer memory, for punch-in/punch-out operations in the recording/reproduction mode.

TABLE 5

| Chip No. | Bank No. | Assigned Channel No. or Name |
|---|---|---|
| 0 | 0 | 0, 2, 4 |
| 0 | 1 | 1, 3, 5 |
| 0 | 2 | 6, 8, 10 |
| 0 | 3 | 7, 9, 11 |
| 1 | 0 | 12, 14, 16 |
| 1 | 1 | 13, 15, 17 |
| 1 | 2 | 18, 20, 22 Metronome (1st Tick) |
| 1 | 3 | 19, 21, 23 Metronome (2nd and subsequent Ticks) |

Figure 2:
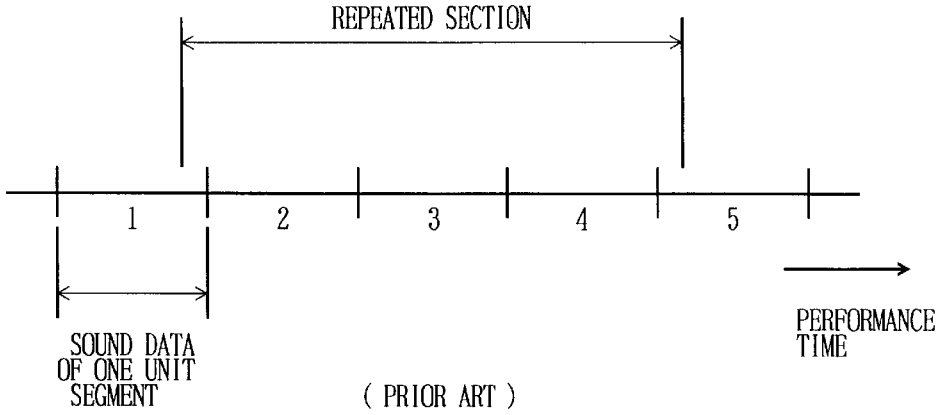
FIG. 2 is a diagram explanatory of a manner in which repetitive reproduction of a designated performance section is carried out by a conventionally-known hard disk recorder.
Figure 13:
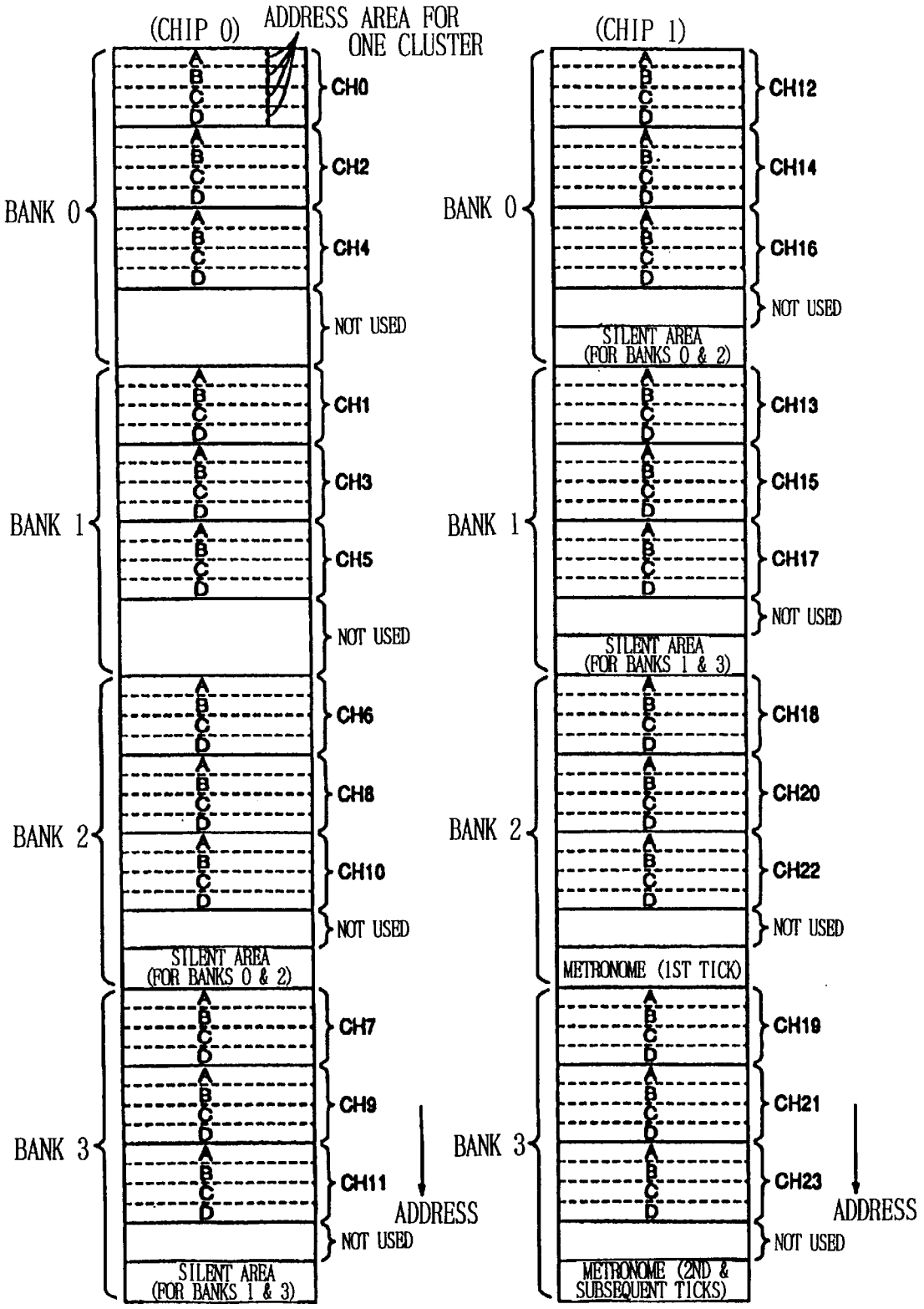
FIG. 13 is a diagram showing an example of an address map of the SDRAMs for punch-in/punch-out operations.

FIG. 13 is a diagram showing an example of an address map of the SDRAMs 64 and 66 which corresponds to the channel assignment of Table 5. For the punch-in/punch-out operations, four successive address areas A to D for a total of four clusters (each address area for one cluster), twice as many as those for the normal recording/reproduction, are allocated to each of performance channels 0–23, in order to automatically repeat a repetition section appropriately set to include the punch-in/punch-out section. In chip 0, a silent area for the channels assigned to banks 0 and 2 is allocated immediately following the rear end of bank 2 of chip 0, and a silent area for the channels assigned to banks 1 and 3 of chip 0 is allocated immediately following the rear end of bank 3. In chip 1, a silent area for the channels assigned to banks 0 and 2 of chip 1 is allocated immediately following the rear end of bank 0, and a silent area for the channels assigned to banks 1 and 3 of chip 1 is allocated immediately following the rear end of bank 1. Each of the silent areas has a size equal to about one or two clusters, in which silent data is inserted and held upon activation of the punch-in/punch-out mode. Further, an area of an appropriate size (about the size of one cluster) is allocated immediately following the rear end of bank 2 of chip 1 for the first metronome tick, and another area of an appropriate size (about the size of one cluster) is also allocated immediately following the rear end of bank 3 of chip 1 for the second and subsequent metronome ticks. Upon activation of the punch-in/punch-out mode, the sound data of the first metronome tick and sound data of the second and subsequent metronome ticks, read out from the flash ROM 58 (FIG. 3), are held in the respective metronome areas. No sampler area is allocated here because no sampler is used in the punch-in/punch-out mode. Control sequence of the SDRAMs 64 and 66 performed by the DRC 68 in the punch-in/punch-out mode in the case where the channels are assigned to the banks of the SDRAMs 64 and 66 in the manner as shown in FIG. 13 may be similar to that of Table 2 above, except that the control sequence pertaining to the sampler and mix-down operation of FIG. 2 is excluded in the punch-in/punch-out mode.

Figure 14:
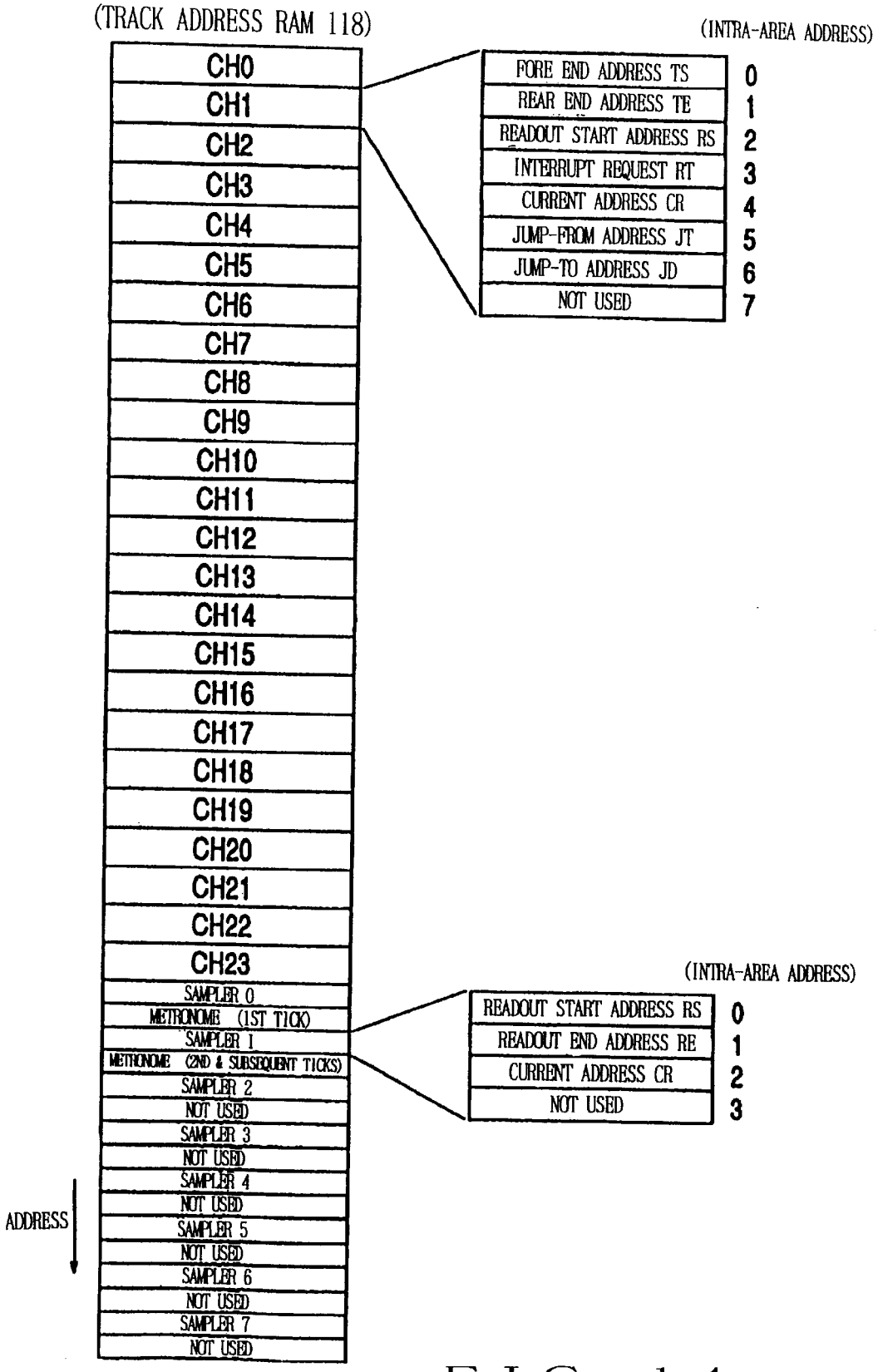
FIG. 14 is a diagram showing an example of an address map of a track address RAM of FIG. 1.

Further, the following paragraphs describe address control performed on the SDRAMs 64 and 66 in the case where the channel assignment in the SDRAMs 64 and 66 is set in the manner as shown in FIG. 11 for the normal recording/reproduction but set in the manner as shown in FIG. 13 for the punch-in/punch-out operations. In FIG. 1, there is shown an exemplary general setup of the track address generator 100 of FIG. 10. In FIG. 1, a track address RAM 118 stores therein, for each of the channels, address information (current address) of the SDRAM 64 or 66 where data are to be read out or written in the current sampling period. The track address RAM 118 also stores therein various address information, in a sequentially updating fashion, of the SDRAM 64 or 66 which is necessary for calculating an address of the SDRAM 64 or 66 where data are to be read out or written in a current sampling period; the address information of the SDRAMs 64 and 66 thus stored in the track address RAM 118 will hereinafter be called "address parameters". In FIG. 14, there is shown an example of an address map of the track address RAM 118. As shown, the track address RAM 118 includes areas for performance channels 0–23, samplers 0–7, first metronome tick and second and subsequent metronome ticks. Each of the areas for performance channels 0–23 is made up of eight intr-area addresses, each of which retains address parameter data for one word.

(1) Intra-area address 0 (address for storing an area's leading or fore end address (TS)): Address for storing the fore end address of the SDRAM 64 or 66 which is allocated to the channel in question, i.e. the leading address of an A memory area in the address map of FIG. 11 or 13.

(2) Intra-area address 1 (address for storing an area trailing or rear end address (TE)): Address for storing the rear end address of the SDRAM 64 or 66 which is allocated to the channel in question, i.e. the rear end address of the B memory area of FIG. 11 in the case of the normal recording/reproduction, or the rear end address of the D memory area of FIG. 13 in the case of the punch-in/punch-out operations.

(3) Intra-area address 2 (address for storing a readout start address (RS)): Address for storing an address at which data readout from an address area of the SDRAM 64 or 66 allocated to the channel in question should begin. Because the sound data of the first cluster read out from the HDD 60 at the beginning of reproduction are stored in the A memory area, the leading address (area fore end address (TS)) of the A memory area, in normal cases, may be set as the readout start address RS so that the data readout starts at the area fore end address TS. However, with a special file, data other than music data, such as sampling frequency data, is sometimes written at the beginning of the music piece. If such data other than music data is not to be reproduced, then an address at which the music piece data exactly begins may be set as the readout start address RS.

(4) Intra-area address 3 (address for storing an interrupt request generation address (RT): Address for storing an address of the SDRAM 64 or 66 at which an interrupt request for DMA transfer of the sound data of the channel in question should be issued to the recorder CPU 14. The interrupt request is issued each time the write or read address for the SDRAM 64 or 66 reaches the interrupt request generation address. In the case of the normal recording/reproduction, the interrupt request generation address is set at the rear end address of each of the A memory area and B memory area (FIG. 11) in each of performance channels 0–23, so that the interrupt request is issued each time one cluster of the sound data has been written or read out. In the case where the silent area is to be reproduced or where an appropriately-set area is to be reproduced repetitively for punch-in/punch-out or the like, the interrupt request generation address RT is set at another suitable address than the rear end address of each of the A and B memory areas (FIG. 11) for each of performance channels 0–23, as will be later described.

(5) Intra-area address 4 (address for storing a current address (CR): Address for storing an address of the SDRAM 64 or 66 at which data should be written or read out in the current sampling period. Normally, the current address is incremented by one every sampling period.

(6) Intra-area address 5 (address for storing a jump-from address (JT): Address for storing an address of the SDRAM 64 or 66 from which data readout should jump. The jump-from address is set by the recorder CPU 14 calculating, with reference to the current address (CR), an address of the SDRAM 64 or 66 where an address pointer should reach at a jump start time designated by the song management data or by the human operator.

(7) Intra-area address 6 (address for storing a jump-to address (JD): Address for storing an address of the SDRAM 64 or 66 to which data readout should jump. The jump-to address is set by the recorder CPU 14 calculating an address of the SDRAM 64 or 66 where the sample data of a jump-to location is to be stored. Once an address immediately preceding the current address CR reaches the jump-from address JT, the address jump is effected after data is written or read out to or from the current address CR so that the data readout is resumed at the jump-to address JD in the next sampling period.

(8) Intra-area address 7: Not used.

Further, in the track address RAM 118, each of the areas for samplers 0–7, first metronome tick and second and subsequent metronome ticks is imparted with four intra-area addresses, each of which retains address parameter data for one word.

(1) Intra-area address 0 (address for storing a readout start address (RS)): Address for storing an address of the SDRAM 64 or 66 at which data readout should begin for the channel in question.

(2) Intra-area address 1 (address for storing a readout start address (RE)): Address for storing an address of the SDRAM 64 or 66 at which data readout should end for the channel in question.

(3) Intra-area address 2 (address for storing a current address (CR): Address for storing an address of the SDRAM 64 or 66 at which data should be written or read out in the current sampling period. The current address is incremented by one every sampling period for the channel in question.

(4) Intra-area address 4: Not used.

Note that for samplers 0–7, first metronome tick and second and subsequent metronome ticks, silent data is stored at the address of the SDRAM 64 or 66 designated by the readout start address RS. The address pointer for the SDRAM 64 or 66 is kept at the readout start address RS until a tone generation start is instructed. Once such a tone generation start is instructed (such as by a tone generation instruction from the human operator or from the recorder CPU 14 based on the song management data in the case of a sampler tone, or by a tone generation instruction given from the recorder CPU 14 every predetermined period corresponding to a designated tempo in the case of a metronome tone), the address pointer is incremented by one every sampling period so that a sampler tone or metronome tone is generated. Once the address pointer thus incremented reaches the readout end address RE, the tone generation is brought to an end, and then the address pointer is kept at the readout start address RS until a next tone generation start is instructed.

If the recording/reproduction mode is selected in the hard disk recorder 10, the recorder CPU 14 sends out, as address parameter data already known prior to designation of a song and previously storable in the track address RAM 118, the area fore end addresses TS and rear end addresses TE of performance channels 0–23, readout start addresses RS and readout end addresses RE of the first, second and subsequent metronome ticks and other data, along with address information of the track address RAM 118 for storing these data. The recorder CPU 14 also writes the sent-out address parameter data and address information of the track address RAM 118 into registers 120 and 122 of FIG. 1 using it own clock. The address parameter data and address information thus written in the registers 120 and 122 are read out by the DRC 68 using it own clock and then forwarded to the track address RAM 118 via selectors 124 and 126. In this way, the area fore end addresses TS and rear end addresses TE of performance channels 0–23, readout start addresses RS and readout end addresses RE of the first, second and subsequent metronome ticks and other information are written into respective allocated addresses of the track address RAM 118.

Then, once a song is designated, the recorder CPU 14, on the basis of the song management data read out from the HDD 60, sends out, the readout start address RS of any of performance channels 0–23 for which data reproduction has been instructed, first interrupt request generation address RT, readout start address RS and readout end address RE of each sampler and other data, along with address information of the track address RAM 118 for storing these data. These address information and data sent out by the recorder CPU 14 are fed to the track address RAM 118 via the registers 120 and 122 and selectors 124 and 126 and written into addresses of the track address RAM 118 designated by the address information. On the basis of the song management data, the jump-from address JT and jump-to address JD are sent out by the recorder CPU 14, immediately before the time point for making the address jump, along with address information of the track address RAM 118 for storing these data, and then retained at the corresponding addresses of the track address RAM 118 by way of the registers 120 and 122 and selectors 124 and 126. In case punch-in/punch-out operations are instructed in the recording/reproduction mode, it is necessary to modify the address areas of the SDRAMs 64 and 66 allocated to performance channels 0–23, first, second and subsequent metronome ticks in the manner as shown in FIG. 13. Thus, the area fore end addresses TS and rear end addresses TE for performance channels 0–23 are sent out by the recorder CPU 14, along with address information of the track address RAM 118 for storing these data and fed to the track address RAM 118 by way of the registers 120 and 122 and selectors 124 and 126, so that they are written into the corresponding addresses of the track address RAM 118 to thereby update the data so far stored in the addresses.

During the recording/reproduction, the recorder CPU 14 sends out, for each of performance channels 0–23 to which data reproduction has been instructed, the interrupt request generation address RT, jump-from address JT and jump-to address JD along with information of the track address RAM 118 for storing these data at an appropriate time point immediately before the time point when the interrupt or address jump is to be effected, and these addresses are written into the registers 120 and 122, respectively; note that for each channel to which data reproduction has been instructed, the recorder CPU 14 sends out only information pertaining to the interrupt request generation address RT. In every sampling period, each of the selectors 124 and 126 selects its A input at each timing of 8n+4/512 (0th–511th) divided clock pulses (n=0, 1, 2, . . . , 63), i.e. once for every eight divided clock pulses, and thereby reads out the data stored in the register 122 or 120. The track address RAM 118 is switched to a write mode every such readout timing. As a result, the address parameter data held by the register 120 are stored into the addresses of the track address RAM 118 designated by the data held by the other register 122. Thus, during the recording/reproduction, the address parameter data of the interrupt request generation address RT, jump-from address JT and jump-to address JD in the track address RAM 118 are updated with contents that are necessary on each individual occasion.

Note that after completion of the address jump, the recorder CPU 14 sends out address information indicative of addresses outside the allocated areas for the channel in question, as address parameter data of a jump-from address JT and jump-to address JD, unless there is a need to immediately effect a next address jump, and these address parameter data are stored into the corresponding addresses of the track address RAM 118. Because the sent-out address information is indicative of addresses outside the allocated areas for the channel, the incrementing address pointer will never reach the outside addresses and thus no address jump will take place in this case. When timing for a next address jump approaches, the recorder CPU 14 sends out address parameter data of a jump-from address JT and jump-to address JD to effect the next address jump, and these address parameter data are stored into the corresponding addresses of the track address RAM 118. During the time that DMA transfer is being carried out, the data writing to the registers 120 and 122 is performed only in the first quarter (from the onset) of the sampling period when the recorder CPU 14 is given the bus-use right, the recorder CPU 14, whenever necessary, can write, into the registers 120 and 122, address parameter data of the track address RAM 118 for updating the previous address parameter data and address information of the track address RAM 118 for storing the address parameter data, using only the first quarter of the sampling period, without a delay. As will be later described in detail, each value arithmetically determined by an address calculation circuit 134 of FIG. 1 is stored into the current-address (CR) storing address for each channel in the track address RAM 118.

Further, in FIG. 1, an SDRAM read/write address generator circuit 128 generates, in accordance with the timing defined by the time slots of Table 2 above and for each of the channels for which data recording or reproduction has been instructed, information indicative of an address of the track address RAM 118 at which the current address CR is stored, in order to time-divisionally read out or write one sample of the sound data of the channel from or to the SDRAM 64 or 66 within the first quarter (from the onset) of each sampling period in the recording/reproduction mode. Calculating-address-parameter reading address generator circuit 130 time-divisionally generates, in synchronism with the 512 divided clock pulses and in accordance with predetermined timing, information of addresses of the track address RAM 118 to be used for reading out the address parameter of each channel from the track address RAM 118, in order to time-divisionally calculate, for each channel, an address of the SDRAM 64 or 66 where a next sample of the sound data of the channel is to be read from or written to within the remaining three quarters of each sampling period in the recording/reproduction mode. The address information of the track address RAM 118 thus generated by the address generator circuits 128 and 130 is passed to a selector 132, which selects the output address information from the SDRAM read/write address generator circuit 128 for the first quarter (from the onset) of each sampling period and selects the output address information from the calculating-address-parameter reading address generator circuit 130 for the remaining three quarters of each sampling period.

The address information thus selected by the selector 132 is output from the selector 124 in a time section other than the above-mentioned timing of "8n+4/512 (0th–511th) divided clock pulses (n=0, 1, 2, . . . , 63)", i.e. the "once-for-every eight-divided-clock-pulse" timing, for writing the data of the registers 120 an 122 into the track address RAM 118. The address information output from the selector 124 is fed to the address terminal of the track address RAM 118, so that the corresponding parameter data are read out from the corresponding address of the track address RAM 118. Note that data generation sequences synchronous with the 512 divided clock pulses are set in the address generator circuits 128 and 130 such that no effective data is generated from these address generator circuits 128 and 130 at the timing of writing the data of the registers 120 an 122 into the track address RAM 118. The current address CR of each channel read out from the track address RAM 118 in the first quarter (from the onset) of each sampling period is sent to the SDRAM 64 or 66 and used therein as a write or read address. The current address CR of each channel is also sent and notified to the recorder CPU 14.

Figure 15:
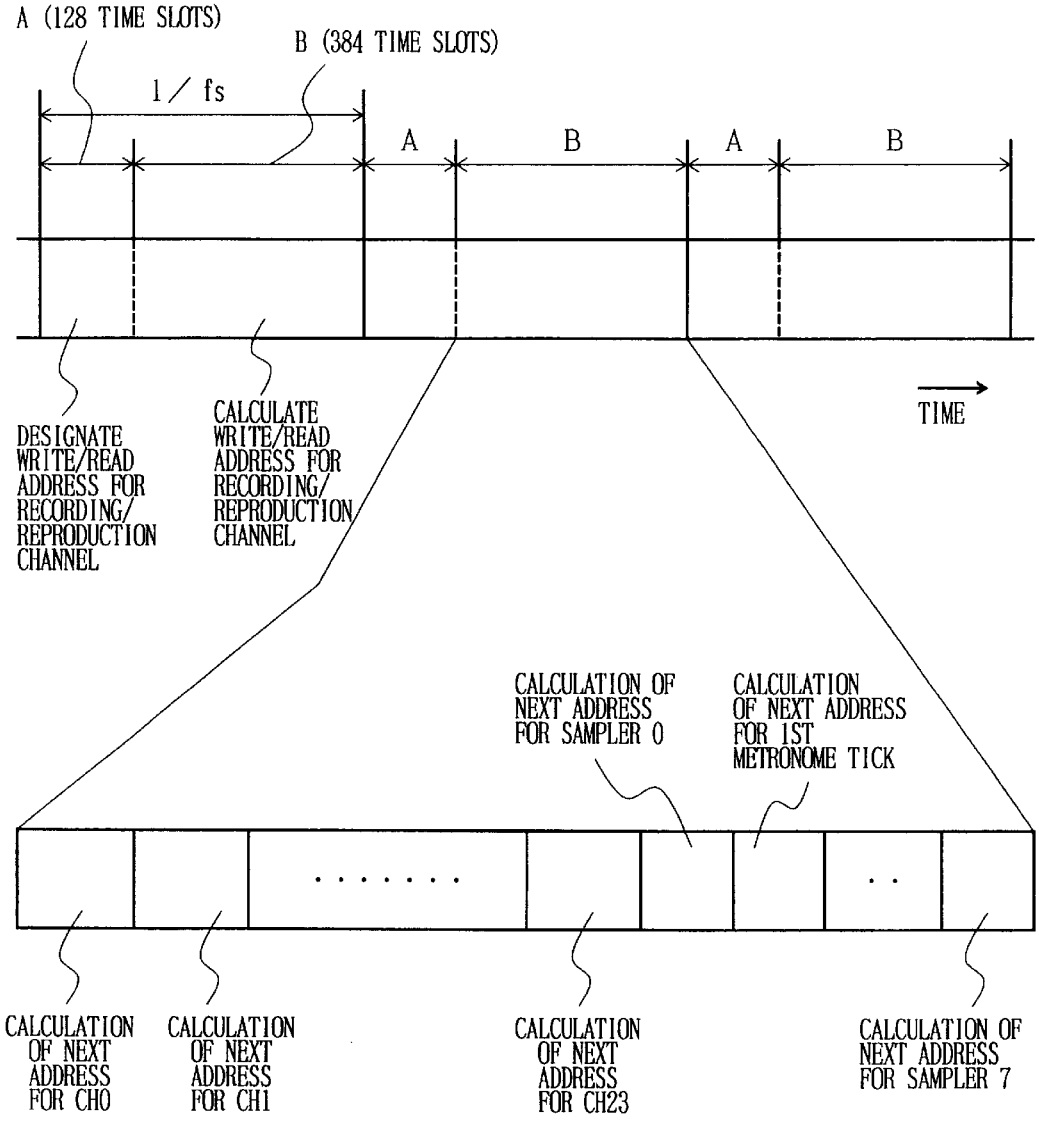
FIG. 15 is a time chart showing an exemplary manner in which an available calculating time of an address calculation circuit is shared among a plurality of channels.

On the basis of the address parameters stored in the track address RAM 118, the address calculation circuit 134 time-divisionally calculates an address of the SDRAM 64 or 66 where a next sample of the sound data of each channel is to be read out or written in the remaining three quarters of each sampling period (i.e., current address CR for a next sampling period), using the 512 divided clock pulses as its operating clock pulses. In FIG. 15, there is shown an exemplary manner in which the available calculating time of the address calculation circuit 134 is shared among the channels. The address calculation circuit 134 is exclusively used for each of performance channels 0–23, samplers 0–7, first metronome tick and second and subsequent metronome ticks in a time period allocated thereto, to thereby calculate the current address CR of the next sampling period and store the calculated current address CR into the corresponding address of the track address RAM 118. Order in which the current addresses CR of performance channels 0–23 may be the same as the order of the addresses in the track address RAM 118 such as shown in FIG. 14.

The address calculation circuit 134 of FIG. 1 may be constructed as follows. Selector 136 selects either the address parameter data of each channel, whose current address CR is being calculated, read out from the track address RAM 118 in the time section other than the timing for writing to the track address RAM 118 (i.e., other than the "once-for-every eight-divided-clock-pulse" timing), or data stored in a register 138 (B register). The data thus selected by the selector 136 is written into a register 140 (A register), from which it is transferred to the selector 126 or an ALU (Arithmetic and Logic Unit) 142. The ALU 142 performs an appropriate operation using the data stored in the A register and B register, so that in accordance with the result of the operation, various control is performed on the data writing to the A register 140, address information generation from the calculating-address-parameter reading address generator circuit 130 and interrupt request issuance for DMA transfer. The result of the operation by the ALU 142 is retained by an accumulator (ACC) 144 as necessary.

Figure 16:
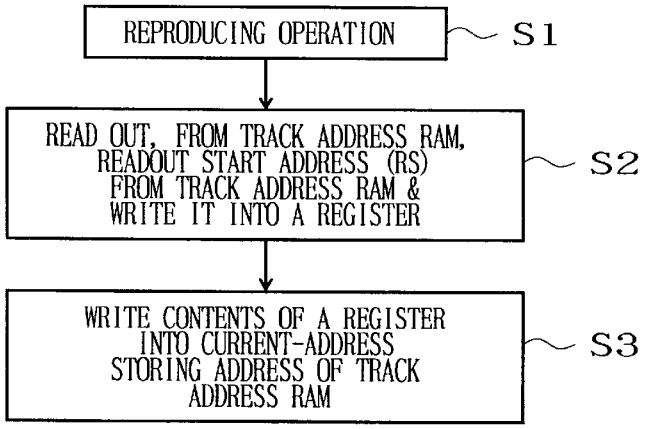
FIG. 16 is a flow chart of an address calculation process for one performance channel (or reproduction channel) which is executed by the address calculation circuit in a first sampling period after data reproduction is started up.

The following paragraphs describe exemplary procedures executed by the address calculation circuit 134 for calculating an address for one performance channel (reproduction channel). FIG. 16 is a flow chart of such an address calculation process executed by the address calculation circuit 134 in the first sampling period after data reproduction is started up in response to a user's operation instructing reproduction or simultaneous recording/reproduction. Namely, once the user or human operator has made a data-reproduction instructing operation at step S1, the read-out start address RS of the reproduction channel in question is read out from the track address RAM 118 at step S2, and then the read-out readout start address RS is stored, via the selector 136, A register and selector 126, into the track address RAM 118 at the current-address storing address thereof allocated to the reproduction channel at step S3.

Figure 17:
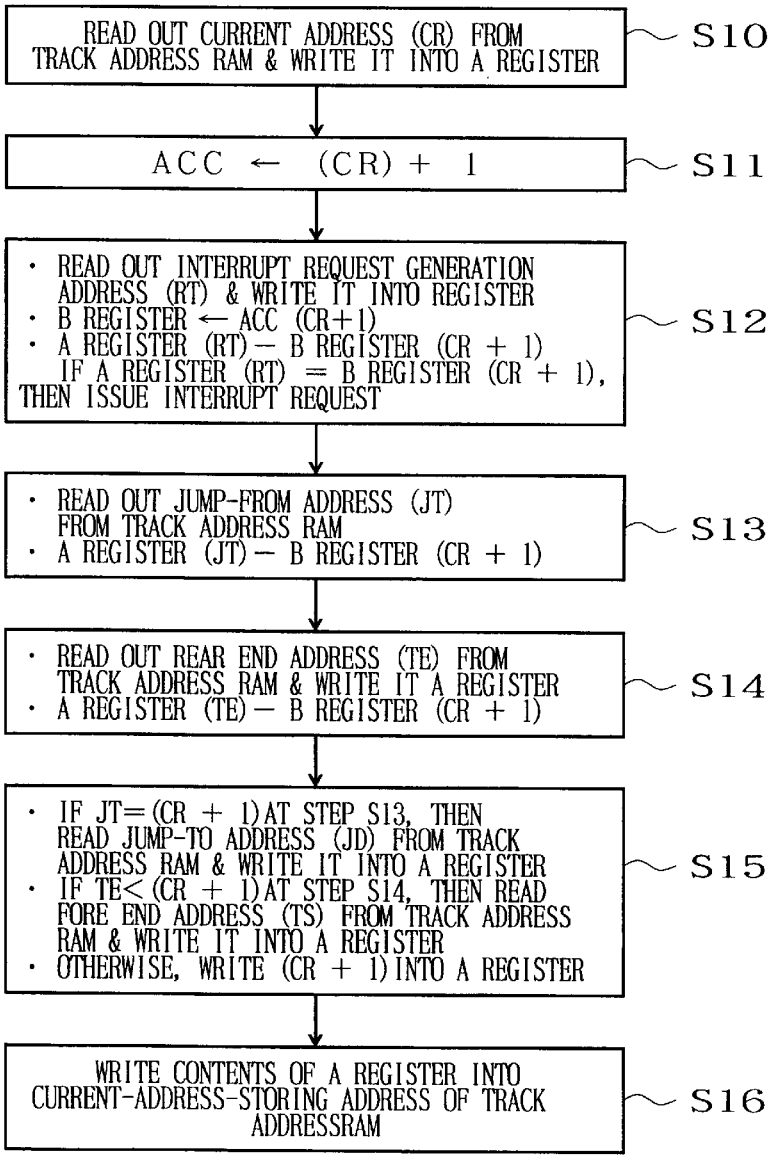
FIG. 17 is a flow chart of a calculation sequence for one performance channel (reproduction channel) that is repeated every sampling period from the second sampling period (following the first sampling period) up to a time point when an operation to terminate the reproduction is made.

FIG. 17 is a flow chart of a calculation sequence that is repeated every sampling period from the next or second sampling period up to a time point when the human operator makes an operation to terminate the reproduction. At step S10, the current address CR is read out from the track address RAM 118 and written into the A register 140. Then, at step S11, the ALU 142 adds "1" to the current address CR stored in the A register 140 so that the added result (CR+1) is stored into the accumulator (ACC) 144. Then, at step S12, the interrupt request generation address RT is read out from the track address RAM 118 and written into the A register 140, in parallel with which the data currently stored in the accumulator 144 (i.e., current address CR+1) is written into the B register 138. At the same time, the ALU 142 performs an arithmetic operation of "{data stored in the A register (interrupt request generation address RT)}−{data stored in the B register (current address CR+1)". If the data stored in the A register (interrupt request generation address RT) is equal to the data stored in the B register (current address CR+1), then an interrupt for DMA transfer is generated. Then, at step S13, the jump-from address JT is read out from the track address RAM 118 and written into the A register 140, in parallel with which the ALU 142 performs an arithmetic operation of "{data stored in the A register (jump-from address JT)}−{data stored in the B register (current address CR+1)". At next step S14, the area rear end address TE is read out from the track address RAM 118 and written into the A register 140, in parallel with which the ALU 142 performs an arithmetic operation of "{data stored in the A register (area rear end address TE)}−{data stored in the B register (current address CR +1)".

If the calculation result of step S13 indicates that {data stored in the A register (jump-from address JT)} equals {data stored in the B register (current address CR+1), then the jump-to addresses JD is read out from the track address RAM 118 and written into the A register 140. If the calculation result of step S14 indicates that {data stored in the A register (area rear end address TE)} is smaller than (<) (data stored in the B register (current address CR+1), then the area fore end address TS is read out from the track address RAM 118 and written into the A register 140. Otherwise, the data stored in the B register (current address CR+1) is written into the A register 140 at step S15. Then, the data stored in the A register 140 is written into the current-address (CR) storing address for the channel in question, at step S16. Thus, in the next sampling period, sample data writing or reading sample data will be performed to or from the address of the SDRAM 64 or 66 currently written at the current-address (CR) storing address thereof.

For each recording channel as well, a similar address calculation process is executed by the address calculation circuit 134. Namely, once the user or human operator has made an operation instructing recording or simultaneous recording/reproduction, the area fore end address TS is read out from the track address RAM 118 in the first sampling period after the start of the recording, and stored into the current-address (CR) storing address of the track address RAM 118, so that the sample data is written, in the next sampling period, into the address of the SDRAM 64 or 66 designated by the current address CR. After that, the current address CR is incremented by one every sampling period. If the thus-incremented current address CR reaches the interrupt request address, an interrupt request address for DMA transfer is issued. Then, once the thus-incremented current address CR reaches the area rear end address TE, the area fore end address TS is set as the current address CR in the next sampling period, after which the above-mentioned address circulation sequence is repeated; note that no address jump takes place in the case of the recording channel.

For each of samplers 0–7, the following operations take place. Namely, once the user or human operator has made an operation instructing reproduction or simultaneous recording/reproduction, the readout start addresses RS of the samplers are read out from the track address RAM 118 in the first sampling period after the start of the reproduction, and stored into the current-address (CR) storing address, for the channel, of the track address RAM 118 and kept stored there until the human operator makes a sampler-tone-generation instructing operation or a sampler-tone generation instruction is issued from the recorder CPU 14 on the basis of the song management data. Because the silent data is prestored at the readout start address RS of each of samplers 0–7 in the SDRAMs 64 and 66, no tone is generated in this state. Then, once the human operator instructs tone generation of any one of the samplers or sampler-tone generation instruction is issued from the recorder CPU 14 on the basis of the song management data, the current address CR is incremented, for the sampler, by one every sampling period, so that the corresponding sampler tone is generated. Once the incremented current address CR reaches the readout end address RE, the readout start address RS is held at the current-address (CR) storing address of the track address RAM 118 in the next and subsequent sampling periods, so that no tone of the sampler will be generated until the human operator makes a tone generation instructing operation for the sampler or a tone generation instruction for the sampler is issued from the recorder CPU 14 on the basis of the song management data.

For the first metronome tick and second and subsequent metronome ticks, the readout start addresses RS of the metronome ticks are read out from the track address RAM 118 in response to activation of the recording/reproduction mode and stored into the corresponding current-address (CR) storing addresses of the track address RAM 118, after which the readout start addresses RS are kept stored there until the human operator makes a metronome-sound-generation instructing operation. Because the silent data is prestored at the readout start address RS of each of the first metronome tick and second and subsequent metronome ticks, no metronome tone is generated in this situtation. Then, once the human operator instructs metronome tone generation, a metronome tone generation instruction is issued from the recorder CPU 14, and the current address CR for the first metronome tick is incremented by one every sampling period, so that the metronome tone is generated for a first beat of a measure. Once the incremented current address CR reaches the readout end address RE, the readout start address RS is held at the current-address (CR) storing address of the track address RAM 118 in the next and subsequent sampling periods, so that the metronome tone generation is terminated. Upon arrival at a second beat in the measure, a metronome tone generation instruction is issued from the recorder CPU 14, and the current address CR for the second and subsequent metronome ticks is incremented by one every sampling period, so that the metronome tone is generated for the second beat of the measure. Once the incremented current address CR reaches the readout end address RE, the readout start address RS is held at the current-address (CR) storing address of the track address RAM 118 in the next and subsequent sampling periods, and the metronome tone generation is terminated. Within the measure, the second and subsequent metronome ticks are sounded repetitively a necessary number of times corresponding to the time of the music piece in question. From the following measure onward, the first and second and subsequent metronome ticks are sounded repetitively.

Note that in a situation where the address calculation circuit 134 is unable to calculate addresses for all the channels within one sampling period due to a too-great number of the channels, a plurality of the above-mentioned track address RAMs 118 and address calculation circuits 134 may be provided in parallel so that the address calculation for the channels can be performed dividedly by the plurality of the track address RAMs 118 and address calculation circuits 134, or the operating clock frequency for the address calculation circuit 134 may be increased to raise the calculating speed.

Figure 18:
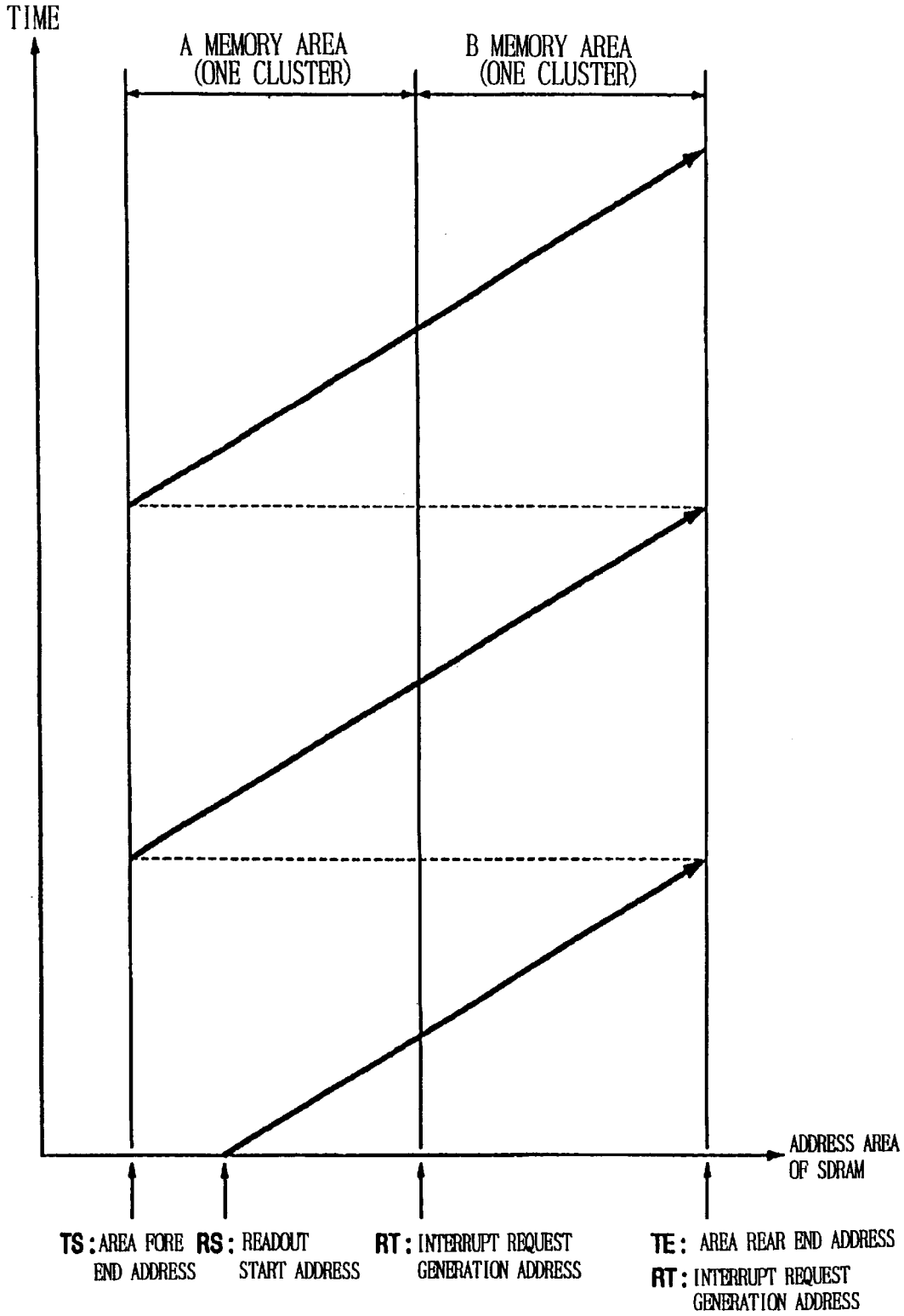
FIG. 18 is a diagram showing exemplary movement of an address pointer for the SDRAM during normal recording/reproduction of one performance channel (reproduction channel)

Now, a description will be made about address control of the SDRAMs 64 and 66 which is performed by the track address generator 100. FIG. 18 is a diagram showing exemplary movement of the address pointer for the SDRAM 64 or 66 during normal recording/reproduction of one reproduction channel. In the illustrated example of FIG. 18, no address jump takes place. To the reproduction channel, there are allocated memory spaces (A and B memory areas) of the SDRAM 64 or 66 for storing two successive clusters of the sound data. The address pointer pointing to the current address CR is incremented by one every sampling period. The area fore end address TS is set at the head of the A memory area, while the area rear end address TE is set at the end of the B memory area. Further, in this illustrated example, the readout start address RS is set at a separate address from the area fore end address TS. The interrupt request generation address RT is alternately set at the rear end address of one of the A memory area and the B memory area where the address pointer is located.

Once the user or human operator has made an operation instructing reproduction or simultaneous recording/reproduction of a selected song, the first cluster of the sound data of each reproduction channel is read out from the HDD 60 and DMA-transferred to the SDRAM 64 or 66 for storage into the A memory area thereof allocated to that channel. Then, as the address pointer is incremented from the readout start address RS by one every sampling period, the corresponding sound data are read out and audibly reproduced from the SDRAM 64 or 66. During the movement of the address pointer in the A memory area, the next cluster of the sound data is read out from the HDD 60 and stored into the B memory area thereof. Also, during the movement of the address pointer in the A memory area, the interrupt request generation address RT is set at the rear end address of the A memory area. In the course of the movement of the address pointer in the A memory area, the sound data writing into the B memory area through the DMA transfer is completed. Then, once the address pointer reaches the rear end address of the A memory area, an interrupt request is issued, which is transmitted to the recorder CPU 14 so that the DMA transfer is initiated again and thus a still next cluster of the sound data is read out from the HDD 60 and DMA-transferred for storage into the A memory area. Even after arrival at the rear end address of the A memory area, the address pointer is incremented, from the fore end address of the B memory area, by one every sampling period, so that the sound data continue to be audibly reproduced with no break. Once the address pointer enters the B memory area, the interrupt request generation address RT is shifted to the rear end address of the B memory area. In the course of the movement of the address pointer in the B memory area, the sound data writing into the A memory area through the DMA transfer is completed. Then, once the address pointer reaches the rear end address of the B memory area, the address pointer is moved, in a next sampling period, back to the fore end address of the A memory area and then incremented by one every sampling period, so that the sound data continue to be audibly reproduced with no break. In the course of the movement of the address pointer in the A memory area, the sound data writing into the B memory area through the DMA transfer is carried out. During the movement of the address pointer in the A memory area, the interrupt request generation address RT is set at the rear end address of the A memory area. In this way, until termination of the reproduction is instructed, the address pointer repeats its movement from the fore end of the A memory area to the rear end of the B memory area.

For each performance channel for which data recording has been instructed, the following operations take place. Namely, once the user or human operator has made an operation instructing recording or simultaneous recording/reproduction, the write address pointer is incremented, from the area fore end address TS, by one every sampling period, so that input sound data are stored, sample by sample, into the A memory area. At this point, the interrupt request generation address RT is set at the rear end address of the A memory area. Then, once the write address pointer reaches the interrupt request generation address RT, an interrupt request is issued, so that DMA transfer is initiated to cause one cluster of the sound data accumulated in the A memory area to be DMA-transferred to and recorded onto the HDD 60. Even after arrival at the rear end address of the A memory area, the write address pointer continues to be incremented, from the fore end address of the B memory area, by one every sampling period, so that input sound data continue to be stored into the B memory area. At this point, the interrupt request generation address RT is set at the rear end address of the B memory area. Then, once the write address pointer reaches the interrupt request generation address RT at the rear end address of the B memory area, an interrupt request is issued, so that DMA transfer is initiated to cause one cluster of the sound data accumulated in the B memory area to be DMA-transferred to and recorded onto the HDD 60. Then, the write address pointer is moved back to the fore end address of the A memory area and again continues to be incremented by one every sampling period. Until termination of the recording or simultaneous recording/reproduction is instructed, the above-mentioned operations are repeated to allow the input sound data to be recorded onto the HDD 60 one by one.

Figure 19:
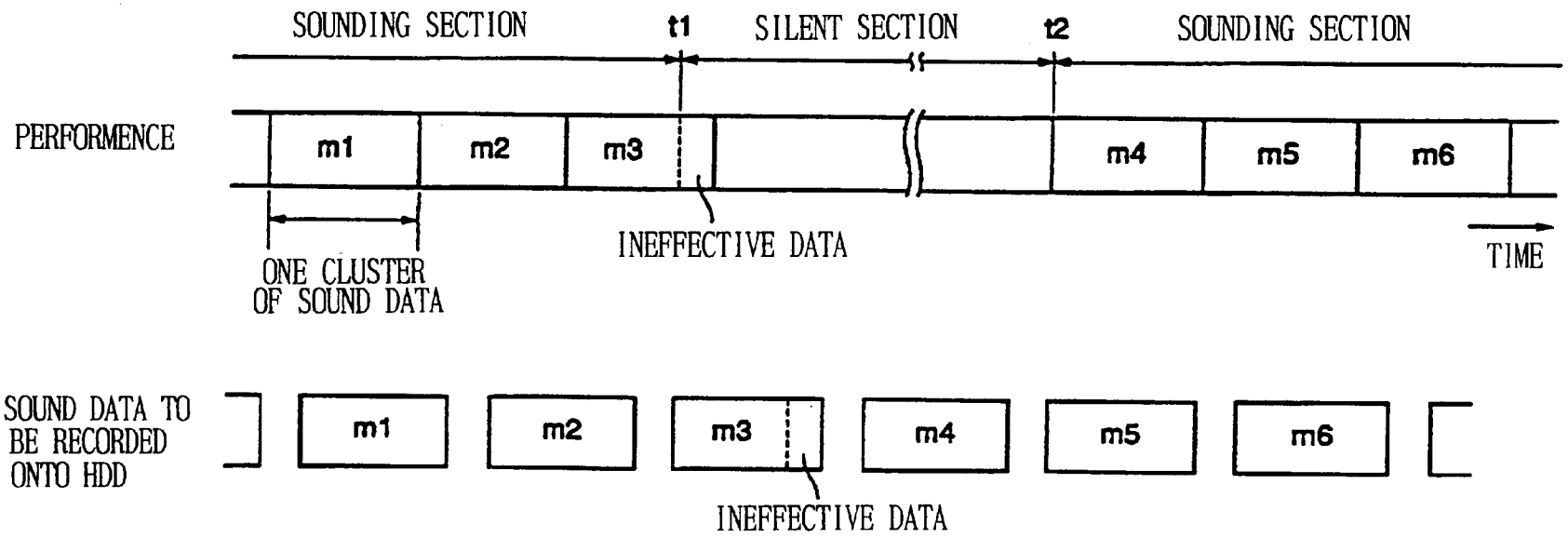
FIG. 19 is a diagram explanatory of an exemplary performance having a silent section set therein and also showing data of performance tones recorded on the HDD.

Address control is performed as follows in a case where sound data are recorded with insertion of a silent area. Let it be assumed here that the silent area is, as shown in FIG. 19, set for a given performance channel between time points t1 and t2 (each representing an elapsed time from the beginning of the recording). Reference numerals "m1"–"m6" each represent one cluster of the sound data recorded on the HDD 60. Once a start of the silent area is instructed at time point t1 in the course of the recording, suspension of the recording is instructed at that time point so that after the effective sound data cluster m3 created till immediately prior to the suspension instruction are recorded onto the HDD 60, the sound data recording onto the HDD 60 for the given performance channel is suspended—after time point t1, ineffective sound data are created. Then, when termination of the silent area is instructed, the recording is resumed so that the effective sound data m4, m5, . . . are created cluster by cluster and recorded onto the HDD 60. Then, once the human operator makes operations for terminating the recording and preserving the data, information indicating that the silent area intervenes between time points t1 and t2 is recorded into the song management data.

Figure 20:
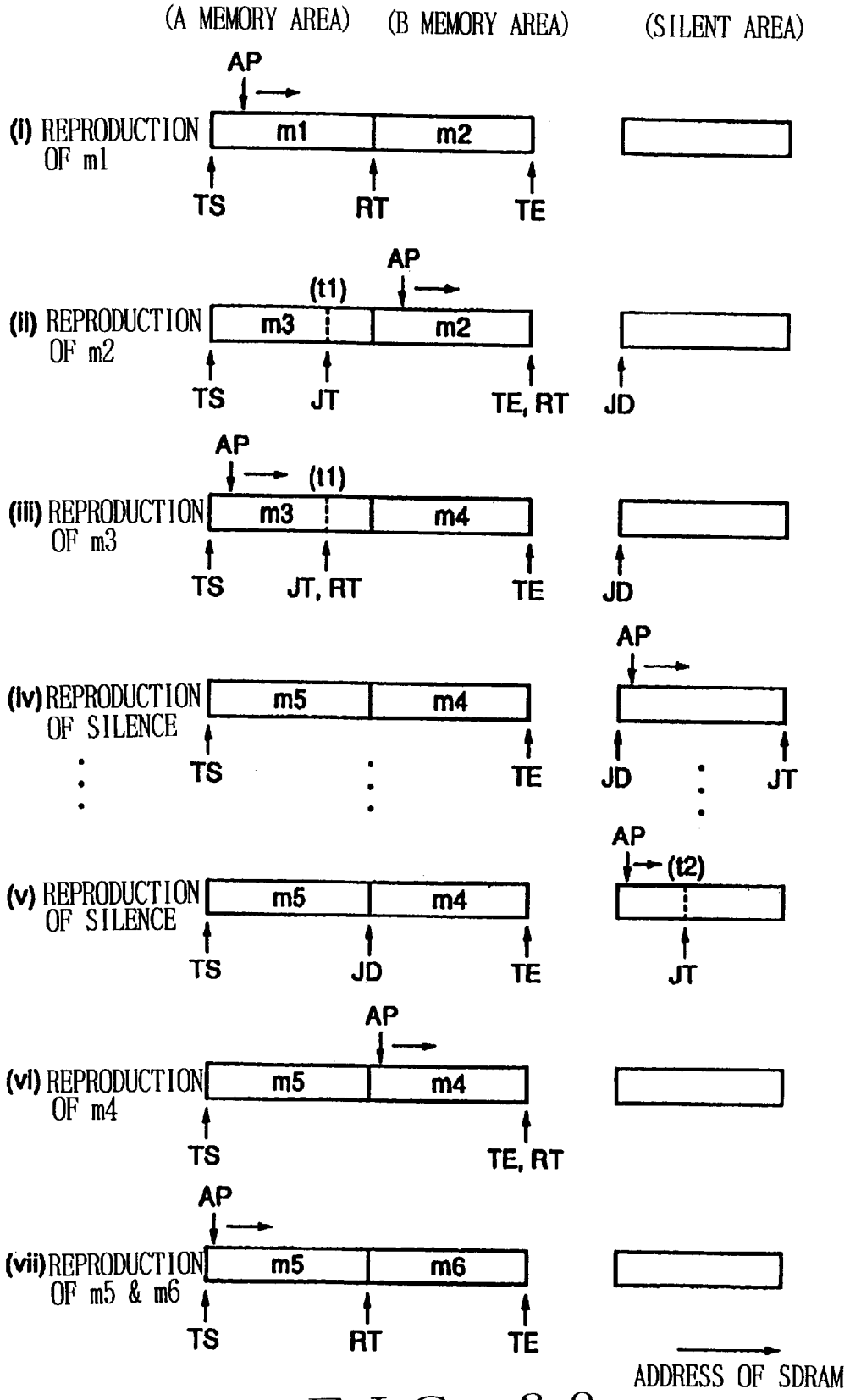
FIG. 20 is a diagram showing an example of address control of the SDRAMs that is performed by the address generator in reproducing a performance part with the sound data recorded along with the silent section as shown in FIG. 19.

FIG. 20 is a diagram showing an example of address control of the SDRAMs 64 and 66 that is performed by the address generator 100 in reproducing a performance part for which the sound data are recorded with the silent area inserted as shown in FIG. 19. (i) of FIG. 20 is explanatory of how the sound data m1 stored in the A memory area of the SDRAM 64 or 66 are read out, and (ii) of FIG. 20 is explanatory of how the sound data m2 stored in the B memory area of the SDRAM 64 or 66 following the sound data m1 are read out. While the sound data m2 are being read out, the A memory area is rewritten with the sound data m3, and the address corresponding to the time point t1 is set as the jump-from address JT while the head address of the silent area is set as the jump-to address JD. Once the address pointer AP reaches the rear end address of the B memory area, the address pointer AP is moved back to the head address of the A memory area to again advance forward from the head address, as denoted in (iii) of the figure. Also, the interrupt request generation address RT is set to coincide with the jump-from address JT. Once the address pointer AP reaches the jump-from address JT, it jumps to the jump-to address JD, from which the address pointer AP is incremented by one every sampling period as denoted in (iv), so that a silent sound is reproduced for the channel in question. Also, when the address pointer AP reaches the interrupt request generation address RT at the jump-from address JT, an interrupt request is issued in such a manner that the B memory area is rewritten with the sound data m4 and the A memory area is rewritten with the sound data m5 while the silent sound is being reproduced. Till immediately before the end time point t2 of the silent area, the address pointer AP circulates through the silent area with the rear end address and head address of the silent area set as the jump-from address JT and jump-to address JD, respectively, so that the silent tone continues to be generated. Throughout these time periods, the sound data readout from the HDD 60 for the channel is suspended. Then, upon arrival at a predetermined point immediately before the end time point t2, an address of the silent area corresponding to the end time point t2 of the silent area is set as the jump-from address JT and the head address of the B memory area is set as the jump-to address JD, as denoted in (v). Then, once the address pointer AP reaches the jump-from address JT in the silent area, it jumps to the jump-to address JD as denoted in (vi) so that the readout of the sound data m4 is resumed at the beginning of the B memory area. As a result, the reproduction of the silent area is terminated, and a performance tone of the channel is reproduced. Also, at this point, the rear end address TE of the B memory area is set as the interrupt request generation address RT. Once the address pointer AP reaches the rear end address TE of the B memory area, the address pointer AP is moved back to the head address of the A memory area to again advance forward from the head address, as denoted in (vii) of the figure, in such a manner that the sound data m5 are read out for audible reproduction. Also, an interrupt request is issued, and the B memory area is rewritten with the sound data m6 so that the sound data m6 are read out and audibly reproduced upon completion of the readout of the sound data m5.

Figure 21:
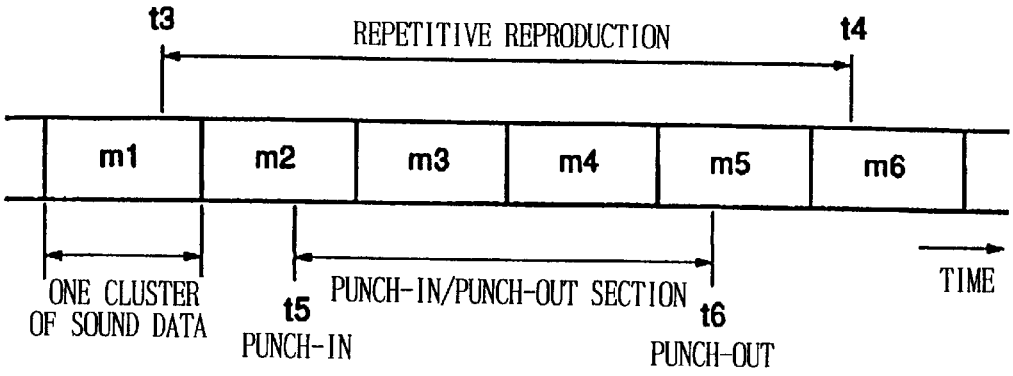
FIG. 21 is a time chart explanatory of an exemplary manner in which a repetition (or repetitive reproduction) section is set for punch-in/punch-out.
Figure 22:
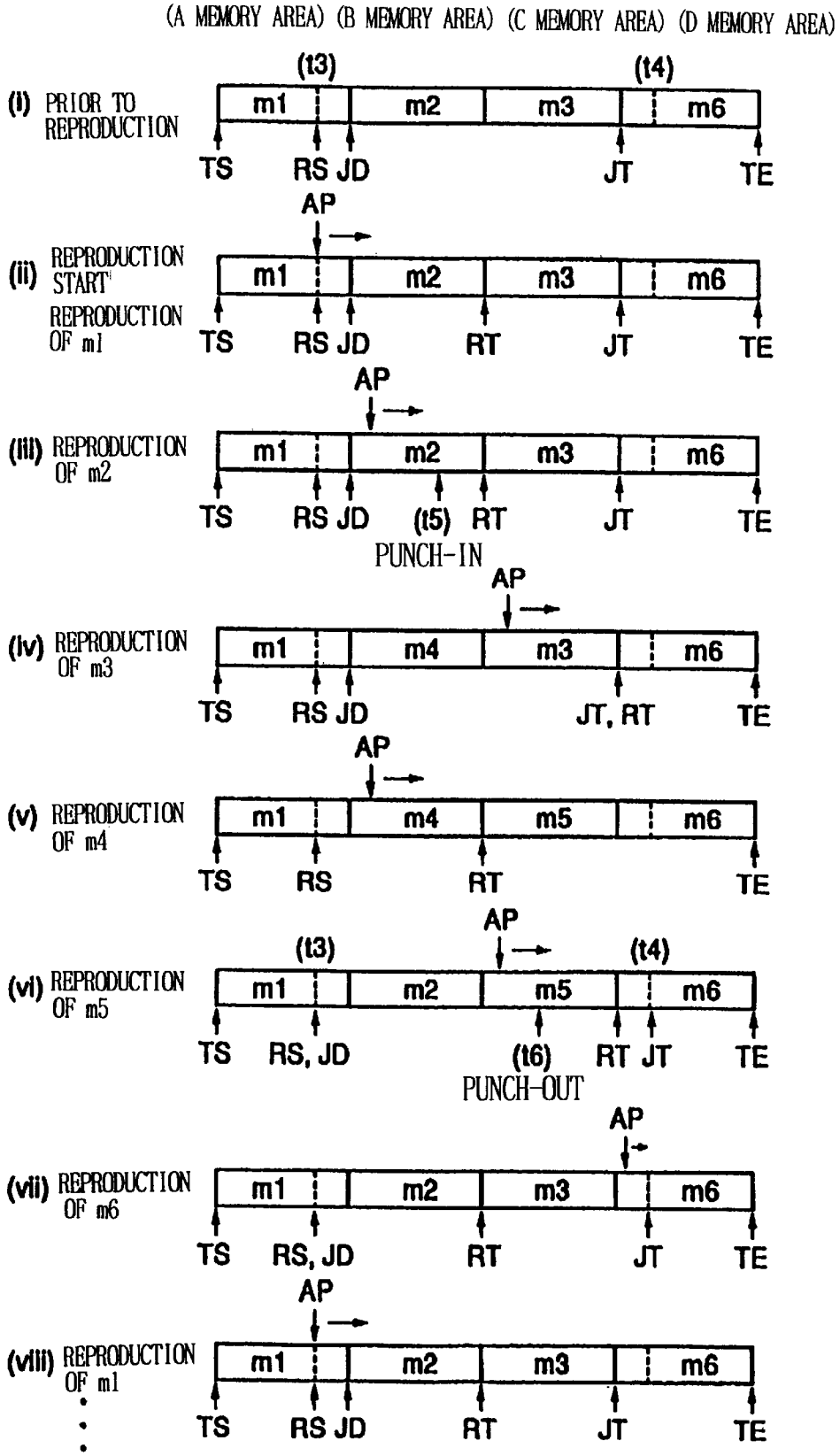
FIG. 22 is a diagram showing exemplary address control of the SDRAM which is performed by the address generator in the repetitive reproduction as shown in FIG. 21.

The following paragraphs describe an example of address control for repetitive reproduction, in relation to a case of FIG. 21 where a particular section between time points t3 and t4 of a recorded song is reproduced in a repetitive fashion and punch-in/punch-out operations are performed between time points t5 and t6 within the particular section. Reference numerals "m1"–"m6" each represent one cluster of the sound data. Start time point t3 of the repetitive reproduction falls at an intermediate point of the sound data cluster m1, while time point t4 of the repetitive reproduction falls at an intermediate point of the sound data cluster m6. FIG. 22 shows the exemplary address control of the SDRAM 64 or 66 which is performed by the address generator 100 in the repetitive reproduction as shown in FIG. 21. When the punch-in/punch-out mode has been selected in the recording/reproduction mode, the memory areas A to D, having a total size of four clusters, in the SDRAMs 64 and 66 are allocated to each of performance channels 0–23, as shown in FIG. 13. Then, once the human operator designates a repetition section between time points t3 and t4 and a punch-in/punch-out section between time points t5 and t6, the HDD 60 is read so that the sound data cluster m1 embracing time point t3 is stored into the A memory area and the sound data cluster m6 embracing time point t4 is stored into the D memory area as denoted in (i) of FIG. 22. These sound data clusters m1 and m6 located at opposite ends of the repetition section are not rewritten during the repetitive reproduction. Initially, the sound data clusters m2 and m3 are stored into the B and C memory areas, respectively, as denoted in (i). The area fore end address TS is set at the head address of the A memory area, readout start address RS set at an address of the A memory area corresponding to time point 3, jump-to address JD set at the rear end of the A memory area, interrupt request generation address set at the rear end of the B memory area, jump-from address JT set at the rear end of the C memory area, and area rear end address TE is set at the trailing or rear end of the D memory area.

Then, once a start of the repetitive reproduction is instructed, the address pointer AP is incremented, from the readout start address RS, by one every sampling period, so that the sound data of the cluster m1 at and after time point t3 are read out and audibly reproduced, as denoted in (ii) of FIG. 22. Then, once the address pointer AP reaches the rear end address TE of the A memory area, the sound data m2 of the B memory area are reproduced directly following the sound data m1, as denoted in (iii). Then, upon arrival at time point t5 in the course of the reproduction of the sound data m2, the channel for which the punch-in/punch-out operations have been instructed is switched to the recording mode, and thus the punch-in operation is carried out. Then, when the address pointer AP reaches the rear end address TE of the B memory area, an interrupt request is issued, in response to which the sound data m4 are read out from the HDD 60 and the B memory area is rewritten with the sound data m4 as denoted in (iv). Then, the address pointer AP continues to move along the B memory area so that reproduction of the sound data m3 and recording of an input sound are continued. The interrupt request generation address RT is shifted to the rear end address of the C memory area. Then, once the address pointer AP reaches the rear end address TE of the C memory area, an address jump takes place such that the address pointer AP is moved back to the head address of the B memory area for readout of the sound data m4 as denoted in (v). Also, an interrupt request is issued, in response to which the sound data m5 are read out from the HDD 60 and the C memory area is rewritten with the sound data m5. Also, the interrupt request generation address RT is shifted to the rear end address of the B memory area. Then, once the address pointer AP reaches the rear end address TE of the B memory area, an interrupt request is issued, in response to which the B memory area is rewritten with the sound data m2 as denoted in (vi). Then, the address pointer AP moves along the C memory area so that reproduction of the sound data m5 is carried out. Also, the interrupt request generation address RT is shifted to the rear end address of the C memory area. In addition, an address of the D memory area corresponding to time point 4 is set as the jump-from address JT, and an address of the A memory area corresponding to time point 3 is set as the jump-to address JD. Then, upon arrival at time point t6 in the course of the reproduction of the sound data m5, the channel for which the punch-in/punch-out operations have been instructed is switched back to the reproduction mode, and thus the punch-out operation is carried out. Then, when the address pointer AP reaches the rear end address TE of the C memory area, an interrupt request is issued, in response to which the C memory area is rewritten with the sound data m3 as denoted in (vii). After that, the address pointer AP moves along the D memory area so that reproduction of the sound data m6 is carried out. Also, the interrupt request generation address RT is shifted to the rear end address of the B memory area. Then, once the address pointer AP reaches an address corresponding to the end time point t4 of the repetition section, an address jump takes place such that the address pointer AP is moved back to the address corresponding to time point t3 of the repetition section, at which the reproduction is resumed to repeat the above-mentioned repetitive reproduction and punch-in/punch-out operations. Note that a slight silent time zone may be provided between the address corresponding to time point t3 and a time point preceding the resumption of the repetitive reproduction so that the movement of the address pointer back to the start point of the repetitive reproduction can be readily recognized.

Figure 23:
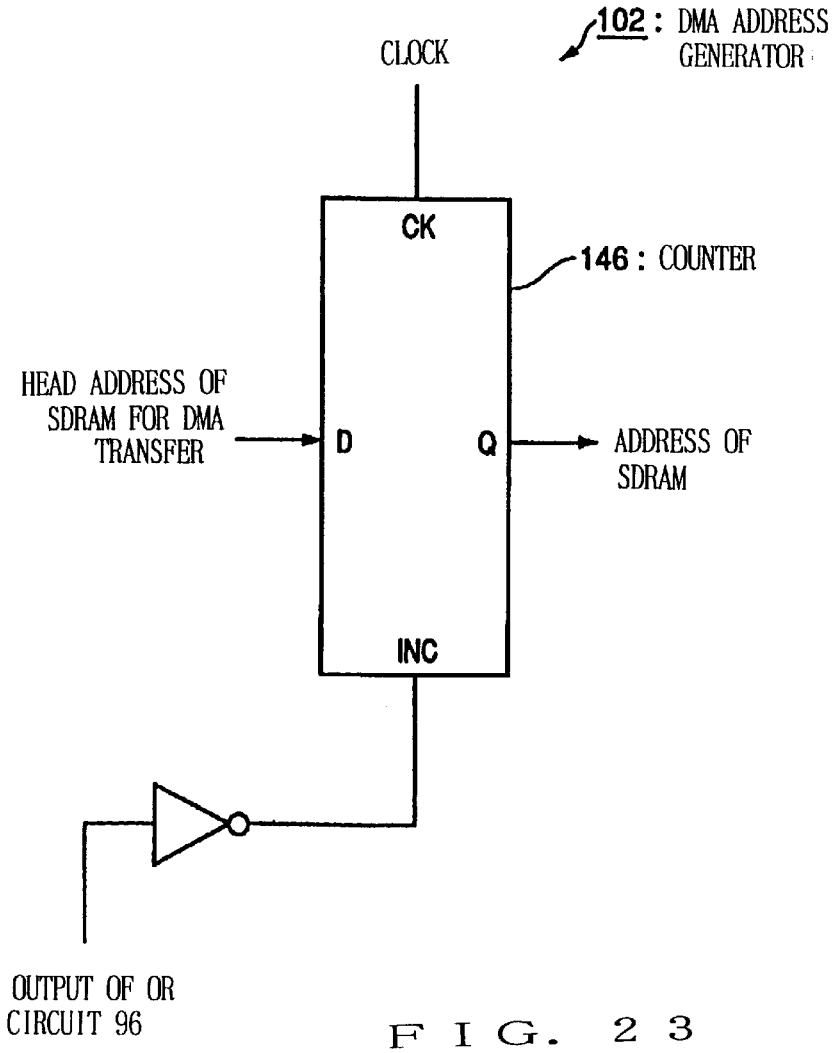
FIG. 23 is a block diagram showing an example of construction of a DMA address generator of FIG. 10.

Finally, a description will be made about address control of the SDRAMs 64 and 66 which is performed by the DMA address generator 102 of FIG. 10 for the DMA transfer. In FIG. 23, there is shown an example of construction of the DMA address generator 102 for one channel, which comprises a counter 146. Once an interrupt request for the DMA transfer is issued, the recorder CPU 14 sets, into the counter 146, the head address of one of the A and B memory areas (in the case of the repetitive reproduction, B and C memory areas) of the SDRAM 64 or 66 which is assigned to the current DMA transfer. To the increment input INC of the counter 146 is applied a signal indicative of the remaining three quarters of a sampling period (i.e., the time period for carrying out the DMA transfer) which is output from the OR circuit of FIG. 7. To the clock input CK of the counter are applied clock pulses obtained by further frequency-dividing the 512 divided clock pulses by four. Thus, the counter 146 is caused to count up once for every four of the 512 divided clock pulses in the time period for carrying out the DMA transfer. The counted value of the counter 146 is fed as address information to the SDRAM 64 or 66, so that the sample data is read out from the corresponding address of the SDRAM 64 or 66 and DMA-transferred to the HDD 60, or the sample data DMA-transferred from the HDD 60 is written into the corresponding address of the SDRAM 64 or 66.

Figure 25:
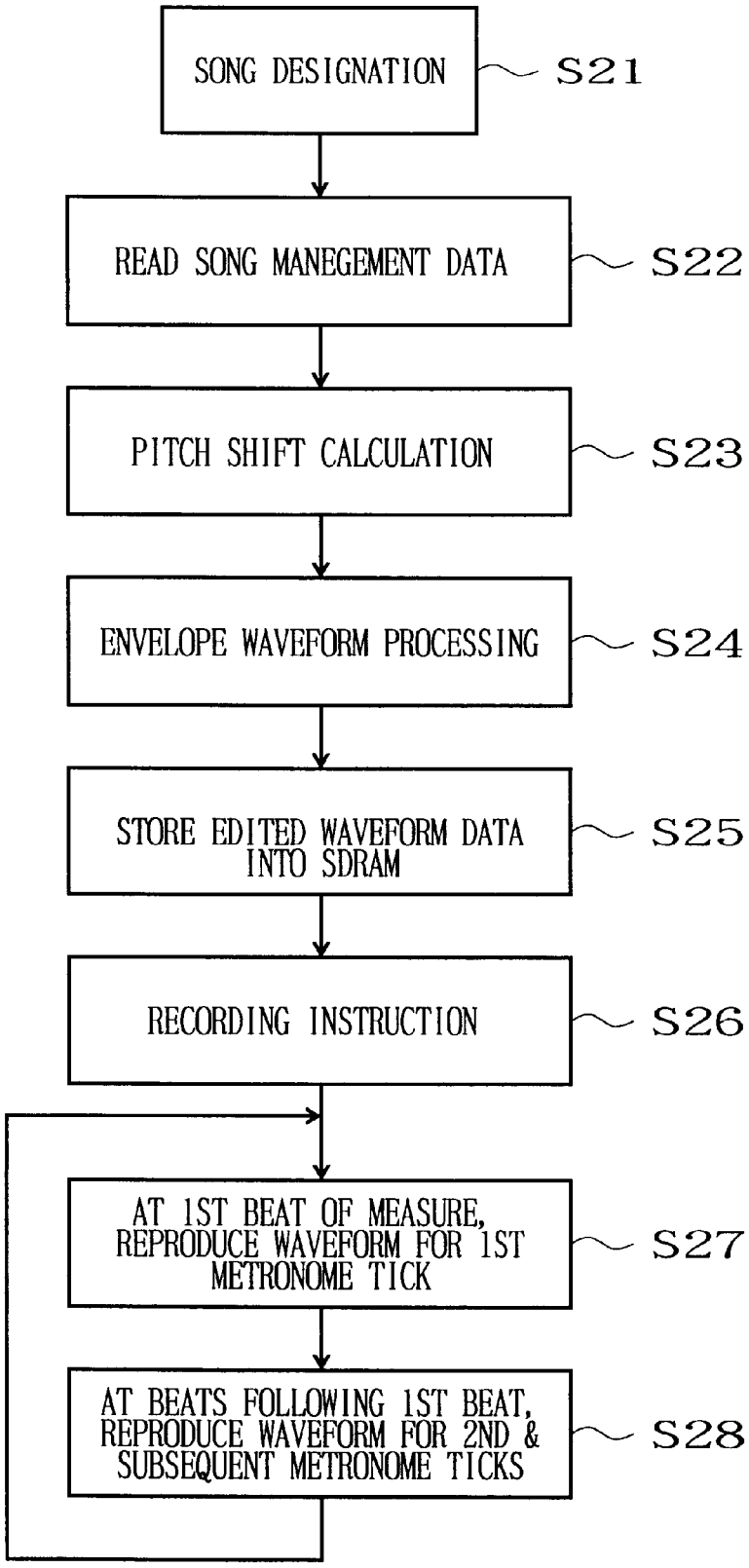
FIG. 25 is a flow chart showing an operational sequence for waveform editing and audible reproduction of a metronome tone in the hard disk recorder of FIG. 3.

FIG. 25 is a flow chart showing an exemplary operational sequence for editing a metronome tone waveform and generating the metronome tone. Once a desired song is designated at step S21 and the corresponding song management data have been read out at step S22, the recorder CPU 14 automatically carries out waveform-editing arithmetic processing (pitch shift calculation of step S23 and envelope calculation of step S24) on the basis of the metronome-sound basic waveform data stored in the flash ROM 58 and metronome-sound waveform editing parameters contained in the song management data, using the DRAM 62 as a working area. In the pitch shift calculation of step S23, pitch-shifted waveform data are calculated by linear interpolation, Lagrange's interpolation or the like. The envelope calculation of step S24 is applied, for example, in the event that the waveform gives a rather dull impression with its attach, release or other portion prolonged by the pitch shift; that is, in this envelope calculation, the waveform is multiplied by a coefficient representing a waveform with a rapid rise or rapid fall, so as to optimize the envelope. The waveform data of the metronome tone having its waveform edited through the waveform-editing arithmetic processing are transferred from the DRAM 62 to a predetermined area of the SDRAM 64 or 66 for storage therein, at step S25. When recording (e.g., ALL REC) has been instructed in this situation at step S26 and if the metronome tone reproduction is set in the ON state, the waveform data of the metronome tone are read out and audibly reproduced repetitively from the SDRAM 64 or 66 at a tempo designated by the human operator, at steps S27 and S28. Recording of a performance is performed to the thus-reproduced metronome tone.

Manner in which the memory areas of the SDRAMs 64 and 66, constituting the buffer memory, are divided for normal recording/reproduction purposes in the recording/reproduction mode, is just as shown in Table 1 above.

Figure 26:
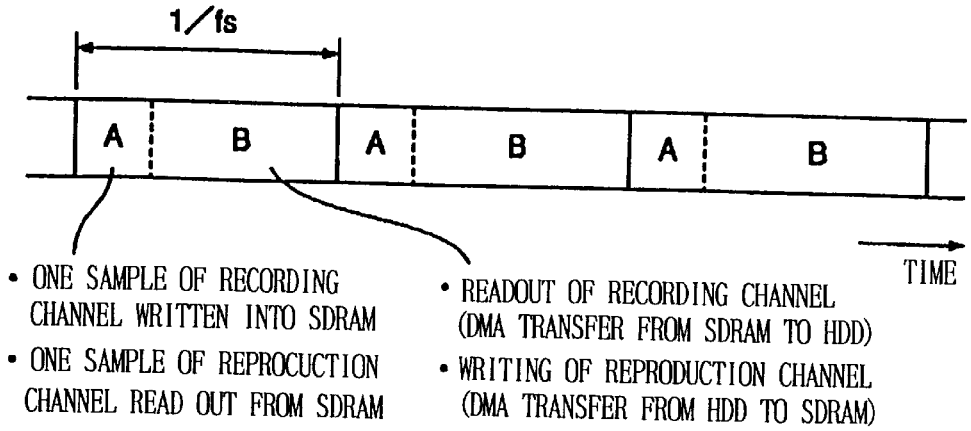
FIG. 26 is a time chart explanatory of an example of write/read control of the SDRAM in the recording/reproduction mode in the hard disk recorder of FIG. 3.

The following paragraphs describe an example of write/read control of the SDRAMs 64 and 66 in the recording/reproduction mode, with reference to FIG. 26 which shows an example of time division similar to that of FIG. 6. As shown, each sampling period 1/fs (fs=48 kHz, 44.1 kHz or the like) is divided into predetermined time sections A and B. For recording channels (input channels), the sound data corresponding to the number of the recording channels are time-divisionally written, sample by sample, into the SDRAM 64 or 66 in the A time section. In the B time section, a plurality of samples of the sound data of the recording channels are read out from the SDRAM 64 or 66 and DMA-transferred to the HDD 60. For reproduction channels (output channels), the sound data corresponding to the number of the recording channels are time-divisionally read out, sample by sample, from the SDRAM 64 or 66 in the A time section. In the B time section, a plurality of samples of the sound data of the reproduction channels are read out from the HDD 60 and DMA-transferred to the SDRAM 64 or 66 for storage therein. Note that the DMA transfer is carried out time-divisionally on a channel-by-channel basis such that once another cluster of the samples has been accumulated for one channel, the other cluster of the samples is transferred collectively, then once one cluster of the samples has been accumulated for another channel, the one cluster of the samples is transferred collectively, and so on. In case there is no need to send data by the DMA transfer for any channel, i.e. in case one cluster of the data input via the input/output signal line has not been newly written into the SDRAM 64 or 66 and unless one cluster of the data to be output via the input/output signal line has not been newly read out from the SDRAM 64 or 66, the DMA transfer is not carried out.

For each of the metronome tones and sampler tones, there is no need to write any data into the SDRAM 64 or 66 during the reproduction because all the waveform data to be reproduced have been already stored in the SDRAM 64 or 66, and in this case, only the data readout from the SDRAM 64 or 66 is effected. The data readout of the metronome tone and sampler tone from the SDRAM 64 or 66 is carried out, one sample per sampling period 1/fs (when a plurality of different types of samplers are designated, one sample per sampler type) along with the sound data readout process of each performance tone reproduction channel on the time-divisional basis. In Table 6 below, there is an example of order in which the SDRAMs 64 and 66 are time-divided in the A time section of one sampling period 1/fs for the purpose of reading out or writing one sample of the data of each channel from or to the SDRAM 64 or 66. Note that in Table 6, "R" represents a read mode, "W" represents a write mode, and "R/W" represents a read or write mode.

TABLE 6

| ORDER | OPERATION MODE | CHIP NO. | BANK NO. | CHANNEL NO. |
|---|---|---|---|---|
| 1 | R | 0 | 0 | 0 |
| 2 | R | 0 | 1 | 1 |
| 3 | R | 1 | 0 | METRONOME (1ST TICK) |
| 4 | R | 0 | 0 | 2 |
| 5 | R | 0 | 1 | 3 |
| 6 | R | 1 | 3 | METRONOME (2ND & SUBSEQUENT TICKS) |
| 7 | R | 0 | 0 | 4 |
| 8 | R | 0 | 1 | 5 |
| 9 | R | 0 | 0 | 6 |
| 10 | R | 0 | 1 | 7 |
| 11 | R/W | 0 | 0 | 8 |
| 12 | R/W | 0 | 1 | 9 |
| 13 | R/W | 0 | 0 | 10 |
| 14 | R/W | 0 | 1 | 11 |
| 15 | R/W | 0 | 2 | 12 |
| 16 | R/W | 0 | 3 | 13 |
| 17 | R/W | 0 | 2 | 14 |
| 18 | R/W | 0 | 3 | 15 |
| 19 | W | 0 | 2 | 16 (MIXL UPPER WORD) |
| 20 | W | 0 | 3 | 17 (MIXR UPPER WORD) |
| 21 | R | 1 | 0–3 | SAMPLER 0 |
| 22 | W | 0 | 2 | 18 |
| 23 | W | 0 | 3 | 19 |
| 24 | R | 1 | 0–3 | SAMPLER 1 |
| 25 | W | 0 | 2 | 20 |
| 26 | W | 0 | 3 | 21 |
| 27 | R | 1 | 0–3 | SAMPLER 2 |
| 28 | W | 0 | 2 | 22 |
| 29 | W | 0 | 3 | 23 |
| 30 | R | 1 | 0–3 | SAMPLER 3 |
| 31 | {W | 0 | 2 | 16 (MIXL LOWER WORD)} |
| 32 | {W | 0 | 3 | 17 (MIXR LOWER WORD)} |
| 33 | R | 1 | 0–3 | SAMPLER 4 |
| 34 | R | 1 | 0–3 | SAMPLER 5 |
| 35 | R | 1 | 0–3 | SAMPLER 6 |
| 36 | R | 1 | 0–3 | SAMPLER 7 |

In the example of Table 6 above, of all the 24 signal path channels, channels 0–7 are set as reproduction-only channels channels 8–15 as recording/reproduction channels and channels 16–23 as recording-only channels. However, note that channels 8–15 can be used as recording channels only in the recording-only (ALL REC) mode, and can be used only as reproduction channels in the simultaneous recording and reproduction (SYNC DUBBING) mode. If a mix-down operation is to be executed, a track of a performance part as a mix-down source is assigned with channels 0–15 set as reproduction channels and channels 16 and 17 are assigned as mix-down destination recording channels MIXL and MIXR (a pair of left and right channels), so that tones reproduced via channels 0–15 are mixed down to the left and right channels MIXL and MIXR by means of the DSP 38 and recorded onto the HDD 60 by way of channels 16 and 17. The mixed-down signals of the left and right channels are reproduced by being allocated to any desired ones of reproduction-only channels 0–15. Because the mixed-down signals MIXL and MIXR are each made up of 24 bits, each of the signals MIXL and MIXR is transmitted after being divided into upper and lower words.

Further, whereas the preferred embodiments have been described above as employing a hard disk device (HDD) as the external storage device, any other suitable type of external device may be employed such as an optical disk device or magneto-optical disk device. Furthermore, although the preferred embodiments have been described above in relation to the case where the basic principles of the present invention are applied to a recording/reproduction apparatus with an external storage device incorporated therein, the present invention may also be applied to any other type of audio-data recording/reproduction apparatus employing an external storage device connected, via an interface board such as an SCSI, to the recording/reproduction apparatus. Moreover, although the preferred embodiments have been described above in relation to the case where the basic principles of the present invention are applied to a digital mixing recorder (hard disk recorder), the present invention may also be applied to digital recorders having no mixing function and various other types of sample-data reproduction apparatus.

Furthermore, the embodiment described above in relation to the metronome tones can be applied to generation of various other types of tones, such as sampler tones and other single-shot tones, than the metronome tones. Further, the waveform editing of the present invention may be intended for any other processing than the pitch adjustment, such as level adjustment. Further, the storage device for storing the basic waveform data may be other than the flash ROM, such as a non-volatile memory or HDD. Further, the storage device for storing edited waveform data may be any other non-volatile memory or the like than the SDRAM. Further, the present invention is applicable to an electronic musical instrument or any other tone generation apparatus in addition to the recording/reproduction apparatus.

Finally, while the described embodiments represent the preferred form of the present invention, it is to be understood that various modifications will occur to those skilled in the art without departing from the spirit of the invention. The scope of the present invention is therefore to be determined solely by the appended claims.

What is claimed is:

1. A sample data reproduction apparatus adapted to be connected to a storage device storing therein sample data and adapted to reproduce the sample data by reading out the sample data from said storage device, said sample data reproduction apparatus comprising:

a buffer memory;

a control device coupled with said storage device and said buffer memory, said control device being adapted to:

sequentially read out the sample data from said storage device and then write the read-out sample data into said buffer memory;

read out the sample data from said buffer memory, one sample per sampling period;

sequentially update the sample data at addresses of said buffer memory where sample data readout has been completed, with the sample data newly read out from said storage device;

set a jump-from address and jump-to address while the sample data are being read out, sample by sample, from said buffer memory; and cause a read address of said buffer memory to jump to the jump-to address when the read address of said buffer memory reaches the set jump-from address, to carry on reading out the sample data from the jump-to address onward; and a reproduction circuit coupled to said control device and adapted to reproduce the sample data having been read out, sample by sample, from said buffer memory.

2. A sample data reproduction apparatus as claimed in claim 1 wherein said control device includes:

a jump address setting circuit that sets the jump-from address and jump-to address at an appropriate time point while the sample data are being read out, sample by sample, from said buffer memory; and a read-address calculation circuit that, every sampling period, obtains an address advanced from a current read address and determines whether or not the obtained address has reached the jump-from address, and wherein when it is determined that the obtained address has not reached the jump-from address, said read-address calculation circuit sets the obtained address as a read address to be used in a next sampling period, but when it is determined that the obtained address has reached the jump-from address, said read-address calculation circuit sets the jump-to address as the read address to be used in the next sampling period.

3. A sample data reproduction apparatus as claimed in claim 2 wherein said jump address setting circuit includes an address memory that rewritably holds information indicative of the jump-from address and jump-to address, and wherein the information indicative of the jump-from address and jump-to address held in said address memory is updated with a next jump-from address and next jump-to address at an appropriate time point after completion of a last address jump.

4. A sample data reproduction apparatus as claimed in claim 1 wherein the jump-from address is set on the basis of time information that is stored in said storage device and that corresponds to timing for effecting an address jump from the jump-from address.

5. A sample data reproduction apparatus as claimed in claim 1 wherein the jump-from address is set on the basis of an instructing operation by a human operator that corresponds to timing for effecting an address jump from the jump-from address.

6. A method for reproducing sample data by transferring, from a storage device storing therein sample data, the sample data to a buffer memory and then reading out the sample data from said buffer memory, said method comprising the steps of:

sequentially reading out the sample data from said storage device and then writing the sample data into said buffer memory;

reading out the sample data from said buffer memory, one sample per sampling period;

sequentially updating the sample data at addresses of said buffer memory where sample data readout has been completed, with the sample data newly read out from said storage device;

setting a jump-from address and jump-to address while the sample data are being read out, sample by sample, from said buffer memory; and causing a read address of said buffer memory to jump to the jump-to address when the read address of said buffer memory reaches the jump-from address set via said step of setting, to carry on reading out the sample data from the jump-to address onward.

7. A machine-readable storage medium containing a group of instructions to cause said machine to implement a method for reproducing sample data, said method reproducing sample data by transferring, from a storage device storing therein sample data, the sample data to a buffer memory and then reading out the sample data from said buffer memory, said method comprising the steps of:

sequentially reading out the sample data from said storage device and then writing the sample data into said buffer memory;

reading out the sample data from said buffer memory, one sample per sampling period;

sequentially updating the sample data at addresses of said buffer memory where sample data readout has been completed, with the sample data newly read out from said storage device;

setting a jump-from address and jump-to address while the sample data are being read out, sample by sample, from said buffer memory; and causing a read address of said buffer memory to jump to the jump-to address when the read address of said buffer memory reaches the jump-from address set via said step of setting, to carry on reading out the sample data from the jump-to address onward.

8. A sample data reproduction apparatus adapted to be connected to a storage device storing therein sample data and adapted to reproduce the sample data by reading out the sample data from said storage device, information indicative of a silent section being stored in said storage device in place of sample data corresponding to the silent section, said sample data reproduction apparatus comprising:

a buffer memory adapted to store therein sample data, a silent area for storing silent sample data being set in part of said buffer memory;

a control device coupled with said storage device and said buffer memory, said control device being adapted to:

sequentially read out the sample data from said storage device and then write the read-out sample data into said buffer memory;

read out the sample data from said buffer memory, one sample per sampling period;

sequentially update the sample data at addresses of said buffer memory where sample data readout has been completed, with the sample data newly read out from said storage device;

while the sample data are being read out, sample by sample, from said buffer memory and on the basis of the information indicative of the silent section, set, as a jump-from address, an address of said buffer memory corresponding to a start point of the silent section and, as a jump-to address, an address of said silent area in said buffer memory; and cause a read address of said buffer memory to jump to the jump-to address when the read address of said buffer memory reaches the set jump-from address, to carry on reading out the silent sample data from the jump-to address onward; and a reproduction circuit coupled to said control device and adapted to reproduce the sample data having been read out, sample by sample, from said buffer memory.

9. A sample data reproduction apparatus as claimed in claim 8 wherein said control device is further adapted to:

at an appropriate time point while the silent sample data are being read out from said silent area and on the basis of the information indicative of the silent section, set, as the jump-from address, an address of said silent area corresponding to an end point of the silent section and, as the jump-to address, an address within an area of said buffer memory containing the sample data following the silent section which is read out from said storage device; and cause a read address of said buffer memory to jump to the jump-to address when the read address of said buffer memory reaches the jump-from address within the silent area, to carry on reading out the sample data from the jump-to address onward.

10. A method for reproducing sample data by transferring, from a storage device storing therein sample data, the sample data to a buffer memory and then reading out the sample data from said buffer memory, information indicative of a silent section being stored in said storage device in place of sample data corresponding to the silent section, a silent area for storing silent sample data being set in part of said buffer memory, said method comprising the steps of:

sequentially reading out the sample data from said storage device and then writing the sample data into said buffer memory;

reading out the sample data from said buffer memory, one sample per sampling period;

sequentially updating the sample data at addresses of said buffer memory where sample data readout has been completed, with the sample data newly read out from said storage device;

while the sample data are being read out, sample by sample, from said buffer memory and on the basis of the information indicative of the silent section, setting, as a jump-from address, an address of said buffer memory corresponding to a start point of the silent section and, as a jump-to address, an address of said silent area in said buffer memory; and causing a read address of said buffer memory to jump to the jump-to address when the read address of said buffer memory reaches the set jump-from address, to carry on reading out the silent sample data from the jump-to address onward.

11. A method as claimed in claim 10 which further comprises the steps of:

at an appropriate time point while the silent sample data are being read out from said silent area and on the basis of the information indicative of the silent section, setting, as the jump-from address, an address of said silent area corresponding to an end point of the silent section and, as the jump-to address, an address within an area of said buffer memory containing the sample data following the silent section which is read out from said storage device; and causing a read address of said buffer memory to jump to the jump-to address when the read address of said buffer memory reaches the jump-from address within the silent area, to carry on reading out the sample data from the jump-to address onward.

12. A machine-readable storage medium containing a group of instructions to cause said machine to implement a method for reproducing sample data, said method reproducing sample data by transferring, from a storage device storing therein sample data, the sample data to a buffer memory and then reading out the sample data from said buffer memory, information indicative of a silent section being stored in said storage device in place of sample data corresponding to the silent section, a silent area for storing silent sample data being set in part of said buffer memory, said method comprising the steps of:

sequentially reading out the sample data from said storage device and then writing the sample data into said buffer memory;

reading out the sample data from said buffer memory, one sample per sampling period;

sequentially updating the sample data at addresses of said buffer memory where sample data readout has been completed, with the sample data newly read out from said storage device;

while the sample data are being read out, sample by sample, from said buffer memory and on the basis of the information indicative of the silent section, setting, as a jump-from address, an address of said buffer memory corresponding to a start point of the silent section and, as a jump-to address, an address of said silent area in said buffer memory; and causing a read address of said buffer memory to jump to the jump-to address when the read address of said buffer memory reaches the set jump-from address, to carry on reading out the silent sample data from the jump-to address onward.

13. A machine-readable storage medium as claimed in claim 12 wherein said method further comprises the steps of:

at an appropriate time point while the silent sample data are being read out from said silent area and on the basis of the information indicative of the silent section, setting, as the jump-from address, an address of said silent area corresponding to an end point of the silent section and, as the jump-to address, an address within an area of said buffer memory containing the sample data following the silent section which is read out from said storage device; and causing a read address of said buffer memory to jump to the jump-to address when the read address of said buffer memory reaches the jump-from address within the silent area, to carry on reading out the sample data from the jump-to address onward.

14. A sample data reproduction apparatus adapted to be connected to a storage device storing therein sample data and adapted to reproduce the sample data by reading out the sample data from said storage device, said sample data reproduction apparatus comprising:

a buffer memory;

a control device coupled with said storage device and said buffer memory, said control device being adapted to:

sequentially read out the sample data from said storage device, by one predetermined unit segment at a time, and then write the read-out sample data into said buffer memory;

read out the sample data from said buffer memory, one sample per sampling period;

sequentially update the sample data at addresses of said buffer memory where sample data readout has been completed, with the sample data newly read out from said storage device, by one unit segment at a time;

when the sample data of a given section ranging across a plurality of unit segments are to be read out repetitively, prior to readout of said given section, read out, from said storage device, individual sample data of at least a first unit segment containing a fore end portion of said given section and a second unit segment containing a rear end portion of said given section, and then store the read-out individual sample data into a first area of said buffer memory, and during the readout of said given section, read out, from said storage device, the sample data of other unit segments than at least said first unit segment and said second unit segment, and store the read-out sample data into a second area of said buffer memory in a sequentially updating fashion;

sequentially set a jump-from address and jump-to address to effect an address jump for successive readout of said given section; and cause a read address of said buffer memory to jump to the jump-to address when the read address of said buffer memory reaches the set jump-from address, to carry on reading out the sample data from the jump-to address onward; and a reproduction circuit coupled to said control device and adapted to reproduce the sample data having been read out, sample by sample, from said buffer memory.

15. A method for reproducing sample data by transferring, from a storage device storing therein sample data, the sample data to a buffer memory and then reading out the sample data from said buffer memory, said method comprising the steps of:

sequentially reading out the sample data from said storage device, by one predetermined unit segment at a time, and then writing the read-out sample data into said buffer memory;

reading out the sample data from said buffer memory, one sample per sampling period;

sequentially updating the sample data at addresses of said buffer memory where sample data readout has been completed, with the sample data newly read out from said storage device, by one unit segment at a time;

when the sample data of a given section ranging across a plurality of unit segments are to be read out repetitively, prior to readout of said given section, reading out, from said storage device, individual sample data of at least a first unit segment containing a fore end portion of said given section and a second unit segment containing a rear end portion of said given section, and then storing the read-out individual sample data into a first area of said buffer memory, and during the readout of said given section, reading out, from said storage device, the sample data of other unit segments than at least said first unit segment and said second unit segment, and then storing the read-out sample data into a second area of said buffer memory in a sequentially updating fashion;

sequentially setting a jump-from address and jump-to address to effect an address jump for successive readout of said given section; and causing a read address of said buffer memory to jump to the jump-to address when the read address of said buffer memory reaches the set jump-from address, to carry on reading out the sample data from the jump-to address onward.

16. A machine-readable storage medium containing a group of instructions to cause said machine to implement a method for reproducing sample data, said method reproducing sample data by transferring, from a storage device storing therein sample data, the sample data to a buffer memory and then reading out the sample data from said buffer memory, said method comprising the steps of:

sequentially reading out the sample data from said storage device, by one predetermined unit segment at a time, and then writing the read-out sample data into said buffer memory;

reading out the sample data from said buffer memory, one sample per sampling period;

sequentially updating the sample data at addresses of said buffer memory where sample data readout has been completed, with the sample data newly read out from said storage device, by one unit segment at a time;

when the sample data of a given section ranging across a plurality of unit segments are to be read out repetitively, prior to readout of said given section, reading out, from said storage device, individual sample data of at least a first unit segment containing a fore end portion of said given section and a second unit segment containing a rear end portion of said given section, and then storing the read-out individual sample data into a first area of said buffer memory, and during the readout of said given section, reading out, from said storage device, the sample data of other unit segments than at least said first unit segment and said second unit segment, and then storing the read-out sample data into a second area of said buffer memory in a sequentially updating fashion;

sequentially setting a jump-from address and jump-to address to effect an address jump for successive readout of said given section; and causing a read address of said buffer memory to jump to the jump-to address when the read address of said buffer memory reaches the set jump-from address, to carry on reading out the sample data from the jump-to address onward.

17. A sample data recording apparatus adapted to be connected to a storage device storing therein sample data and adapted to record other sample data into said storage device while reading out the sample data from said storage device, said sample data recording apparatus comprising:

a buffer memory;

a control device coupled with said storage device and said buffer memory, said control device being adapted to:

sequentially read out the sample data from said storage device, by one predetermined unit segment at a time, and then write the read-out sample data into said buffer memory;

read out the sample data from said buffer memory, one sample per sampling period; and sequentially update the sample data at addresses of said buffer memory where sample data readout has been completed, with the sample data newly read out from said storage device, by one unit segment at a time, said control device being further adapted to:

when said control device is to record other sample data separately input to at least part of a given section ranging across a plurality of unit segments while repetitively reading out the sample data of said given section, prior to readout of said given section, read out, from said storage device, individual sample data of at least a first unit segment containing a fore end portion of said given section and a second unit segment containing a rear end portion of said given section, and then store the read-out individual sample data into a first area of said buffer memory, and during the readout of said given section, read out, from said storage device, the sample data of other unit segments than at least said first unit segment and said second unit segment, and store the read-out sample data into a second area of said buffer memory in a sequentially updating fashion;

sequentially set a jump-from address and jump-to address to effect an address jump for successive readout of said given section;

cause a read address of said buffer memory to jump to the jump-to address when the read address of said buffer memory reaches the set jump-from address, to carry on reading out the sample data from the jump-to address onward; and for the at least part of said given section during the readout of the sample data of said given section, write the other sample data into said buffer memory, one sample per sampling period, time-divisionally with readout of the sample data, and then read out the other sample data from said buffer memory, by one predetermined unit segment at a time, to write the read-out other sample data into said storage device.

18. A sample data recording apparatus as claimed in claim 17 which further comprises a reproduction circuit coupled to said control device adapted to reproduce the sample data read out, sample by sample, from said buffer memory.

19. A method for, while transferring, from a storage device storing therein sample data, the sample data to a buffer memory and reading out the sample data from said buffer memory, recording other sample data into said storage device, said method comprising:

a step of sequentially reading out the sample data from said storage device, by one predetermined unit segment at a time, and then writing the sample data into said buffer memory;

a step of reading out the sample data from said buffer memory, one sample per sampling period;

a step of sequentially updating the sample data at addresses of said buffer memory where sample data readout has been completed, with the sample data newly read out from said storage device, by one unit segment at a time; and a step of recording other sample data separately input to at least part of a given section ranging across a plurality of unit segments while repetitively reading out the sample data of said given section, said step of recording including the steps of:

prior to readout of said given section, reading out, from said storage device, individual sample data of at least a first unit segment containing a fore end portion of said given section and a second unit segment containing a rear end portion of said given section, and then storing the read-out individual sample data into a first area of said buffer memory;

during the readout of said given section, reading out, from said storage device, the sample data of other unit segments than at least said first unit segment and said second unit segment, and storing the read-out sample data into a second area of said buffer memory in a sequentially updating fashion;

sequentially setting a jump-from address and jump-to address to effect an address jump for successive readout of said given section;

causing a read address of said buffer memory to jump to the jump-to address when the read address of said buffer memory reaches the set jump-from address, to carry on reading out the sample data from the jump-to address onward; and for the at least part of said given section during the readout of the sample data of said given section, writing the other sample data into said buffer memory, one sample per sampling period, time-divisionally with readout of the sample data, and then reading out the other sample data from said buffer memory, by a predetermined unit segment at a time, to write the read-out other sample data into said storage device.

20. A machine-readable storage medium containing a group of instructions to cause said machine to implement a method for recording sample data into a storage device, said method being directed to, while transferring, from said storage device storing therein sample data, the sample data to a buffer memory and reading out the sample data from said buffer memory, recording other sample data into said storage device, said method comprising:

a step of sequentially reading out the sample data from said storage device, by one predetermined unit segment at a time, and then writing the sample data into said buffer memory;

a step of reading out the sample data from said buffer memory, one sample per sampling period;

a step of sequentially updating the sample address at addresses of said buffer memory where sample data readout has been completed, with the sample data newly read out from said storage device, by one unit segment at a time; and a step of recording other sample data separately input to at least part of a given section ranging across a plurality of unit segments while repetitively reading out the sample data of said given section, said step of recording including the steps of:

prior to readout of said given section, reading out, from said storage device, individual sample data of at least a first unit segment containing a fore end portion of said given section and a second unit segment containing a rear end portion of said given section, and then storing the read-out individual sample data into a first area of said buffer memory;

during the readout of said given section, reading out, from said storage device, the sample data of other unit segments than at least said first unit segment and said second unit segment, and storing the read-out sample data into a second area of said buffer memory in a sequentially updating fashion;

sequentially setting a jump-from address and jump-to address to effect an address jump for successive readout of said given section;

causing a read address of said buffer memory to jump to the jump-to address when the read address of said buffer memory reaches the set jump-from address, to carry on reading out the sample data from the jump-to address onward; and for the at least part of said given section during the readout of the sample data of said given section, writing the other sample data into said buffer memory, one sample per sampling period, time-divisionally with readout of the sample data, and then reading out the other sample data from said buffer memory, by a predetermined unit segment at a time, to write the read-out other sample data into said storage device.

21. A recording/reproduction apparatus for recording and/or reproducing sound data to and/or from a storage device, said recording/reproduction apparatus comprising:

a basic waveform data storage section storing therein basic waveform data of a given tone;

a waveform editing section coupled with said basic waveform data storage section, said waveform editing section being adapted to read out the basic waveform data from said basic waveform data storage section to thereby perform a waveform editing arithmetic operation on the basic waveform data in accordance with a predetermined waveform editing calculation program and given waveform editing parameters;

a buffer memory; and a control device coupled with said storage device, said buffer memory and said waveform editing section, said control device being adapted to:

store, into one area of said buffer memory, the basic waveform data of the given tone having been subjected to the waveform editing arithmetic operation;

record input sound data into said storage device via another area of said buffer memory, and/or read out the sound data recorded in said storage device to thereby reproductively output the read-out sound data via the other area of said buffer memory; and read out and reproduce the basic waveform data of the given tone stored in the one area of said buffer memory, in synchronism with recording or reproduction of the sound data to or from said storage device, time-divisionally with writing and readout of the sound data to and from said buffer memory.

22. A recording/reproduction apparatus as claimed in claim 21 wherein the waveform editing parameters can be set via an operation by a user and each of the set waveform editing parameters is stored into said storage device, and wherein in response to designation of a song to be recorded or reproduced, corresponding ones of the waveform editing parameters are read out from said storage device and the waveform editing arithmetic operation is performed in accordance with the corresponding waveform editing parameters.

23. A recording/reproduction apparatus as claimed in claim 21 wherein the waveform editing parameters include a parameter instructing either one or both of a pitch shift amount and envelope waveform of the tone.

24. A method for recording and/or reproducing sound data to and/or from a storage device, said method comprising the steps of:

reading out basic waveform data from a basic waveform data storage section storing therein basic waveform data of a given tone;

performing a waveform editing arithmetic operation on the basic waveform data, read out via said step of reading out, in accordance with a predetermined waveform editing calculation program and given waveform editing parameters;

storing, into one area of said buffer memory, the basic waveform data of the given tone having been subjected to the waveform editing arithmetic operation;

recording input sound data into said storage device via another area of said buffer memory, and/or reading out the sound data recorded in said storage device to thereby reproductively output the read-out sound data via the other area of said buffer memory; and reading out and reproducing the basic waveform data of the given tone stored in the one area of said buffer memory, in synchronism with recording or reproduction of the sound data to or from said storage device, time-divisionally with writing and readout of the sound data to and from said buffer memory.

25. A machine-readable storage medium containing a group of instructions to cause said machine to implement a method for recording and/or reproducing sound data to and/or from a storage device, said method comprising the steps of:

reading out basic waveform data from a basic waveform data storage section storing therein basic waveform data of a given tone;

performing a waveform editing arithmetic operation on the basic waveform data, read out via said step of reading out, in accordance with a predetermined waveform editing calculation program and given waveform editing parameters;

storing, into one area of said buffer memory, the basic waveform data of the given tone having been subjected to the waveform editing arithmetic operation;

recording input sound data into said storage device via another area of said buffer memory, and/or reading out the sound data recorded in said storage device to thereby reproductively output the read-out sound data via the other area of said buffer memory; and reading out and reproducing the basic waveform data of the given tone stored in the one area of said buffer memory, in synchronism with recording or reproduction of the sound data to or from said storage device, time-divisionally with writing and readout of the sound data to and from said buffer memory.

26. A recording/reproduction apparatus for recording and/or reproducing sound data of a plurality of channels to and/or from a storage device, said recording/reproduction apparatus comprising:

a basic waveform data storage section storing therein basic waveform data of a given tone;

a waveform editing section coupled with said basic waveform data storage section, said waveform editing section being adapted to read out the basic waveform data from said basic waveform data storage section to perform a waveform editing arithmetic operation on the basic waveform data in accordance with a predetermined waveform editing calculation program and given waveform editing parameters;

a buffer memory including areas allocated to a plurality of channels and another area; and a control device coupled with said storage device, said buffer memory and said waveform editing section, said control device being adapted to:

store, into the other area of said buffer memory, the basic waveform data of the given tone having been subjected to the waveform editing arithmetic operation;

record input sound data of a plurality of channels into said storage device via the areas allocated to the plurality of channels of said buffer memory, and/or read out the sound data recorded in said storage device to thereby reproductively output the read-out sound data via the areas allocated to the plurality of channels of said buffer memory; and read out and reproduce the basic waveform data of the given tone stored in the one area of said buffer memory, in synchronism with recording or reproduction of the sound data to or from said storage device, time-divisionally with writing and readout of the sound data to and from said buffer memory.

27. A method for recording and/or reproducing sound data of a plurality of channels to and/or from a storage device via a buffer memory, said buffer memory including areas allocated to a plurality of channels and another area, said method comprising the steps of:

reading out basic waveform data from a basic waveform data storage section storing therein basic waveform data of a given tone;

performing a waveform editing arithmetic operation on the basic waveform data read out via said step of reading, in accordance with a predetermined waveform editing calculation program and given waveform editing parameters;

storing, into the other area of said buffer memory, the basic waveform data of the given tone having been subjected to the waveform editing arithmetic operation;

recording input sound data of a plurality of channels into said storage device via the areas allocated to the plurality of channels of said buffer memory, and/or reading out the sound data recorded in said storage device to thereby reproductively output the read-out sound data via the areas allocated to the plurality of channels of said buffer memory; and reading out and reproducing the basic waveform data of the given tone stored in the one area of said buffer memory, in synchronism with recording or reproduction of the sound data to or from said storage device, time-divisionally with writing and readout of the sound data to and from said buffer memory.

28. A machine-readable storage medium containing a group of instructions to cause said machine to implement a method for recording and/or reproducing sound data to and/from a storage device, said buffer memory including areas allocated to a plurality of channels and another area, said method comprising the steps of:

reading out basic waveform data from a basic waveform data storage section storing therein basic waveform data of a given tone;

performing a waveform editing arithmetic operation on the basic waveform data read out via said step of reading, in accordance with a predetermined waveform editing calculation program and given waveform editing parameters;

storing, into the other area of said buffer memory, the basic waveform data of the given tone having been subjected to the waveform editing arithmetic operation;

recording input sound data of a plurality of channels into said storage device via the areas allocated to the plurality of channels of said buffer memory, and/or reading out the sound data recorded in said storage device to thereby reproductively output the read-out sound data via the areas allocated to the plurality of channels of said buffer memory; and reading out and reproducing the basic waveform data of the given tone stored in the one area of said buffer memory, in synchronism with recording or reproduction of the sound data to or from said storage device, time-divisionally with writing and readout of the sound data to and from said buffer memory.

29. A buffer device for use with an apparatus for recording sample data of a plurality of channels into a storage device, said buffer device comprising:

a memory including a plurality of banks; and a control device coupled with said memory and adapted to:

assign a plurality of channels to respective separate banks, and time-divisionally write input sample data of a plurality of recording channels, one sample within each sampling period, into corresponding ones of the banks of said memory while sequentially switching between the banks on a sample-by-sample basis;

sequentially read out the sample data of individual ones of the recording channels, written in said memory, in predetermined order, and transfer the read-out sample data to said storage device; and write, into addresses, of the sample data of each of the recording channels, in said memory where readout of the sample data has been completed, newly-input sample data of a corresponding recording channel, to thereby sequentially update the sample data of the individual recording channels in said memory.

30. A buffer device as claimed in claim 29 wherein two or more of the channels are assigned to each one of the banks of said memory, and the sample data of the individual recording channels are written into said memory in such order as to prevent the channels assigned to a same bank from being written in succession.

31. A buffer device as claimed in claim 29 wherein for readout, from said memory, of the sample data of each of the recording channels, a predetermined quantity of the sample data are collectively read out from said memory on a channel-by-channel time-divisional basis, for each of the recording channels for which the predetermined quantity of sample data have been newly written into said memory.

32. A buffer device as claimed in claim 29 wherein a time period of each sample is divided into a first time for writing the sample data of the recording channel into said memory, and a second time for reading out the sample data of the recording channel from said memory to transfer the sample data to said storage device, said second time being set to be longer than said first time, wherein a total number of the sample data of the recording channel to be read out from said memory within each sampling period is set to be greater than a total number of the sample data of the recording channel to be written into said memory within the sampling period, and wherein there is provided a particular sampling period when readout of the sample data of the recording channel from said memory is not carried out.

33. A buffer device as claimed in claim 29 wherein sample data of a given tone are stored in a particular one of the banks of said memory, and wherein readout of the sample data of the given tone from said memory is carried out time-divisionally with writing of the sample data of each of the recording channels into said memory.

34. A buffer method for recording sample data of a plurality of channels into a storage device via a memory, said memory including a plurality of banks, said buffer method comprising the steps of:

assigning a plurality of channels to respective separate banks, and writing input sample data of a plurality of recording channels, one sample within each sampling period, into corresponding ones of the banks of said memory while sequentially switching between the banks on a sample-by-sample basis;

sequentially reading out the sample data of individual ones of the recording channels written in said memory in predetermined order, and transferring the read-out sample data to said storage device; and writing, into addresses, of the sample data of each of the recording channels, in said memory where readout of the sample data has been completed, newly-input sample data of a corresponding recording channel, to thereby sequentially update the sample data of the individual recording channels in said memory.

35. A machine-readable storage medium containing a group of instructions to cause said machine to implement a buffer method for recording sample data of a plurality of channels into a storage device via a memory, said memory including a plurality of banks, said buffer method comprising the steps of:

assigning a plurality of channels to respective separate banks, and writing input sample data of a plurality of recording channels, one sample within each sampling period, into corresponding ones of the banks of said memory while sequentially switching between the banks on a sample-by-sample basis;

sequentially reading out the sample data of individual ones of the recording channels written in said memory in predetermined order, and transferring the read-out sample data to said storage device; and writing, into addresses, of the sample data of each of the recording channels, in said memory where readout of the sample data has been completed, newly-input sample data of a corresponding recording channel, to thereby sequentially update the sample data of the individual recording channels in said memory.

36. A buffer device for use with an apparatus for reproducing sample data of a plurality of channels from a storage device, said buffer device comprising:

a memory including a plurality of banks; and a control device coupled with said memory and adapted to:

assign a plurality of channels to respective separate banks, and write sample data of a plurality of reproduction channels, sequentially read out from said storage device in predetermined order and transferred to said buffer device, into corresponding ones of the banks of said memory;

time-divisionally read out the sample data of individual ones of the reproduction channels written in said memory, one sample within each sampling period, while sequentially switching between the banks on a sample-by-sample basis; and write, into addresses, of the sample data of each of the reproduction channels, in said memory where readout of the sample data has been completed, sample data of a corresponding reproduction channel newly transferred from said storage device, to thereby sequentially update the sample data of individual ones of the reproduction channels in said memory.

37. A buffer device as claimed in claim 36 wherein two or more of the channels are assigned to each one of the banks of said memory, and the sample data of the individual reproduction channels are read out from said memory in such order as to prevent the channels assigned to a same bank from being written in succession.

38. A buffer device as claimed in claim 36 wherein for writing, in said memory, of the sample data of the individual reproduction channels, a predetermined quantity of the sample data are collectively written into said memory on a channel-by-channel time-divisional basis, for each of the reproduction channels for which the predetermined quantity of sample data have been read out from said memory.

39. A buffer device as claimed in claim 36 wherein a time period of each sample is divided into a first time for reading out the sample data of the recording channel from said memory, and a second time for writing the sample data of the reproduction channel, read out from said storage device, into said memory, said second time being set to be longer than said first time, wherein a total number of the sample data of the reproduction channel to be written into said memory within each sampling period is set to be greater than a total number of the sample data of the reproduction channel to be read out from said memory within the sampling period, and wherein there is provided a particular sampling period when writing of the sample data of the reproduction channel into said memory is not carried out.

40. A buffer device as claimed in claim 36 wherein sample data of a given tone are stored in a particular one of the banks of said memory, and wherein readout of the sample data of the given tone from said memory is carried out time-divisionally with readout of the sample data of each of the reproduction channels from said memory.

41. A buffer method for reproducing sample data of a plurality of channels from a storage device, said memory including a plurality of banks, said buffer method comprising the steps of:

assigning a plurality of channels to respective separate banks, and writing sample data of a plurality of reproduction channels, sequentially read out from said storage device in predetermined order and transferred to said buffer device, into corresponding ones of the banks of said memory;

time-divisionally reading out the sample data of individual ones of the reproduction channels written in said memory, one sample within each sampling period, while sequentially switching between the banks on a sample-by-sample basis; and writing, into addresses, of the sample data of each of the reproduction channels, in said memory where readout of the sample data has been completed, sample data of a corresponding reproduction channel newly transferred from said storage device, to thereby sequentially update the sample data of individual ones of the reproduction channels in said memory.

42. A machine-readable storage medium containing a group of instructions to cause said machine to implement a buffer method for reproducing sample data of a plurality of channels from a storage device, said memory including a plurality of banks, said buffer method comprising the steps of:

assigning a plurality of channels to respective separate banks, and writing sample data of a plurality of reproduction channels, sequentially read out from said storage device in predetermined order and transferred to said buffer device, into corresponding ones of the banks of said memory;

time-divisionally reading out the sample data of individual ones of the reproduction channels written in said memory, one sample within each sampling period, while sequentially switching between the banks on a sample-by-sample basis; and writing, into addresses, of the sample data of each of the reproduction channels, in said memory where readout of the sample data has been completed, sample data of a corresponding reproduction channel newly transferred from said storage device, to thereby sequentially update the sample data of individual ones of the reproduction channels in said memory.

43. A buffer device for use with an apparatus for recording and reproducing sample data of a plurality of channels to and from a storage device, said buffer device comprising:

a memory including a plurality of banks; and a control device coupled with said memory and adapted to:

assign a plurality of recording and reproduction channels to respective separate banks;

time-divisionally write input sample data of a plurality of recording channels, into corresponding ones of the banks of said memory;

sequentially read out the sample data of individual ones of the recording channels, written in said memory, in predetermined order, and transfer the read-out sample data to said storage device;

write, into addresses, of the sample data of each of the recording channels, in said memory where readout of the sample data has been completed, newly-input sample data of a corresponding recording channel, to thereby sequentially update the sample data of the individual recording channels in said memory;

write sample data of a plurality of reproduction channels, sequentially read out from said storage device in predetermined order and transferred to said buffer device, into corresponding ones of the banks of said memory;

time-divisionally read out and output the sample data of individual ones of the reproduction channels written in said memory; and write, into addresses, of the sample data of each of the reproduction channels, in said memory where readout of the sample data has been completed, sample data of a corresponding reproduction channel newly transferred from said storage device, to thereby sequentially update the sample data of the individual reproduction channels in said memory, wherein said control device carries out writing of the sample data of the recording channels into said memory and readout of the sample data of the reproduction channels from said memory, one sample within each sampling period, while sequentially switching between the banks on a sample-by-sample basis.

44. A buffer device as claimed in claim 43 wherein two or more of the channels are assigned to each one of the banks of said memory, and the writing of the sample data of the recording channels into said memory and the readout of the sample data of the reproduction channels from said memory are carried out in such order as to prevent the channels assigned to a same bank from being written in succession.

45. A buffer device as claimed in claim 43 wherein for the readout, from said memory, of the sample data of each of the recording channels and for the writing, into said memory, of the sample data of each of the reproduction channels, a predetermined quantity of the sample data are collectively read out or written from or to said memory on a channel-by-channel time-divisional basis, for each of the recording channels for which the predetermined quantity of sample data have been newly written into said memory or for each of the reproduction channels for which the predetermined quantity of sample data have been newly read out from said memory.

46. A buffer device as claimed in claim 43 wherein a time period of each sample is divided into a first time for writing the sample data of the recording channel into said memory and reading out the sample data of the reproduction channel from said memory, and a second time for reading out the sample data of the recording channel from said memory to transfer the sample data to said storage device and writing the sample data of the reproduction channel, read out from said storage device, into said memory, said second time being set to be longer than said first time, wherein a total number of the sample data of the recording channel to be read out from said memory within each sampling period is set to be greater than a total number of the sample data of the recording channel to be written into said memory within the sampling period, and a total number of the sample data of the reproduction channel to be written into said memory within each sampling period is set to be greater than a total number of the sample data of the reproduction channel to be read out from said memory within the sampling period, and wherein there is provided a particular sampling period when readout of the sample data of the recording channel from said memory and writing of the sample data of the reproduction channel into said memory are not carried out.

47. A buffer device as claimed in claim 43 wherein sample data of a given tone are stored in a particular one of the banks of said memory, and wherein readout of the sample data of the given tone from said memory is carried out time-divisionally with writing of the sample data of each of the recording channels and readout of the sample data of each of the reproduction channels to and from said memory.

48. A buffer method for recording and reproducing sample data of a plurality of channels to and from a storage device via a memory, said memory including a plurality of banks, said buffer method comprising the steps of:

assigning a plurality of recording and reproduction channels to respective separate banks;

time-divisionally writing input sample data of a plurality of recording channels, into corresponding ones of the banks of said memory;

sequentially reading out the sample data of individual ones of the recording channels, written in said memory, in predetermined order, and transferring the read-out sample data to said storage device;

writing, into addresses, of the sample data of each of the recording channels, in said memory where readout of the sample data has been completed, newly-input sample data of a corresponding recording channel, to thereby sequentially update the sample data of the individual recording channels in said memory; and writing sample data of a plurality of reproduction channels, sequentially read out and transferred from said storage device in predetermined order, into corresponding ones of the banks of said memory;

time-divisionally reading out and outputting the sample data of individual ones of the reproduction channels written in said memory; and writing, into addresses, of the sample data of each of the reproduction channels, in said memory where readout of the sample data has been completed, sample data of a corresponding reproduction channel newly transferred from said storage device, to thereby sequentially update the sample data of the individual reproduction channels in said memory, wherein writing of the sample data of the recording channels into said memory and readout of the sample data of the reproduction channels from said memory are carried out, one sample within each sampling period, by sequentially switching between the banks on a sample-by-sample basis.

49. A machine-readable storage medium containing a group of instructions to cause said machine to implement a buffer method for recording and reproducing sample data of a plurality of channels to and from a storage device via a memory, said memory including a plurality of banks, said buffer method comprising the steps of:

assigning a plurality of recording and reproduction channels to respective separate banks;

time-divisionally writing input sample data of a plurality of recording channels, into corresponding ones of the banks of said memory;

sequentially reading out the sample data of individual ones of the recording channels, written in said memory, in predetermined order, and transferring the read-out sample data to said storage device;

writing, into addresses, of the sample data of each of the recording channels, in said memory where readout of the sample data has been completed, newly-input sample data of a corresponding recording channel, to thereby sequentially update the sample data of the individual recording channels in said memory; and writing sample data of a plurality of reproduction channels, sequentially read out and transferred from said storage device in predetermined order, into corresponding ones of the banks of said memory;

time-divisionally reading out and outputting the sample data of individual ones of the reproduction channels written in said memory; and writing, into addresses, of the sample data of each of the reproduction channels, in said memory where readout of the sample data has been completed, sample data of a corresponding reproduction channel newly transferred from said storage device, to thereby sequentially update the sample data of the individual reproduction channels in said memory, wherein writing of the sample data of the recording channels into said memory and readout of the sample data of the reproduction channels from said memory are carried out, one sample within each sampling period, by sequentially switching between the banks on a sample-by-sample basis.

* * * * *